US011759929B2

(12) United States Patent
Koenig et al.

(10) Patent No.: US 11,759,929 B2
(45) Date of Patent: Sep. 19, 2023

(54) POWER TOOL SOUND DAMPING

(71) Applicant: Black & Decker Inc., New Britain, CT (US)

(72) Inventors: Trevor Koenig, Lancaster, PA (US); Michael F. Cannaliato, Bel Air, MD (US); Brent Kuehne, Red Lion, PA (US); Anthony Reth, Baltimore, MD (US); Nicholas A. Mondich, Baltimore, MD (US); Steven McClaskey, North Las Vegas, NV (US); Xin Lei Wang, Suzhou (CN); Yufeng Chen, Suzhou (CN); Paul G. Gross, White Marsh, MD (US); Marco A. Mattucci, Fallston, MD (US); Ashok Samuel Baskar, Lutherville, MD (US)

(73) Assignee: Black & Decker Inc., New Britain, CT (US)

( * ) Notice: Subject to any disclaimer, the term of this patent is extended or adjusted under 35 U.S.C. 154(b) by 401 days.

(21) Appl. No.: 16/901,658

(22) Filed: Jun. 15, 2020

(65) Prior Publication Data

US 2020/0306942 A1 Oct. 1, 2020

Related U.S. Application Data

(63) Continuation of application No. 14/747,410, filed on Jun. 23, 2015, now Pat. No. 10,717,179, which is a continuation-in-part of application No. 14/444,982, filed on Jul. 28, 2014, now Pat. No. 10,022,848.

(30) Foreign Application Priority Data

Apr. 10, 2015 (WO) ..... PCT/CN2015/076257

(51) Int. Cl.
*B25C 1/06* (2006.01)
*B25F 5/00* (2006.01)

(52) U.S. Cl.
CPC ..... *B25C 1/06* (2013.01); *B25F 5/00* (2013.01)

(58) Field of Classification Search
CPC ..... B25C 1/06; B25F 5/00
See application file for complete search history.

(56) References Cited

U.S. PATENT DOCUMENTS 3,193,049 A * 7/1965 Wollek ..... F16F 9/306 428/152
3,263,770 A * 8/1966 Alm ..... B25D 17/12 181/230
3,807,281 A * 4/1974 Perkins ..... B25C 1/047 91/461
3,809,179 A * 5/1974 Delaney, Jr ..... B25F 5/00 181/230

(Continued)

*Primary Examiner* — Nathaniel C Chukwurah
*Assistant Examiner* — Lucas E. A. Palmer

(57) ABSTRACT

A power tool having one or more sound damping members which reduce sound and/or vibration from one or more parts of a power tool. The sound damping member can reduce sound and/or vibration from static or dynamic parts of a power tool. The sound damping member can reduce noise and/or vibration from one or more rotating or moving parts of a power tool and its housing or internal structure. Methods, means, controls, systems and practices for reducing or eliminating undesired sound from a power tool are disclosed.

20 Claims, 49 Drawing Sheets

(56) References Cited

U.S. PATENT DOCUMENTS 4,509,669 A * 4/1985 Elliesen ..... B25C 1/047 91/243
5,445,232 A * 8/1995 Brannstrom ..... B25D 17/28 173/100
2003/0094294 A1* 5/2003 Fritz ..... B25H 3/006 173/171
2004/0219322 A1* 11/2004 Fisher ..... B60R 13/08 428/40.1
2006/0219418 A1* 10/2006 Arakawa ..... B25F 5/006 173/162.1
2007/0295522 A1* 12/2007 Bohne ..... B25D 17/24 173/162.2
2008/0025017 A1* 1/2008 Tadokoro ..... B25F 5/021 362/119
2008/0073095 A1* 3/2008 Henriksson ..... B25D 17/24 173/162.2
2008/0164043 A1* 7/2008 Henriksson ..... B25D 17/24 173/162.1
2010/0123359 A1* 5/2010 Nishikawa ..... B25B 21/00 310/58
2010/0181085 A1* 7/2010 Imada ..... B25F 5/02 173/162.2
2011/0314589 A1* 12/2011 Vito ..... A42B 1/08 2/181
2012/0160533 A1* 6/2012 Kamegai ..... B25D 17/20 173/162.2
2013/0092408 A1* 4/2013 Oberheim ..... B25F 5/006 188/267.2
2014/0360744 A1* 12/2014 Lawrence ..... B25B 23/1453 173/218
2016/0023342 A1* 1/2016 Koenig ..... B25C 1/06 173/124
2016/0377139 A1* 12/2016 Vito ..... B32B 5/024 267/141
2018/0187540 A1* 7/2018 Hanski ..... E21B 49/003
2020/0058281 A1* 2/2020 Luoma ..... E21B 7/025
2021/0053201 A1* 2/2021 Mandal ..... B25B 21/02

* cited by examiner

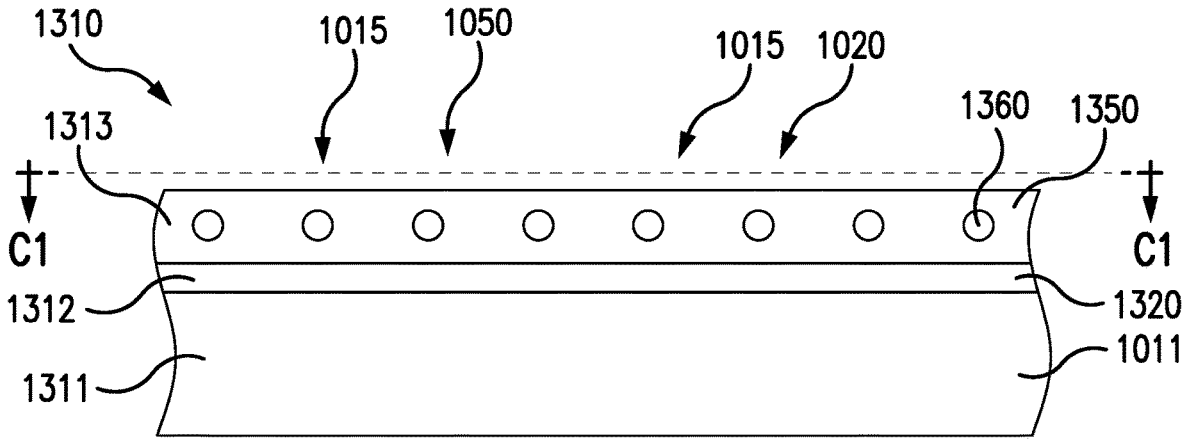
FIG. 7C1
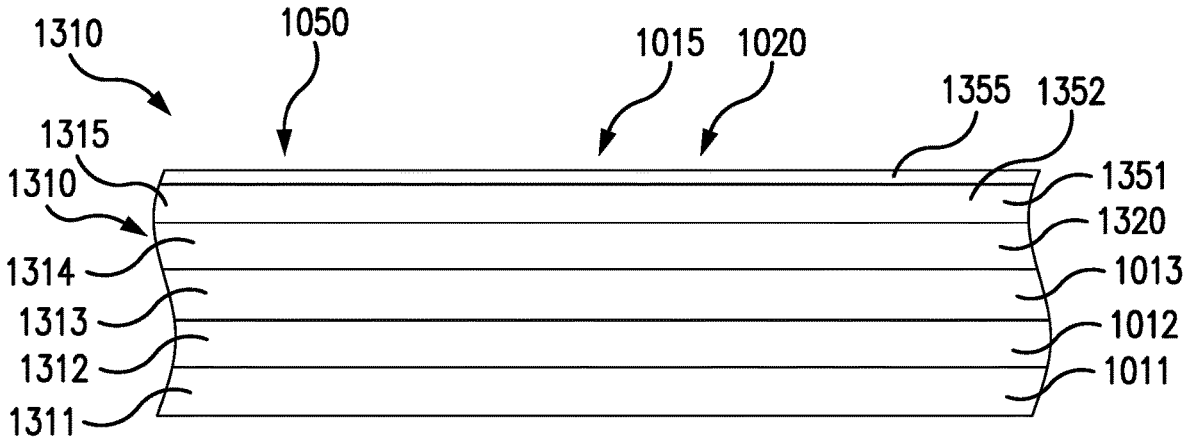
FIG. 7C2

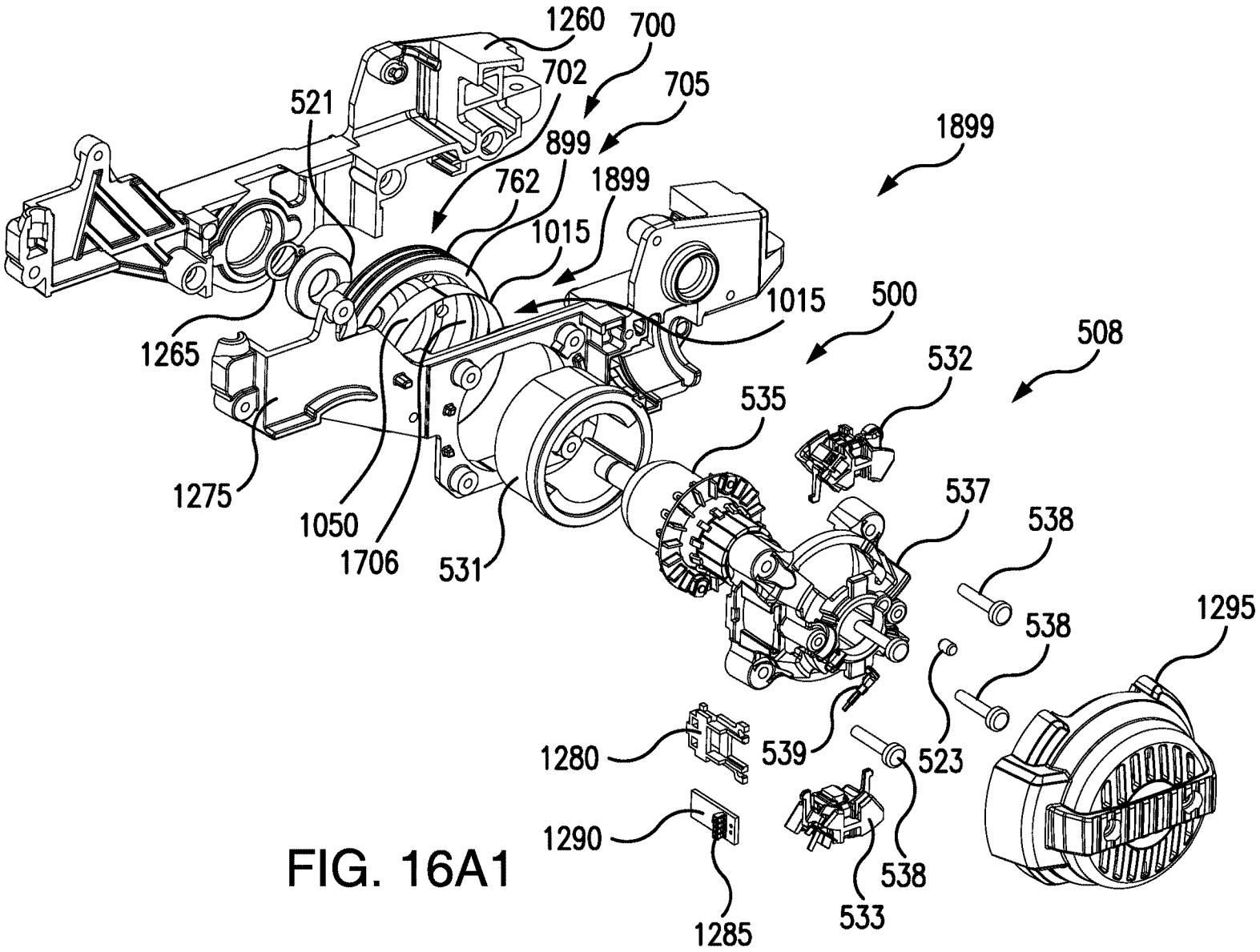
FIG. 16A1

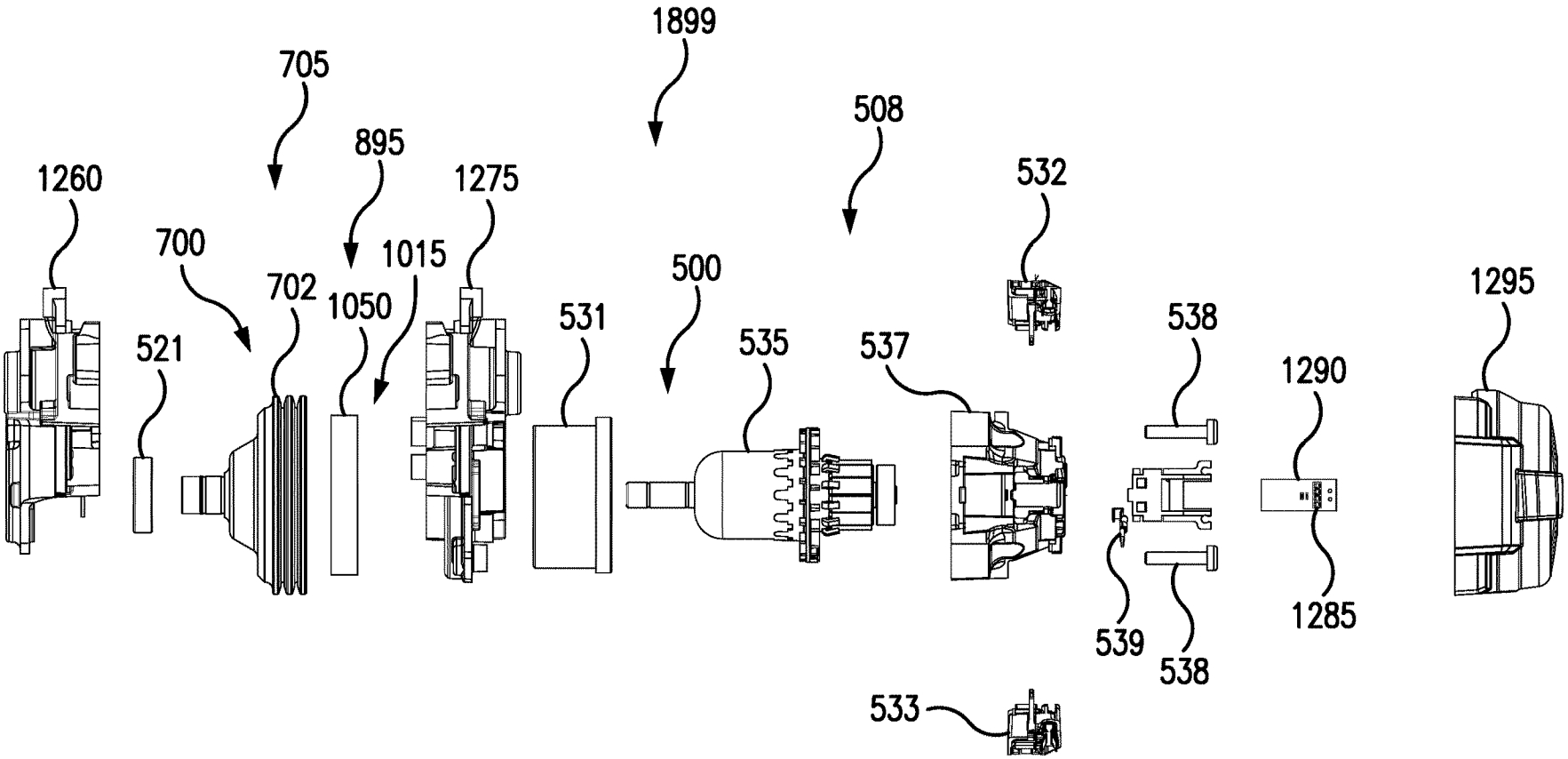
FIG. 16A2

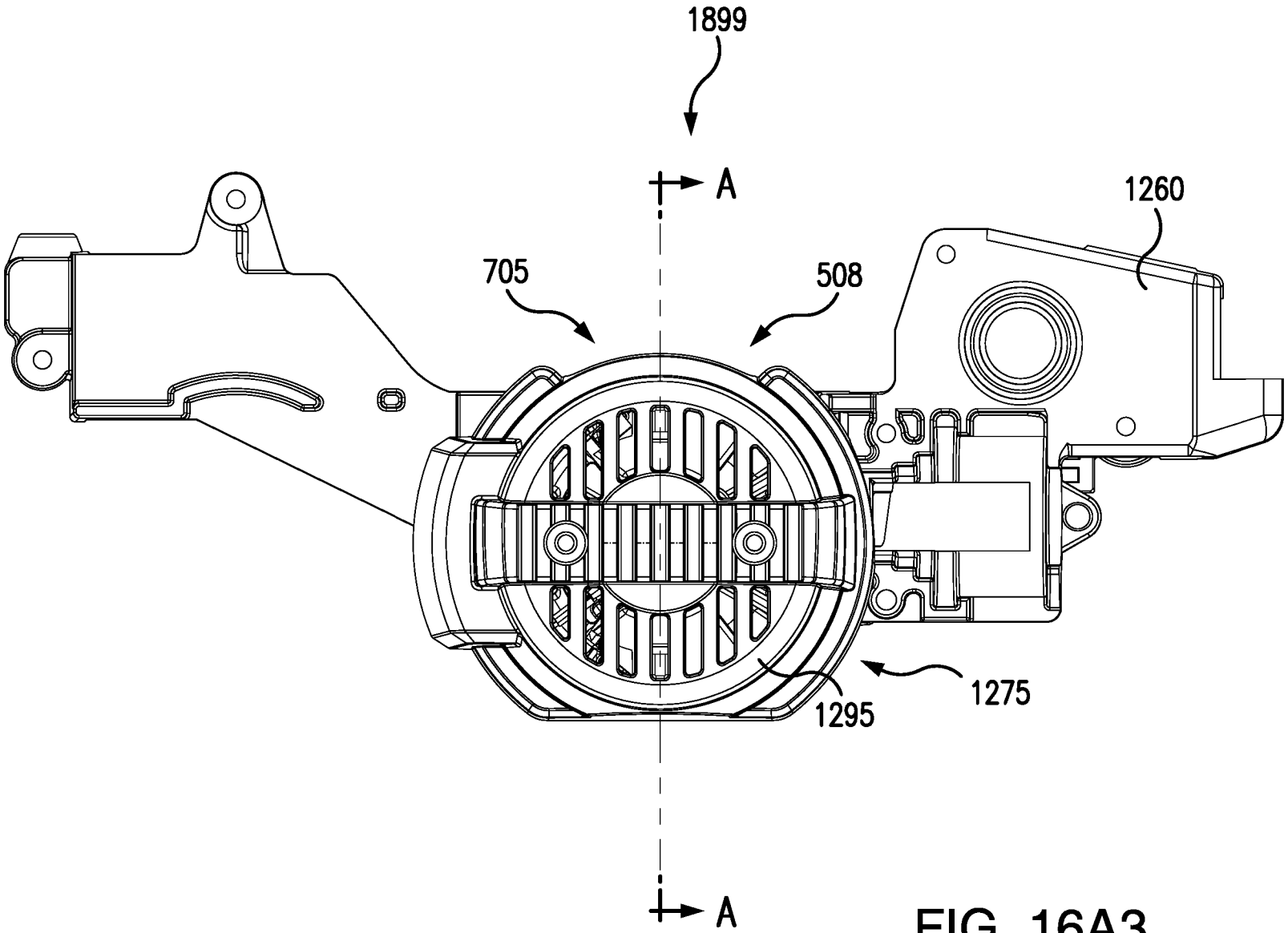
FIG. 16A3

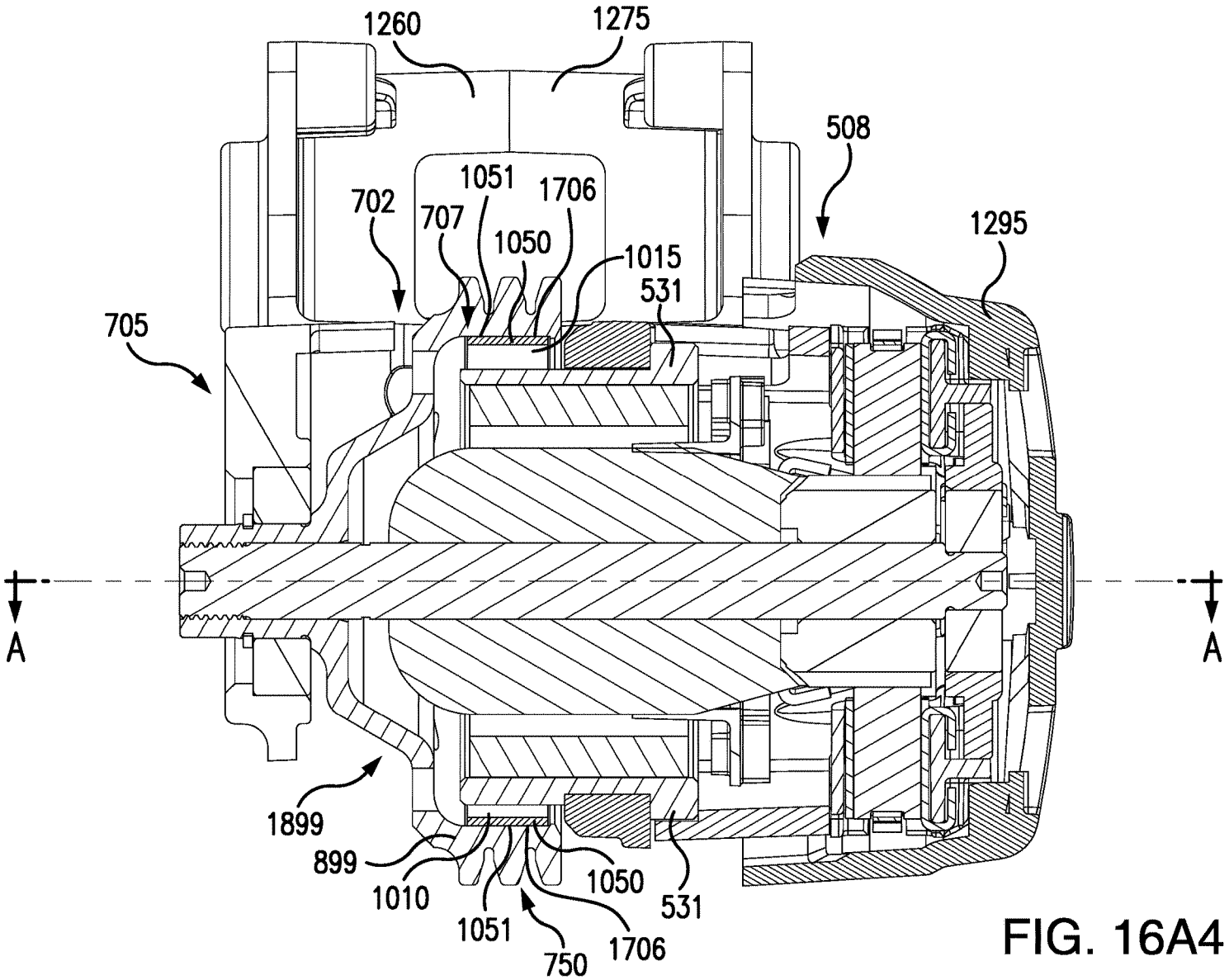
FIG. 16A4

POWER TOOL SOUND DAMPING

CROSS-REFERENCE TO RELATED APPLICATIONS

This application is a continuation of U.S. patent application Ser. No. 14/747,410 entitled "Sound Damping for Power Tools", filed Jun. 23 2015, which is a continuation-in-part of and U.S. patent application Ser. No. 14/444,982 entitled "Power Tool Drive Mechanism" filed Jul. 28, 2014, now U.S. Pat. No. 10,022,048. This application also claims benefit of PCT Application No. PCT/CN2015/076257 entitled "Sound Damping for Power Tools" filed Apr. 10, 2015. All of the above applications are incorporated herein by reference.

FIELD OF THE INVENTION

The present invention relates to sound damping for power tools.

BACKGROUND OF THE INVENTION

Fastening tools, such as nailers, are used in the construction trades. However, many fastening tools which are available are insufficient in design, expensive to manufacture, heavy, not energy efficient, lack power, have dimensions which are inconveniently large and cause operators difficulties when in use. Further, many available fastening tools do not adequately guard the moving parts of a nailer driving mechanism from damage.

Additionally, many power tools, such as fastening tools, emit excess sound and/or noise. Such excess sound and/or noise can be unpleasant to the user and others within a hearing distance thereof.

Further, many fastening tools which are available are inconveniently bulky and have systems for driving a fastener which have dimensions that require the fastening tool to be larger than desired. For example, drive systems having a motor which turns a rotor can require clutches, transmissions, control systems and kinetic parts which increase stack up and limit the ability of a power tool to be reduced in size while retaining sufficient power to achieve a desired performance.

There is a strong need for a fastening tool having an improved motor and drive mechanism. A strong need also exists for a fastening tool which has improved sound characteristics.

SUMMARY OF THE INVENTION

A power tool, such as a fastening tool, can have one or more sound damping members which can control, manage, reduce and eliminate undesired sound and/or noise emitted from such tools. Herein, "sound" and "noise" are used synonymously.

In an embodiment, the fastening tool can have an electric motor having a rotor which has a rotor shaft which is coupled to a flywheel. The flywheel can have a sound damping member. The sound damping member can have a sound damping material. In an embodiment, the sound damping member can be a sound damping tape. The sound damping member can have a polymer. The sound damping member can be a powder coat and/or a powder coating applied to at least a portion of a power tool member, piece and/or structure, such as a flywheel and/or housing. The powder coat can be a coating which covers a surface of a power tool part in-part or wholly.

In an embodiment, the sound damping member can have one or a plurality of layers. The sound damping member can be a single material and/or a single layer, or the sound damping member can be a laminate having a plurality of layers of the same or different materials.

Herein, a vibration absorption member is a type of sound damping member. In an embodiment, the sound damping member vibration absorption member. In an embodiment, the vibration absorption member can have one or a plurality of layers. The vibration absorption member can be a single material and/or a single layer, or the sound damping member can be a laminate having a plurality of layers of the same or different materials.

In non-limiting example, the flywheel having the sound damping member can have a vibration damping ratio of 0.050% or greater. In another non-limiting example, The frequency response for a flywheel having a sound damping member can be less than 800 (m/s^2)/$lb_f$ in a range from 20 Hz to 20,000 Hz.

The electric motor can have an inner rotor. The flywheel can have a portion which is cantilevered over at least a portion of the electric motor. The flywheel can have a contact surface adapted to impart energy from the flywheel when contacted by a moveable member.

In an embodiment, a power tool can have an electric motor having a rotor having a rotor shaft. The rotor shaft coupled to a metal flywheel which can have a contact surface adapted to impart energy from the metal flywheel when contacted with a moveable member. The metal flywheel can have a sound damping member which can receive at least a vibrational energy from the metal flywheel. The metal flywheel can have a vibration absorption member which can receive at least a vibrational energy from the metal flywheel. The metal flywheel can have a portion which is cantilevered over at least a portion of the electric motor. The portion which is cantilevered can overlap at least a portion of the electric motor. The metal flywheel's portion which is cantilevered over at least a portion of the electric motor can be adapted to rotate radially about at least a portion of the electric motor.

In an embodiment, the sound damping member can be affixed to an inner surface of the portion of the metal flywheel which is cantilevered over at least a portion of the electric motor. The sound damping member can comprise a plurality of layers, or be a laminate. The sound damping member can have a sound damping material. In an embodiment, the sound damping member can have a metal layer.

In an embodiment, the power tool can have a sound damping member which is a laminate and which is adhered to at least a portion of the power tool. In an embodiment, the power tool having a sound damping member can be a nailer. In an embodiment, the power tool having a sound damping member can be an impact driver.

In an embodiment, a power tool can have an electric motor having a rotor which has a rotor shaft. The rotor shaft can be coupled to a flywheel which can have a potion which is cantilevered over at least a portion of the rotor. The flywheel can also have a contact surface adapted to impart energy from the flywheel when contacted by a moveable member. The overlapping portion can be adapted to rotate radially about at least a portion of the motor. The power tool can have a motor which has an inner rotor, or a motor which has an outer rotor. The flywheel can have a portion which is cantilevered over at least a portion of the rotor.

In an embodiment, a power tool can have an electric motor having a motor housing and a rotor having a rotor shaft. The rotor shaft can be coupled to a flywheel which can have a potion which is cantilevered over at least a portion of the motor housing. The flywheel can also have a contact surface adapted to impart energy from the flywheel when contacted by a moveable member. The overlapping portion can be adapted to rotate radially about at least a portion of the motor housing. The power tool can have a motor which has an inner rotor, or a motor which has an outer rotor.

The power tool can have an overlapping portion which supports a flywheel ring which can have a contact surface. Optionally, the contact surface can have a geared portion. The contact surface can optionally have at least one grooved portion. The contact surface can optionally have at least one toothed portion.

In an embodiment, the power tool can have a flywheel ring and a rotor shaft which rotate in a ratio in a range of 0.5:1.5 to 1.5:0.5; such as in a range of 1:1.5 to 1.5:1. In an embodiment, the power tool can have a flywheel ring and a rotor shaft which rotate in a ratio of about 1:1. In an embodiment, the power tool can have a flywheel ring and a rotor shaft which rotate in a ratio of 1:1. The power tool can also have a flywheel ring which rotates at a speed in a range of from about 2500 rpm to about 20000 rpm. The power tool can also have a flywheel ring which rotates at a speed in a range of from about 5600 rpm to about 10000 rpm. In another embodiment, the power tool can have a flywheel ring which has a contact surface which has a speed in a range of from about 20 ft/s to about 200 ft/s. In yet another embodiment, the power tool can have a flywheel ring which has an inertia in a range of from about 10 J(kg*m^2) to about 500 J(kg*m^2).

In an embodiment, the power tool can have a flywheel ring which rotates in a plane parallel to a driver profile centerline plane. The power tool can also have a moveable member which is a driver blade which has a driving action which is energized by a transfer of energy from a contact of the driver blade with the flywheel. The power tool can also have a moveable member which is a driver profile which has a driving action which is energized by a transfer of energy from a contact of the driver profile with the flywheel.

The power tool can be a cordless power tool. The power tool can be a cordless nailer and can be adapted to drive a nail. The power tool can also be driven by a power cord, or be pneumatic, or receive power from another source.

In an embodiment, a fastening device can have a motor having a cantilevered flywheel. The cantilevered flywheel can have a contact surface adapted for frictional contact with a driving member adapted to drive a fastener. The fastening device can have a motor which has an inner rotor, or a motor which has an outer rotor. The motor can be a brushed motor or a brushless motor. The motor can be an inner rotor motor which can be a brushed motor or an outer rotor motor which can be a brushed motor. The motor can be an inner rotor motor which can be a brushless motor or an outer rotor motor which can be a brushless motor.

In an embodiment, the fastening device can also have a cupped flywheel. The cupped flywheel can have a flywheel ring. In an embodiment, at least a portion of the cupped flywheel can be cantilevered over at least a portion of the motor and/or motor housing. The cupped flywheel can have a contact surface. The cupped flywheel can have a geared flywheel ring. Herein, a grooved surface of a flywheel ring is considered to be a type of gearing; and a grooved surface to be a type of geared surface.

In an embodiment, the cupped flywheel can have a mass in a range of from about 1 oz to about 20 oz. In another embodiment, the fastening device can have a cantilevered flywheel which can have a diameter in a range of from about 0.75 to about 12 inches. The cantilevered flywheel can be adapted to rotate at an angular velocity of from about 500 rads/s to about 1500 rads/s. The cantilevered flywheel can be adapted to have a flywheel energy in a range of from about 10 j to about 1500 j.

In an embodiment, the fastening device can have a driving member which is driven with a driving force of from about 2 j to about 1000 j. In another embodiment, the fastening device can have a driving member which is driven at a speed of from about 10 ft/s to about 300 ft/s. The fastening device can have a driving member which is a driver blade. The fastening device can have a driving member which is a driver profile.

The fastening device can have a direct drive mechanism. In an embodiment, the direct drive mechanism can have a cantilevered flywheel. In another aspect, the fastening device can have a drive mechanism which is clutch-free.

The fastening device can be a nailer and can be adapted to drive a fastener which is a nail.

In an embodiment, a power tool can have a motor having a rotor and a flywheel adapted for turning by the rotor. The flywheel can have a flywheel portion which is positioned radially over at least a portion of the motor. In an embodiment, the flywheel portion can be at least a part of a flywheel ring, or can be a flywheel ring. In an embodiment, the flywheel portion can be at least a part of a flywheel body, or a flywheel body. In an embodiment, the flywheel portion can be at least a part of a cupped flywheel, or a cupped flywheel.

In an embodiment, the power tool can have a flywheel which is a cupped flywheel. The flywheel body can have a flywheel inner circumference which is configured radially about at least a portion of the motor. In another embodiment, the power tool can have a flywheel which is a cupped flywheel and which has a flywheel ring having at least a part which positioned radially over at least a portion of the motor.

In an embodiment, the power tool can have a motor housing which houses at least a portion of the motor and a flywheel portion which is positioned radially over at least a portion of the motor housing.

In an embodiment, the power tool can have a flywheel adapted for clutch-free turning by the motor. In another embodiment, the power tool can have a flywheel adapted for transmission-free turning by the motor. In yet another embodiment, the power tool can have a flywheel which can be adapted for turning by the rotor in a ratio of 1 turn of the flywheel to 1 turn of the rotor. In even another embodiment, the power tool can have a flywheel which can be adapted for turning by the rotor in a ratio of 1.5 turn of the flywheel to 1 turn of the rotor to 1.0 turn of the flywheel to 1.5 turn of the rotor.

In an embodiment, the power tool can be a fastening device. In another embodiment, the power tool can be a fastening device adapted to drive a nail into a workpiece.

In an embodiment, a power tool can have a motor having a rotor axis and a flywheel adapted for turning by the motor. The flywheel can have a flywheel portion coaxial to the rotor axis and which is at least in part located over at least a portion of the motor. The power tool can have a flywheel body having a flywheel body portion which radially surrounds at least a portion of the motor. The power tool can have a cupped flywheel having a cupped flywheel portion which radially surrounds at least a portion of the motor. The power tool can have a cupped flywheel having a flywheel ring and in which a portion of the flywheel ring is adapted to rotate coaxial to the rotor axis. The power tool can have a flywheel portion which has a flywheel contact surface which is adapted to rotate coaxial to the rotor axis. In an embodiment, the flywheel contact surface which can be adapted to have a velocity of at least 10 ft/s and in which the flywheel contact surface can be adapted to revolve coaxially about the rotor axis.

In an embodiment, the power tool can have a flywheel portion which is a cantilevered portion. The power tool can have a flywheel portion which is cantilevered over at least a portion of the motor. The flywheel portion which is cantilevered over at least a portion of the motor can have a contact surface.

In another embodiment, the power tool can have a flywheel portion which is cantilevered over at least a portion of the motor and can have a geared flywheel ring. In yet another embodiment, the power tool can have a motor housing which houses at least a portion of the motor and in which the flywheel has a flywheel inner circumference which is configured radially about at least a portion of the motor and which has a flywheel motor clearance of greater than 0.02 mm.

The power tool can be a fastening device.

In addition to the disclosure of articles, apparatus and devices herein, this disclosure encompasses a variety of methods of use and construction of the disclosed embodiments. For example, a method for driving a fastener, can have the steps of: providing a motor and a cantilevered flywheel adapted to be turned by the motor; providing a driving member adapted to drive a fastener into a workpiece; providing a fastener to be driven; configuring the cantilevered flywheel such that at least a portion of the cantilevered flywheel can be reversibly contacted with a portion of the driving member; operating the cantilevered flywheel at an inertia of from about 2 j to about 500 j; causing the driving member to reversibly contact at least a portion of the cantilevered flywheel; imparting a driving force in a range of from about 1 j to about 475 j to the driving member from the cantilevered flywheel; and driving the fastener into the workpiece. The motor which is provided can have an inner rotor or an outer rotor. Additionally, the motor provided can be a brushed motor or a brushless motor.

In an embodiment, the method of driving a fastener can also have the step of operating the cantilevered flywheel at a speed in a range of from about 2500 rpm to about 20000 rpm. In an embodiment, the method of driving a fastener can also have the step of operating the cantilevered flywheel at an angular velocity in a range of from about 250 rads/s to about 2000 rads/s.

In another embodiment, the method of driving a fastener can also have the steps of providing a fastener which is a nail; and driving the nail into the workpiece.

BRIEF DESCRIPTION OF THE DRAWINGS

The present invention in its several aspects and embodiments solves the problems discussed herein and significantly advances the technology of fastening tools. The present invention can become more fully understood from the detailed description and the accompanying drawings, wherein:

FIG. 7C1 is a sectional view of an embodiment of a sound damping laminate having a reinforced backing layer;

FIG. 7C2 is a sectional view of a multilayered sound damping laminate;

FIG. 16A1 is a exploded view of the drive assembly having the cupped flywheel and a sound damping tape;

FIG. 16A2 is a side view of the exploded view of the drive assembly of FIG. 16A1 having the cupped flywheel and the sound damping tape;

FIG. 16A3 is a side view of the drive assembly of FIG. 16A1 having the cupped flywheel and the sound damping tape;

FIG. 16A4 is a sectional view of the drive assembly of FIG. 16A1 having the cupped flywheel which has the sound damping tape;

Throughout this specification and figures like reference numbers identify like elements.

DETAILED DESCRIPTION OF THE INVENTION

In an embodiment, one or more sound damping materials can be used to reduce the sound emitted from a power tool during its operation. In an embodiment, a power tool can have a sound damping material which can reduce or eliminate sound from the power tool. In an embodiment, the power tool can be a fastening tool. In another embodiment, the power tool can be an impact driver, or other power tool.

In an embodiment, the power tool can have a broad variety of designs and can be powered by one or more of a number of power sources. For example, power sources for the fastening tool can be manual or use one or more of a pneumatic, electric, battery, combustion, solar or other source of energy, or multiple sources of energy. In an embodiment, both battery and electric power can be employed in the same power tool. The fastener can be cordless or can have a power cord. In an embodiment, the fastening tool can have both a cordless mode and a mode in which a power cord is used.

Figure 7:
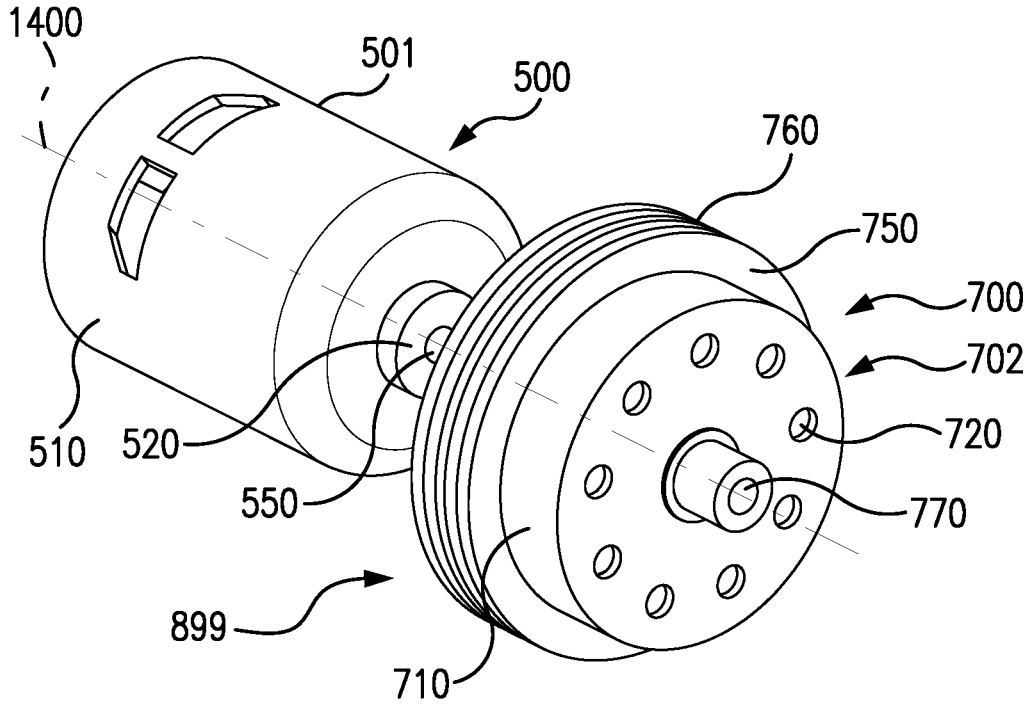
FIG. 7 is a perspective view of a cupped flywheel positioned for assembly onto an inner rotor motor.

In an embodiment, the power tool can be driven by an inner rotor motor 500 and a flywheel 700 which can be a cantilevered flywheel 899 (e.g. FIG. 7), such as a cupped flywheel 702 (e.g. FIG. 7). The inner rotor motor 500 can be a brushed motor 501, a brushless motor, or of another type. The inner rotor motor 500 can be in instant start motor and can drive an instant start flywheel and/or fastening device driver.

The disclosed use of the cantilevered flywheel 899, such as the cupped flywheel 702 achieves numerous benefits, such as allowing brushed motors to be used, significant reductions in manufacturing cost, smaller and lighter power tools. In embodiments, the inner rotor motor 500 with the flywheel 700 can drive a clutch-free (clutchless) and/or transmission-free direct drive mechanism. The inner rotor motor 500 with the cantilevered flywheel 899 achieves an efficient direct drive system for a flywheel to drive action in a power tool and/or fastening device.

The power tool drive mechanism disclosed herein can be used with a broad variety of fastening tools, including but not limited to, nailers, drivers, riveters, screw guns and staplers. Fasteners which can be used with the magazine 100 (e.g. FIG. 1) can be in non-limiting example, roofing nails, finishing nails, duplex nails, brads, staples, tacks, masonry nails, screws and positive placement/metal connector nails, rivets and dowels.

In an embodiment in which the fastening tool is a nailer. Additional areas of applicability of the present invention can become apparent from the detailed description provided herein. The detailed description and specific examples herein are not intended to limit the scope of the invention. This disclosure and the claims of this application are to be broadly construed.

Figure 1:
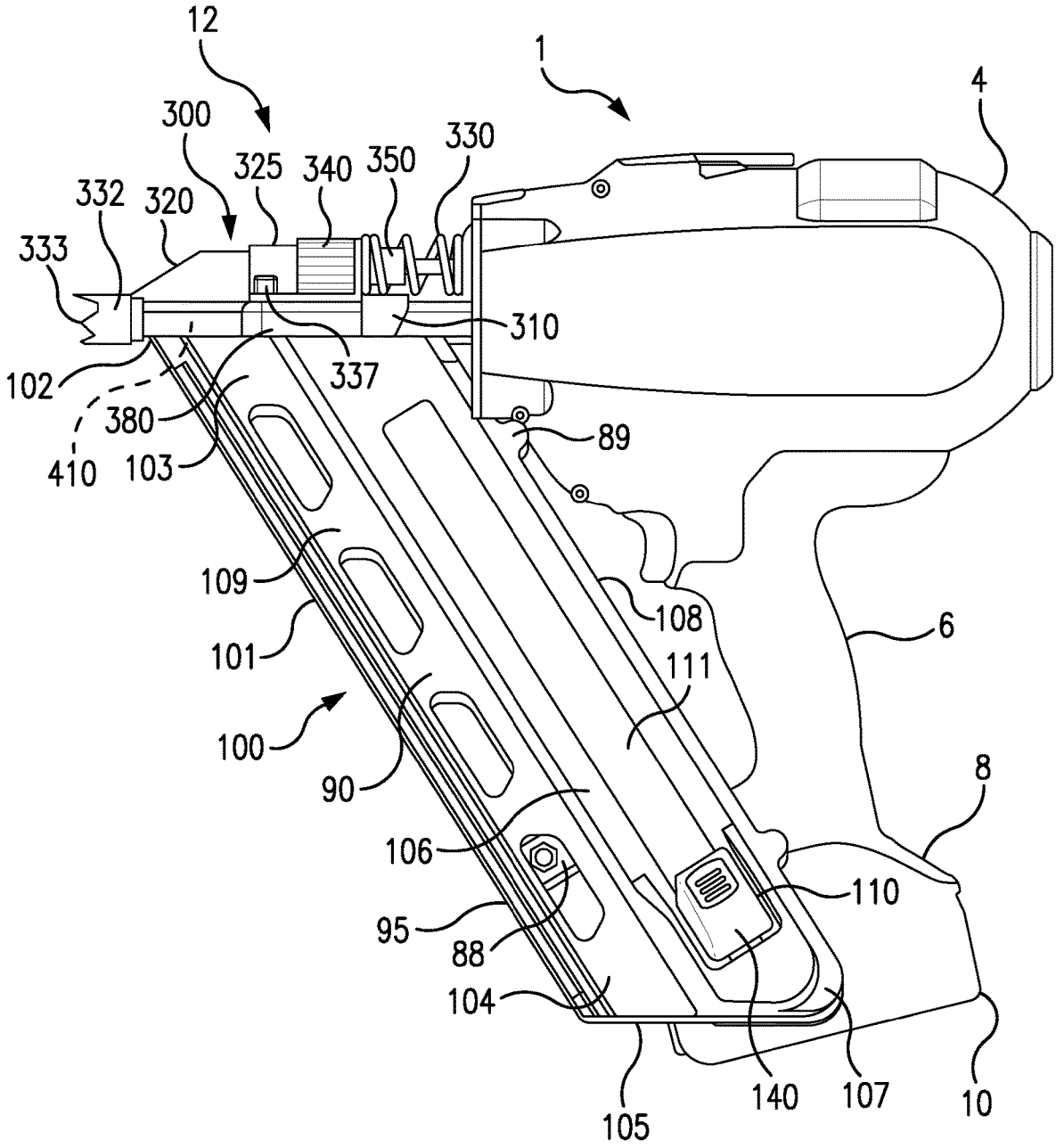
FIG. 1 is a knob-side side view of an exemplary nailer having a fixed nosepiece assembly and a magazine.

FIG. 1 is a side view of an exemplary nailer having a magazine viewed from the knob-side 90 (e.g., FIG. 1 and FIG. 3) and showing the pusher assembly knob 140. The embodiment of FIG. 1 shows a magazine 100 which is constructed according to the principles of the present invention is shown in operative association with a nailer 1. In this example, FIG. 1's nailer 1 is a cordless nailer. However, the nailer can be of a different type and/or a power source which is not cordless.

Nailer 1 has a housing 4 and a motor having an inner rotor, herein as "inner rotor motor 500", (e.g. FIG. 7) which can be covered by the housing 4. In the embodiment of FIG. 1, the inner rotor motor 500 drives a nail driving mechanism for driving nails which are fed from the magazine 100. The terms "driving" and "firing" are used synonymously herein regarding the action of driving or fastening a fastener (e.g. a nail) into a workpiece. A handle 6 extends from housing 4 to a base portion 8 having a battery pack 10. Battery pack 10 is configured to engage a base portion 8 of handle 6 and provides power to the motor such that nailer 1 can drive one or more nails which are fed from the magazine 100.

Nailer 1 has a nosepiece assembly 12 which is coupled to housing 4. The nosepiece can be of a variety of embodiments. In a non-limiting example, the nosepiece assembly 12 can be a fixed nosepiece assembly 300 (e.g. FIG. 1), or a latched nosepiece assembly 13 (e.g. FIG. 4).

The magazine 100 can optionally be coupled to housing 4 by coupling member 89. The magazine 100 has a nose portion 103 which can be proximate to the fixed nosepiece assembly 300. The magazine 100 can engage the fixed nosepiece assembly 300 at a nose portion 103 of the magazine 100 which has a nose end 102. In an embodiment, the fixed nosepiece assembly 300 can fit with the magazine 100 by a magazine interface 380. In an embodiment, the magazine screw 337 can be screwed to couple the fixed nosepiece assembly 300 to the magazine 100, or unscrewed to decouple the magazine 100 from the fixed nosepiece assembly 300.

The magazine 100 can be coupled to a base portion 8 of a handle 6 at a base portion 104 of magazine 100 by base coupling member 88. The base portion 104 of magazine 100 is proximate to a base end 105. The magazine can have a magazine body 106 with an upper magazine 107 and a lower magazine 109. An upper magazine edge 108 is proximate to and can be attached to housing 4. The lower magazine 109 can have a lower magazine edge 101.

Figure 5:
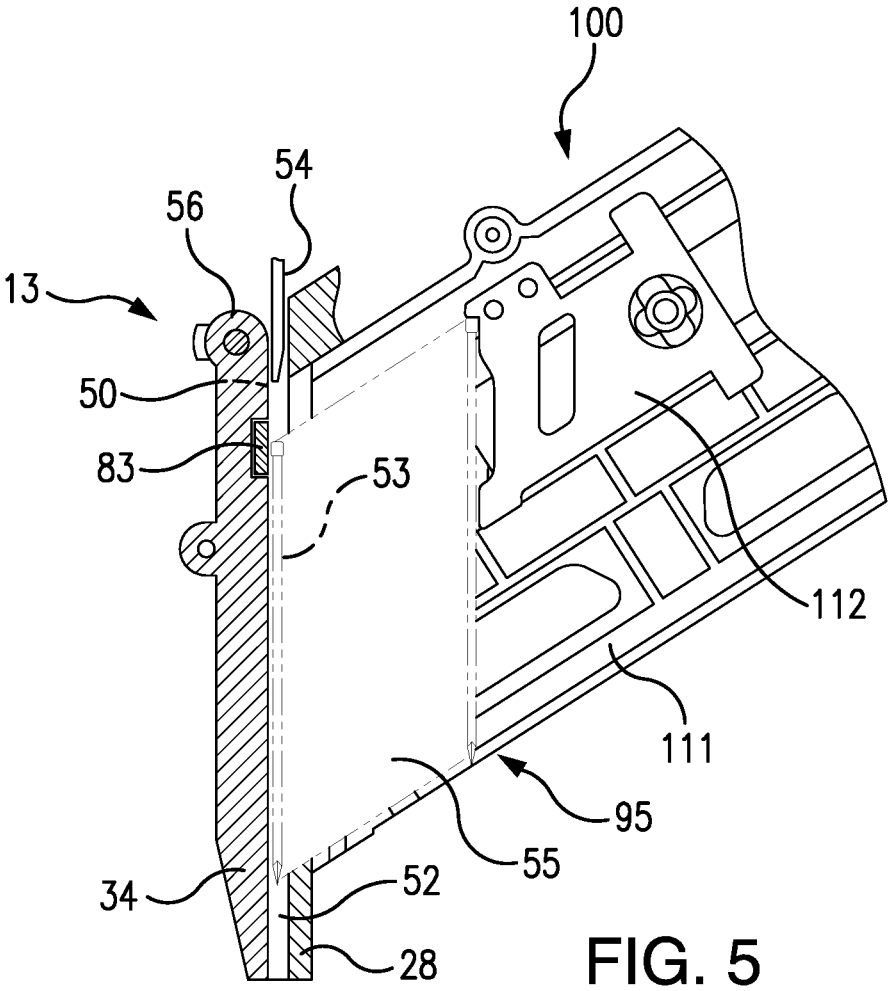
FIG. 5 is a side sectional view of the latched nosepiece assembly.

The magazine 100 can include a nail track 111 sized to accept a plurality of nails 55 therein (e.g. FIG. 5). The nails can be guided by a feature of the upper magazine 107 which guides at least one end of a nail, such as a nail head. The lower magazine 109 can guide a portion of a nail, such as a nail tip supported by a lower liner 95. The plurality of nails 55 can be moved through the magazine 100 towards nosepiece assembly 12 by a force imparted by contact from the pusher assembly 110.

FIG. 1 illustrates an example embodiment of the fixed nosepiece assembly 300 which has an upper contact trip 310 and a lower contact trip 320. The lower contact trip 320 can be guided and/or supported by a lower contact trip support 325. The fixed nosepiece assembly 300 can have a nose 332 which can have a nose tip 333. When the nose 332 is pressed against a workpiece, the lower contact trip 320 and the upper contact trip 310 can be moved toward the housing 4 which can compress a contact trip spring 330. A depth adjustment wheel 340 can be moved to affect the position of a depth adjustment rod 350. In an embodiment, the depth adjustment wheel 340 can be a thumbwheel. The position of the depth adjustment rod also affects the distance between nose tip 333 and insert tip 355 (e.g. FIG. 3). A detail of a nosepiece insert 410 can be found in FIG. 3.

The magazine 100 can hold a plurality of nails 55 (FIG. 6) therein. A broad variety of fasteners usable with nailers can be used with the magazine 100. In an embodiment, collated nails can be inserted into the magazine 100 for fastening.

Figure 2:
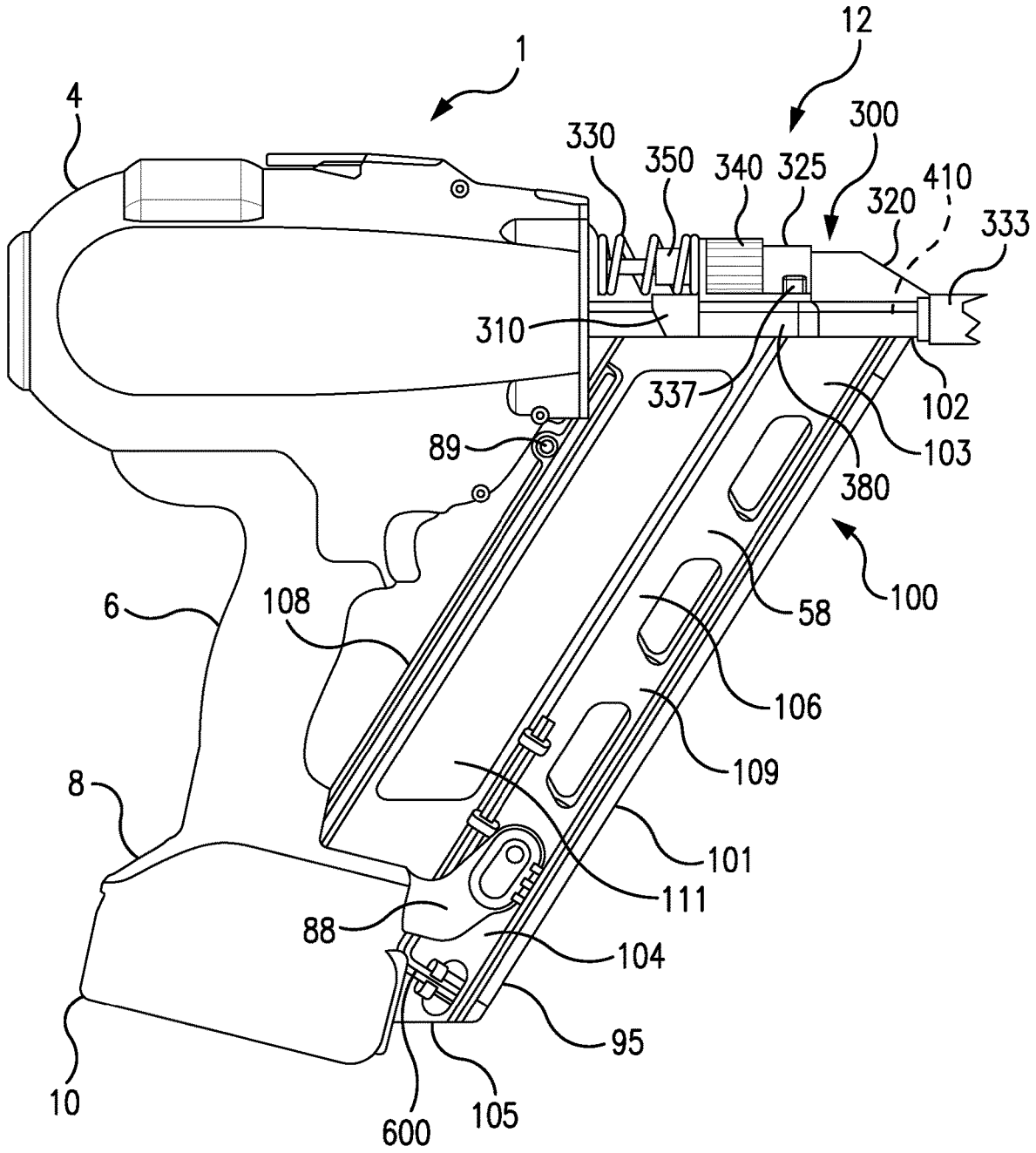
FIG. 2 is a nail-side view of an exemplary nailer having the fixed nosepiece assembly and the magazine.

FIG. 2 is a side view of exemplary nailer 1 having a magazine 100 and is viewed from a nail-side 58. Allen wrench 600 is illustrated as reversibly secured to the magazine 100.

Figure 3:
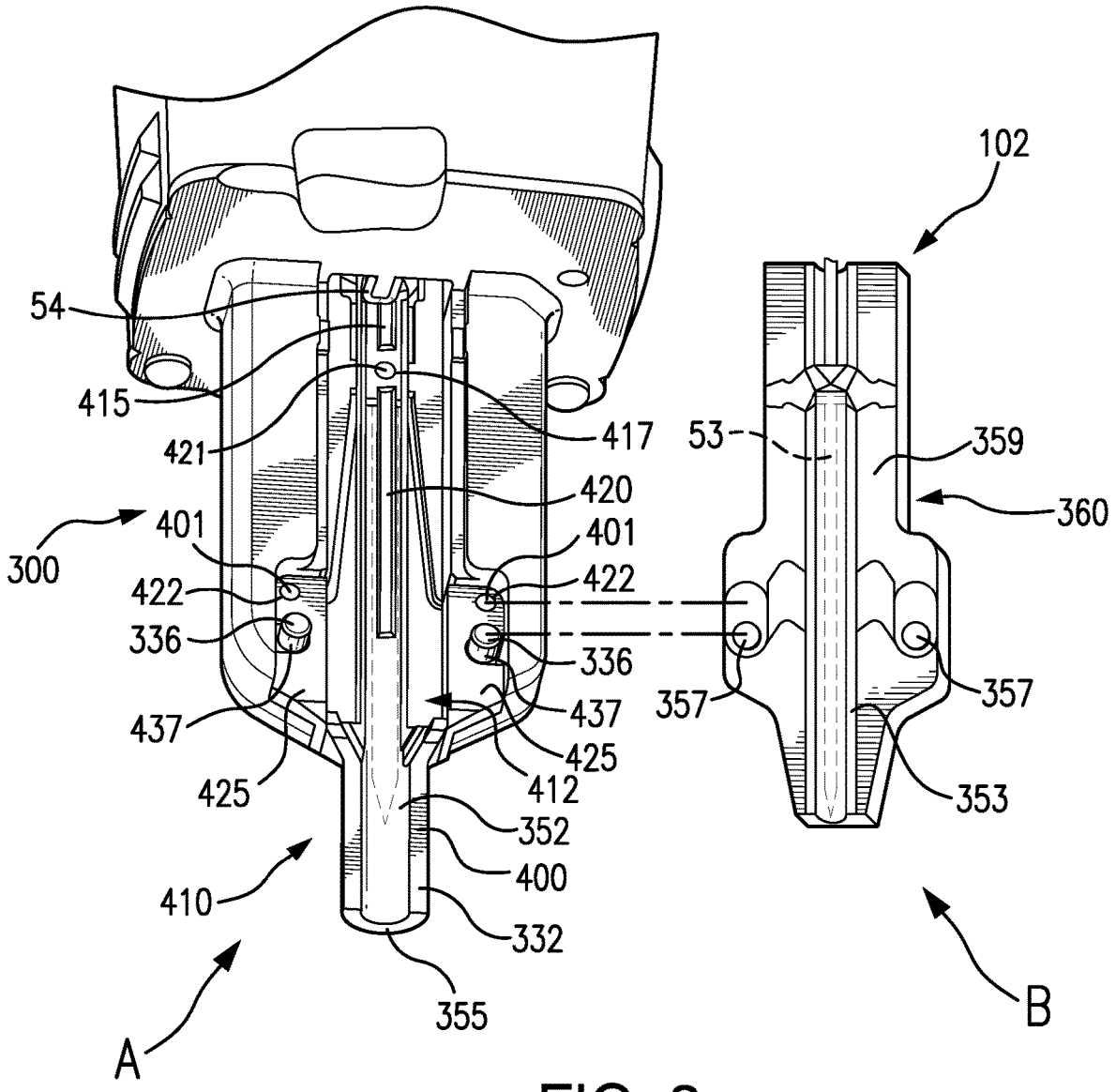
FIG. 3 is a detailed view of the fixed nosepiece with a nosepiece insert and a mating nose end of the magazine.

FIG. 3 is a detailed view of a fixed nosepiece with a nosepiece insert and a mating nose end of a magazine. FIG. 3 is a detailed view of the nosepiece assembly 300 from the channel side 412 which mates with the nose end 102 of the magazine 100.

FIG. 3 detail A illustrates a detail of the nosepiece insert 410 from the channel side 412. The nosepiece insert 410 has the rear mount screw hole 417 for the nail guide insert screw 421. Nosepiece insert 410 can also have a blade guide 415 and nail stop 420. The driver blade 54 can extend from the drive mechanism into channel 52. Nosepiece insert 410 can be fit to nosepiece assembly 300 and can have an interface seat 425. Nosepiece insert 410 can also have a nosepiece insert screw hole 422 and a magazine screw hole 336. Optionally, insert screw 401 for mounting the nosepiece insert 410 to the fixed nosepiece assembly 300 can be a rear mounted screw or a front mounted screw. Optionally, one or more prongs 437 respectively having a screw hole 336 for the magazine screw 337 can be used. In an embodiment, a nail channel 352 can be formed when the nosepiece insert 410 is mated with the nose end 102 of the magazine 100.

FIG. 3 detail B is a front detail of the face of the nose end 102 having nose end front side 360. The nose end 102 can have a nose end front face 359 which fits with channel side 412. The nose end 102 can have a nail track exit 353. For example, a loaded nail 53 is illustrated exiting nail track exit 353. FIG. 3 detail B also illustrates a screw hole 357 for magazine screw 337. In an embodiment, nosepiece insert 410 (FIG. 3) having nose 400 with insert tip 355 is inserted into the fixed nosepiece assembly 300.

Figure 4:
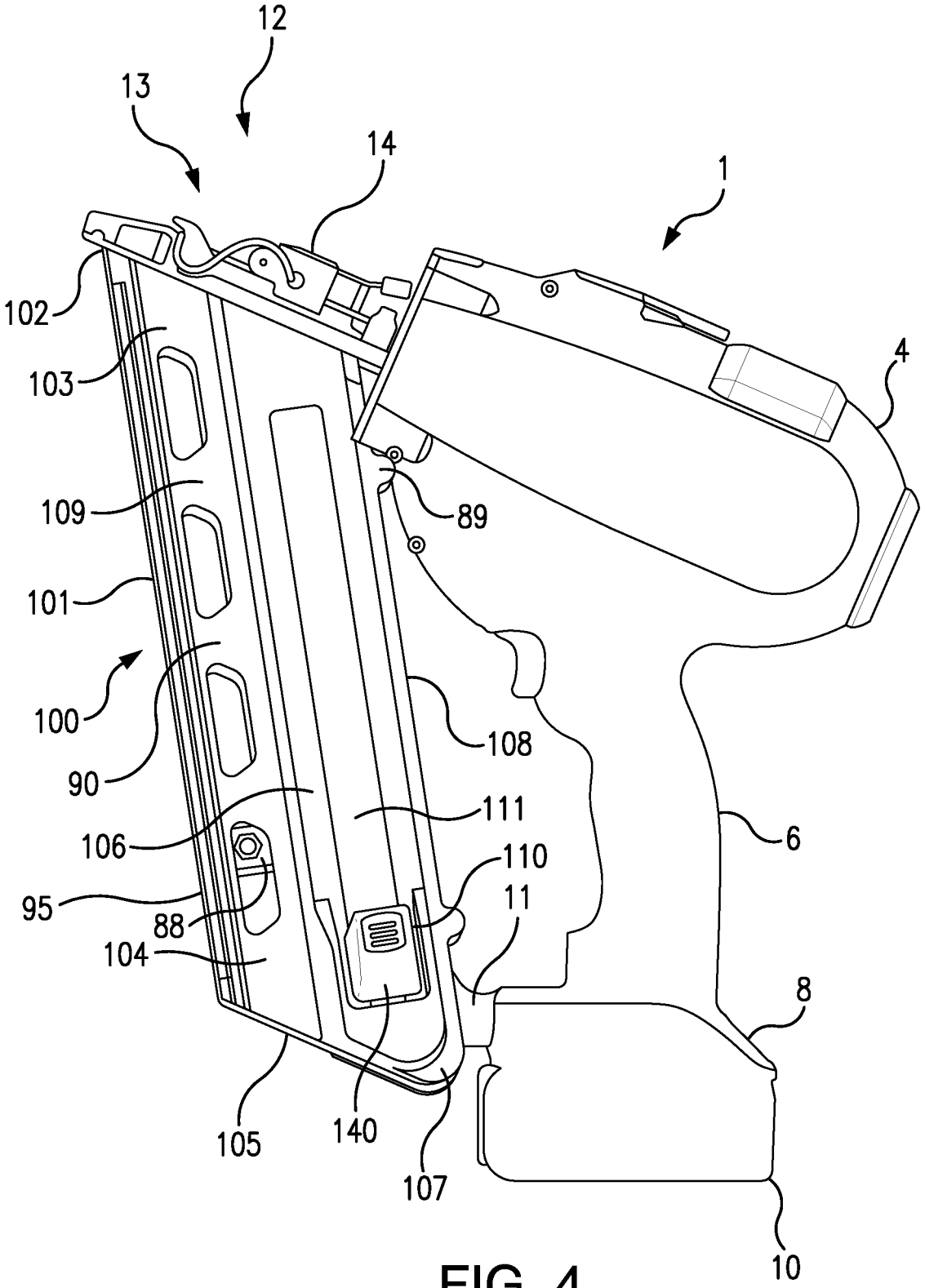
FIG. 4 is a perspective view of the latched nosepiece assembly of the nailer having a latch mechanism.

FIG. 4 is a side view of another embodiment of exemplary nailer 1 viewed from the knob-side 90. In this embodiment, the nosepiece assembly 12 is a latched nosepiece assembly 13 having a latch mechanism 14. Also in this embodiment, the magazine 100 is coupled to the housing 4 and coupled to the base 8 of the handle 6 by bracket 11.

FIG. 5 is a side sectional view of the latched nosepiece assembly 13 having a nail stop bridge 83. In an example embodiment, channel 52 can be formed from two or more pieces, e.g. nose cover 34 and at least one of groove 50 and nosepiece 28 (and/or nail stop bridge 83). Nosepiece 28 has a groove 50 formed therein which cooperates with the nose cover 34 (when the nose cover 34 is in its locked position). The locking of nose cover 34 against groove 50 can form an upper portion of channel 52. The driver blade 54 can extend from the drive mechanism into channel 52. The driver blade 54 can engage the head of the loaded nail 53 to drive loaded nail 53. Cam 56 prevents escape of driver blade 54 from the nosepiece 28. The nail stop bridge 83 that bridges the channel 52 engages each nail of the plurality of nails 55 as they are pushed by the pusher 112 along the nail track 111 of the magazine 100 and into channel 52. The tips of the plurality of nails 55 can be supported by the lower liner 95, or a lower support.

Figure 6:
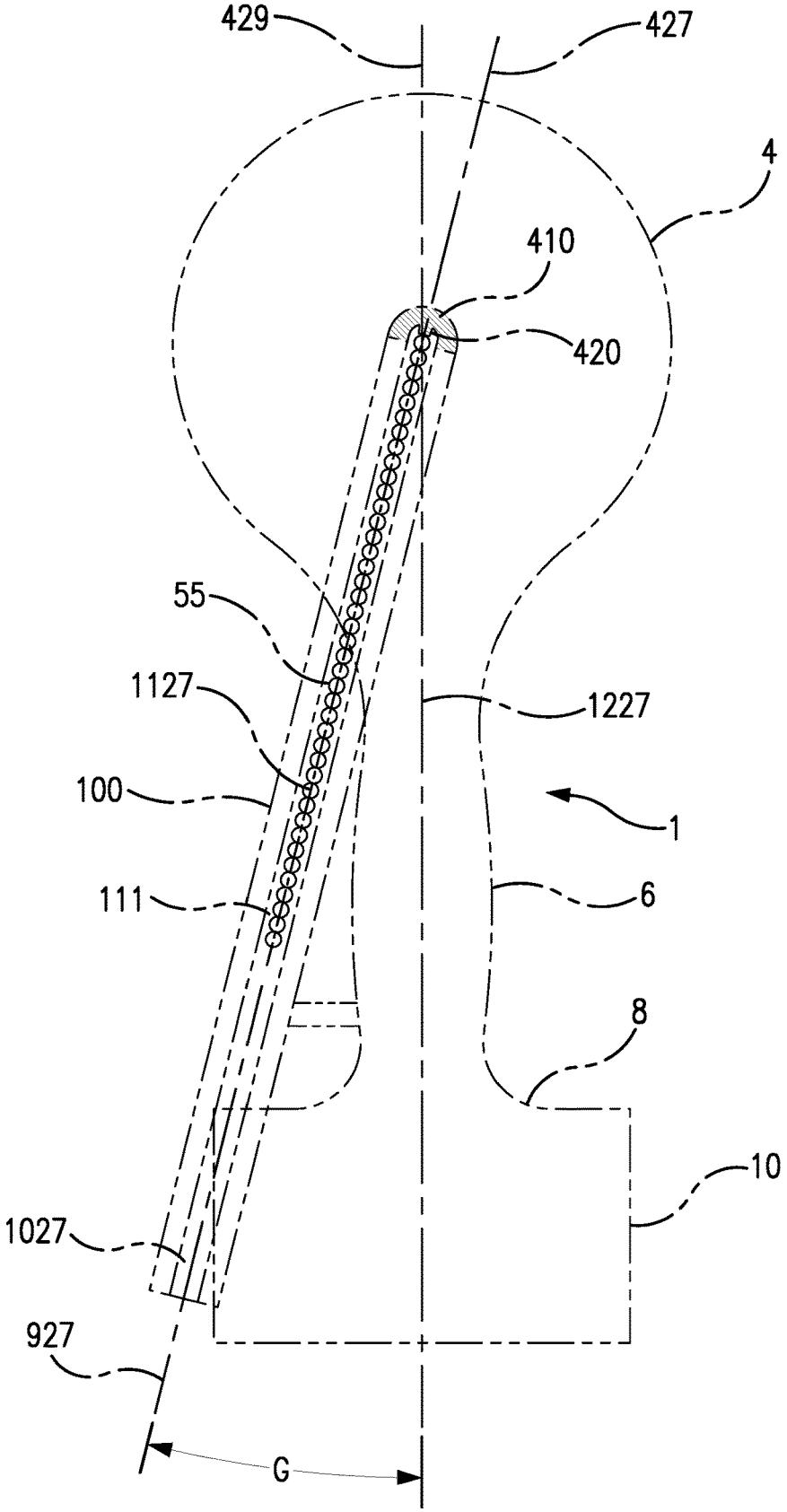
FIG. 6 is a perspective view illustrating the alignment of the nailer, magazine and nails.

FIG. 6 illustrates the nail stop 420, the nail stop centerline 427, a longitudinal centerline 927 of the magazine 100, a longitudinal centerline 1027 of the nail track 111, a longitudinal centerline 1127 of the plurality of nails 55 and a longitudinal centerline 1227 of the nailer 1. FIG. 6 illustrates that in an embodiment having fixed nosepiece 300 having nosepiece insert 410 can be mated with the nose end 102 channel centerline 429 can be collinear with nail 1 centerline 1029. Like reference numbers in FIG. 1 identify like elements in FIG. 6. In an embodiment, the magazine 100 can have its longitudinal centerline 927 offset from a longitudinal centerline 1227 of nailer 1 by an angle G. Angle G can be 14 degrees. In an embodiment, nail stop centerline 427 can be collinear with a longitudinal centerline 927 of the magazine 100. Additionally, in an embodiment, longitudinal centerline 927 of the magazine 100 can be collinear with a longitudinal centerline 1027 of the nail track 111, as well as collinear with a nail stop centerline 427. Longitudinal centerline 1127 of the plurality of nails 55 can be collinear with nail stop centerline 427. Nail stop centerline 427 can be offset as shown in FIG. 6 at an angle G measured from nailer 1 channel centerline 429. In an embodiment, angle G aligns the longitudinal centerline 1027 of the nail track 111 with the centerline 1127 of the plurality of nails 55 and also nail stop centerline 427.

Figure 10A:
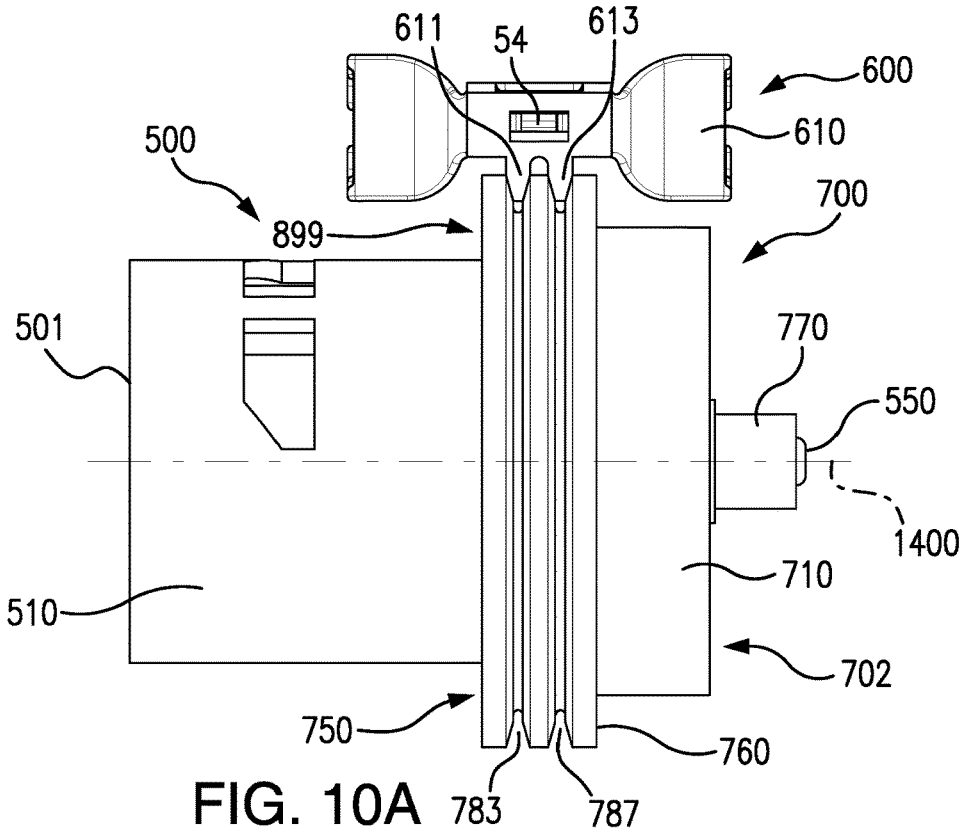
FIG. 10A a side view of a drive mechanism having the cupped flywheel which is frictionally engaged with a driver profile.

FIG. 7 is a perspective view of the cupped flywheel positioned for assembly onto an inner rotor motor 500. FIG. 7 illustrates the inner rotor motor 500 having a motor housing 510 and a first housing bearing 520 which bears a rotor shaft 550 driven by an inner rotor 540 (FIG. 10A). In an embodiment, the motor used can alternatively be a frameless motor which does not include a motor housing, or which can have only a partial motor housing which covers part of a longitudinal length of the motor. FIG. 7 also illustrates a flywheel 700 which is a cantilevered flywheel 899 and which in the embodiment of FIG. 7 is the cupped flywheel 702. The cupped flywheel 702 is shown in a disassembled state and in coaxial alignment with a rotor centerline 1400. The cupped flywheel 702 is shown in an assembled state, for example in FIGS. 10A and 10B. In an embodiment, the cupped flywheel 702 can have a flywheel body 710 and at least one of a flywheel opening 720 and/or a plurality of flywheel openings 720. Herein, both a single flywheel opening and a number of flywheel openings are designated by the reference numeral "720". There is no limitation at to the number flywheel openings which can be used. Such openings achieve a reduction and/or tailoring of the mass of the flywheel to meet structural, inertial and power consumption specifications. In an embodiment, the cupped flywheel 702 can have a flywheel ring 750 which can be a geared flywheel ring 760. Optionally, the cupped flywheel 702 can have a flywheel bearing 770 which interfaces with the rotor shaft 550.

In non-limiting example, the sound damping material 1010 can be used to reduce noise emitted from any one or more of the flywheel 700, the flywheel assembly 705, the driver assembly 800 and the driver return system 900. In another embodiment, the sound damping material 1010 can be used to reduce noise emitted from any one or more of the motor, the inner rotor motor 500, brushed motor 501, a brushless motor, the motor housing 510 and the motor housing 4. In an embodiment, the sound damping material 1010 can have the form of a sound damping member 1015. In an embodiment, the sound damping member 1015 can be a vibration absorption member 1020. A vibration absorption member 1020 can have the sound damping material 1010.

Figure 7A:
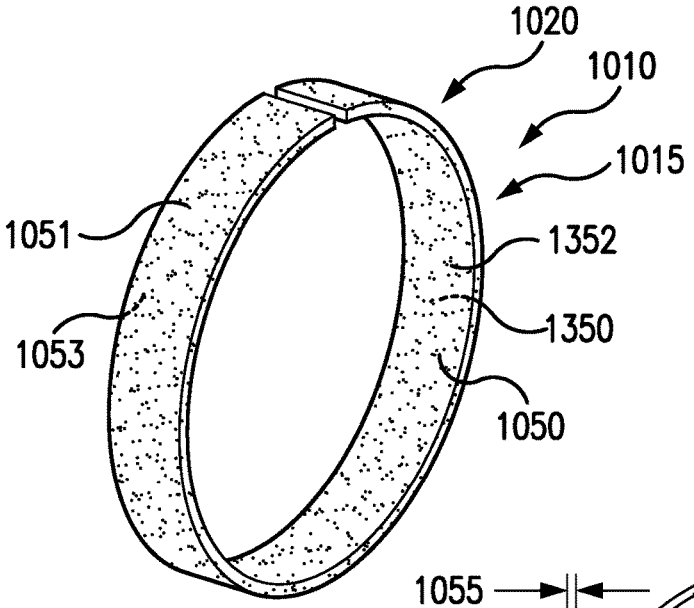
FIG. 7A is a perspective view of an embodiment of a sound damping tape.

FIG. 7A is a perspective view of an embodiment of a sound damping tape 1050. In an embodiment, the sound damping member 1015 has a sound damping material 1010 which can be a sound damping tape 1050. FIG. 7A shows an embodiment in which the sound damping tape 1050 is configured for placement upon a flywheel ring inner surface 1706 (FIG. 7E) of a flywheel body 710. The sound damping tape 1050 can have an adhesive surface 1051 having an adhesive material 1053, as well as a backing layer 1352 having a backing material 1350. In an embodiment, the sound damping material can be a sound damping tape 1050, such as 3M™ 2542 sound damping foil tape (3M™, 3M Corporate Headquarters, 3M Center, St. Paul, Minn. 55144-1000; (888) 364-3577).

The sound damping material 1010 can have one or more of a variety of constituents such as in non-limiting example a polymer, an acrylic polymer, a urethane, an acrylic, a viscoelastic acrylic polymer, a viscoelastic material, a cross-linked elastomer, a polyester, an adhesive, an ultra-high adhesion (UHA™) removable adhesive (UHA™ is a trademarked product of Avery Dennison, 207 Goode Avenue, Glenndale, Calif. 91205, phone (626) 304-2000, such as Avery Dennison tape product FT 0951), UHA™ adhesive, a foam, a metal, a foil, a sound damping foil, an aluminum foil, a dead soft aluminum foil, a film and a cloth.

The sound damping member 1015 can be a vibration absorption member 1020 which can be made from a sound damping material 1010 which can absorb vibrations from one or more power tool parts, such as the flywheel 700. A vibration absorption member 1020 is a type of sound damping member. In an embodiment, a vibration absorption member 1020 can absorb vibrations from a member to which it is attached, or from elsewhere.

In an embodiment, the sound damping member 1015 can have one or more of a foil vibration damping portion, a foam vibration damping portion and a foam sheet vibration damping portion. In non-limiting example, the sound damping member 1015 can have one or more of a low-temperature vibration damping portion, a general purpose vibration damping portion, a high-temperature vibration damping portion, a foil vibration damping portion, a foam vibration damping portion, and a foam sheet vibration damping portion.

Figure 26:
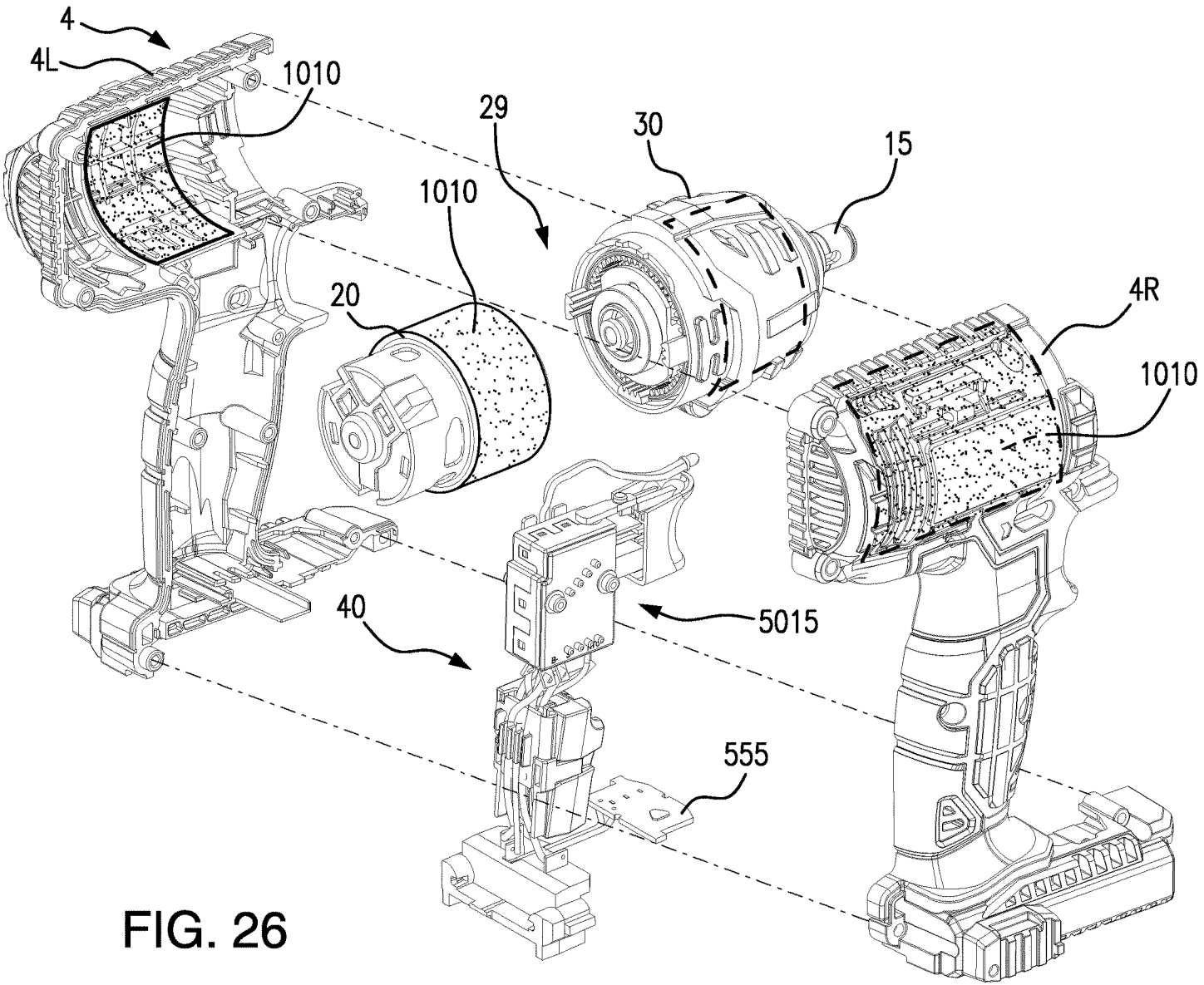
FIG. 26 is an exploded view of an impact driver having the sound damping material.

The sound damping member 1015 can be permanently or reversibly affixed to, mounted on, supported by and/or adjacent to one or more of the following: a stationary member and/or part of the power tool; a portion of a housing, such as the housing 4; a portion of a motor and/or a motor cover, such as the motor housing 510; and a moving and/or rotating member of the power tool, such as one or more of the flywheel 700, the cupped flywheel 702, the cantilevered flywheel 899 and the driver profile 610. In an impact driver, The sound damping member 1015 can be permanently or reversibly affixed to, mounted on, supported by and/or adjacent to one or more of the hammer 1111, the anvil 2222 and the impact driver motor 20 (FIG. 26).

In an embodiment, the sound damping member can convert vibrational energy which it receives from a part, piece and/or member to heat. In an embodiment, the heat generated through conversion from vibrational energy by the sound damping member is cooled by the flow of air across and/or in contact with the sound damping member. In an embodiment the sound damping member can be a radiator and/or cooling member.

In an embodiment, the sound damping member can be the vibration absorption member which can convert vibrational energy which it receives from a part, piece and/or member to heat. In an embodiment, the heat generated through conversion from vibrational energy by the vibration absorption member is cooled by the flow of air across and/or in contact with the vibration absorption member. In an embodiment the vibration absorption member can be a radiator and/or cooling member.

Figure 7B:
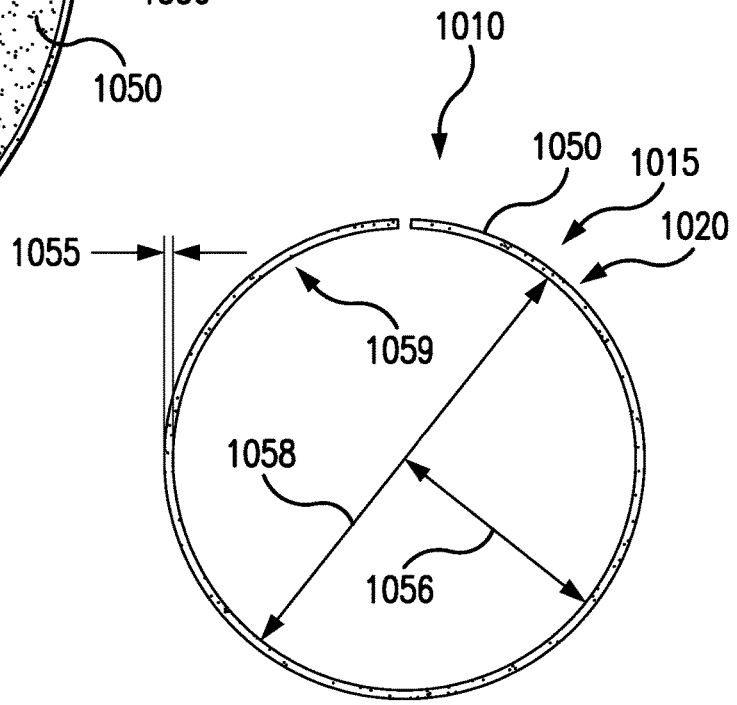
FIG. 7B is a side view of the embodiment of the sound damping tape of FIG. 7A.

FIG. 7B is a side view of the embodiment of the sound damping tape 1050 of FIG. 7A. FIG. 7B shows the sound damping member 1015 configured to have a sound damping tape radius 1056 and a sound damping tape diameter 1058. The sound damping member 1015 is shown to have a sound damping tape thickness 1055 and a sound damping tape circumference 1059.

In an embodiment, the sound damping member 1015 can have a thickness in a range of from 0.01 mm to 15.0 mm, or greater; such as 0.025 mm to 0.2 mm, or 0.10 to 0.25 mm, or 0.20 mm to 0.45 mm, or 0.3 to 1.5 mm, or 0.50 mm to 2.0 mm, or 1.5 mm to 3 mm, or 2.0 mm to 4 mm, or 3 mm to 6 mm, or 5 mm to 10 mm or greater.

Figure 7C:
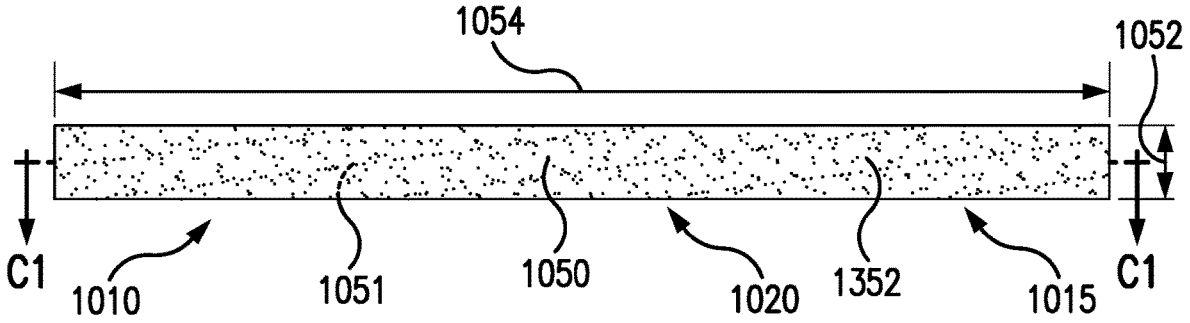
FIG. 7C is a top view of a flattened configuration of the embodiment of the sound damping tape of FIG. 7A.

FIG. 7C is a top view of a flattened configuration of the embodiment of the sound damping tape of FIG. 7A. FIG. 7C shows the dimensions of the sound damping tape 1050 which forms the sound damping member 1015 when in a flattened configuration having a sound damping tape width 1052 and a sound damping tape length 1054. In this embodiment the backing layer 1352 is shown, with the adhesive surface 1051 on the opposite side.

In an embodiment the sound damping member 1015 can have a backing material 1350 (e.g. FIG. 7C1), optionally in the form of a backing layer 1352 (FIG. 7C2). The backing can be thin, light, firm, strong, stiff, heavy-duty, waterproof, magnetic or protective. The backing can be reinforced internally and/or externally.

In an embodiment, the sound damping member 1015 can have a linered construction in which a releasable liner is adhered to the adhesive surface 1051 of the sound damping material 1010 prior to applying the adhesive surface 1051 to a member and/or surface of a power tool. In non-limiting example, the sound damping tape 1050 can have a liner reversibly against the adhesive surface prior to use or application of the tape. In this example, the liner can be removed to allow application of the sound damping tape to a piece, part, member or surface of a tool, or at least a portion thereof.

In an embodiment, the sound damping member 1015 can have a backing material 1350 which can have a thickness in a range of from 0.025 mm to 10.0 mm or thicker, such as 0.025 mm to 0.19 mm, or 0.10 to 0.25 mm, or 0.20 mm to 0.34 mm, or 0.25 to 1.0 mm, or 0.50 mm to 2.0 mm, or 1.5 mm to 3 mm, or 2.0 mm to 4 mm, or 3 mm to 6 mm, or 5 mm to 10 mm or greater.

In an embodiment, the sound damping member 1015 can have a sound damping laminate 1310. The sound damping laminate 1310 can have a number of laminate layers which can be made of the same or different materials.

In an embodiment, sound damping laminate 1310 can have a metal laminate 1317, such as for non-limiting example a foil laminate 1318. In other non-limiting examples, the sound damping laminate 1310 can have one or more of a metal laminate layer, an aluminum laminate layer, a copper laminate layer, an urethane laminate layer, a polymer laminate layer, a cross-linked material polymer layer, a vibration absorbing laminate layer, a sound absorbing laminate layer and an acrylic laminate.

FIG. 7C1 shows a sectional view of an embodiment of a sound damping laminate having a reinforced backing layer. The sound damping member 1015 can have a laminate and/or multilayered structure. The laminated structure can be a sound damping laminate 1310. The sound damping tape 1050 can also have a laminate and/or multilayered structure. FIG. 7C1 is an example of a sound damping laminate 1310 of the sound damping member 1015 and/or of the sound damping tape 1050. In non-limiting example, the sound damping laminate 1310 can have: a first laminate layer 1311, which for example can have a first sound damping material 1011; a second laminate layer 1312, which for example can have a hardened material layer 1320; and a third laminate layer 1313, which for example can have a backing material 1350 which can have a reinforcing material 1360.

FIG. 7C2 shows a sectional view of a multilayered sound damping laminate. The sound damping laminate 1310 can have many layers; for example 1 . . . n layers, with n being a large number, such as up to 25 layers, or up to 10 layers. The respective layers can be the same or different from one another and can have the same or different materials and/or compositions. The respective layers can have the same or different physical properties, and the respective layers can serve the same or different functions.

FIG. 7C2 shows a sectional view of the sound damping laminate 1310 which can form the sound damping member 1015 and/or of the sound damping tape 1050. The sound damping laminate 1310 of FIG. 7C is shown to have: a first laminate layer 1311, which for example can have a first sound damping material 1011; a second laminate layer 1312, which for example can have a second sound damping material 1012; a third laminate layer 1313, which for example can have a third sound damping material 1013; a fourth laminate layer 1314, a fifth laminate layer 1315, which for example can have a fifth laminate layer 1351. Optionally, the fifth laminate layer 1351 can be a backing layer 1352, which for example can have a hardened material layer 1320. In an embodiment, the sound damping laminate 1310 can have a sound damping member coating 1355.

Figure 7D:
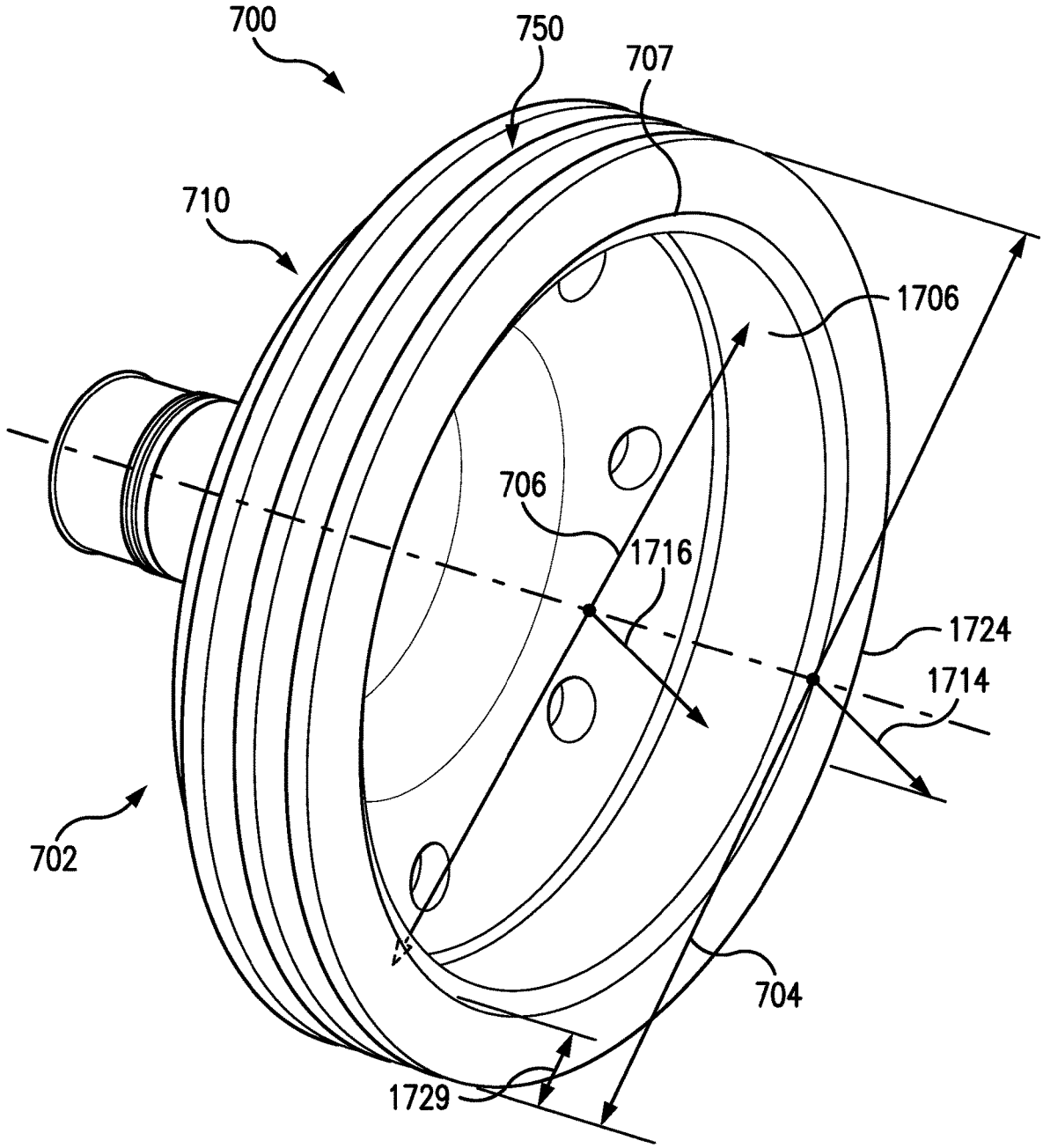
FIG. 7D is a perspective view of a cupped flywheel.

FIG. 7D is a perspective view of a cupped flywheel 702. The cupped flywheel 702 shown in FIG. 7D has a flywheel body 710 and a flywheel ring 750. The flywheel ring 750 can have a flywheel ring inner surface 1706, a flywheel ring thickness 1729 and a flywheel ring outer circumference 1724. The cupped flywheel 702 is shown to have a flywheel inner diameter 706, a flywheel inner radius 1716 and a flywheel ring inner circumference 707. The cupped flywheel 702 also has a flywheel outer diameter 704, a flywheel ring outer radius 1714 and flywheel ring outer circumference 1724.

Figure 7E:
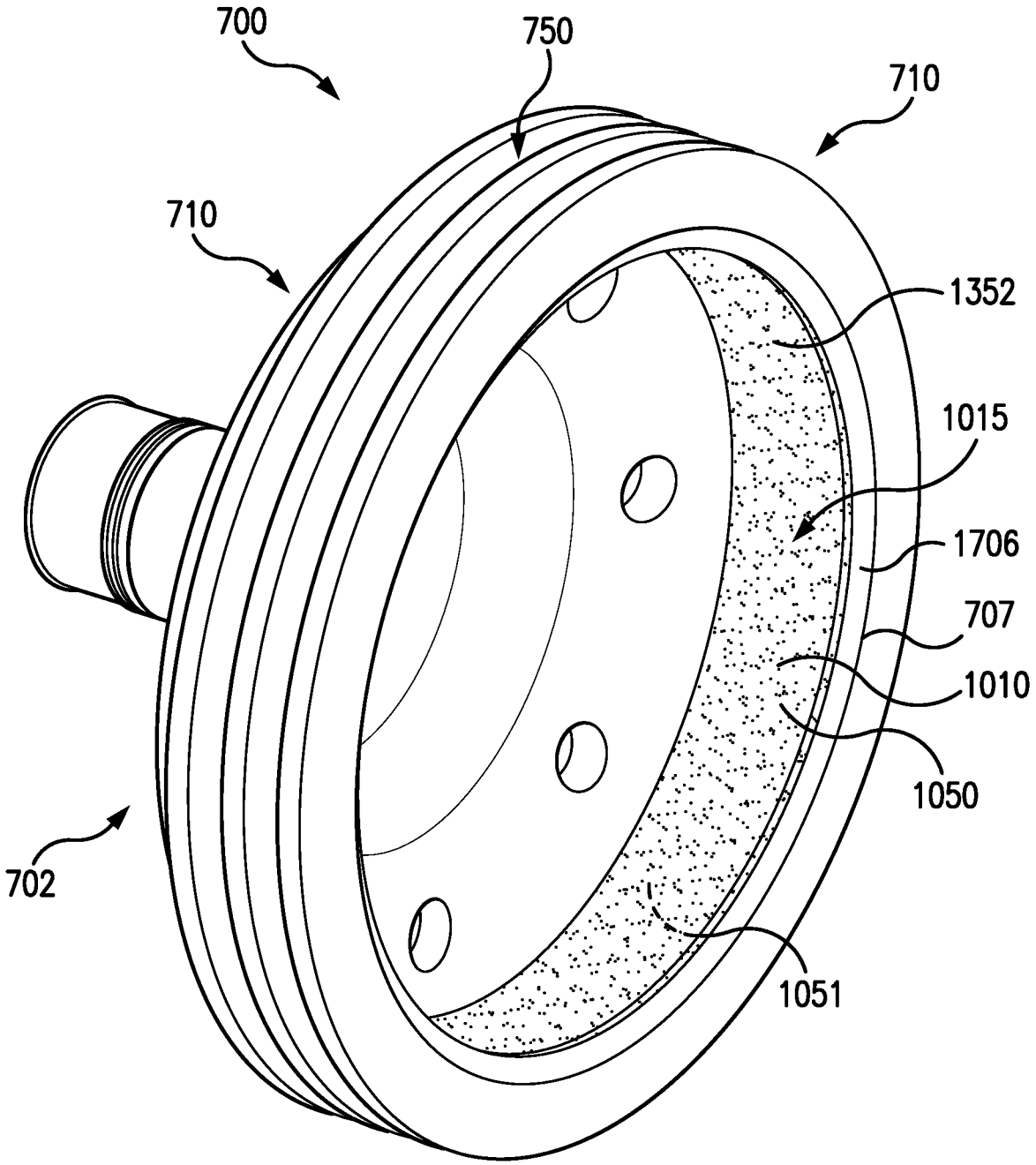
FIG. 7E is a perspective view of the cupped flywheel having a sound damping material on a flywheel ring inner surface.

FIG. 7E is a perspective view of a cupped flywheel 702 bearing a sound damping material 1010 on the flywheel ring inner surface 1706. The non-limiting example of FIG. 7E shows a sound damping member 1015 which is a sound damping tape 1050. The sound damping tape 1050 is shown to have the backing layer 1352 and the adhesive surface 1051 which is adhered to the flywheel ring inner surface 1706. The adhesive surface 1051 of the sound damping tape 1050 is shown to extend along the flywheel ring inner circumference 707 of the flywheel ring inner surface 1706. The sound damping tape 1050 can extend along all or part of the flywheel ring inner circumference 707. The sound damping tape 1050 can cover, be affixed to and/or adhere to all or part of the flywheel ring inner surface 1706.

The sound damping material can be affixed to one or more portions of the flywheel 700, the cupped flywheel 702 or the cantilevered flywheel 899.

Figure 7F:
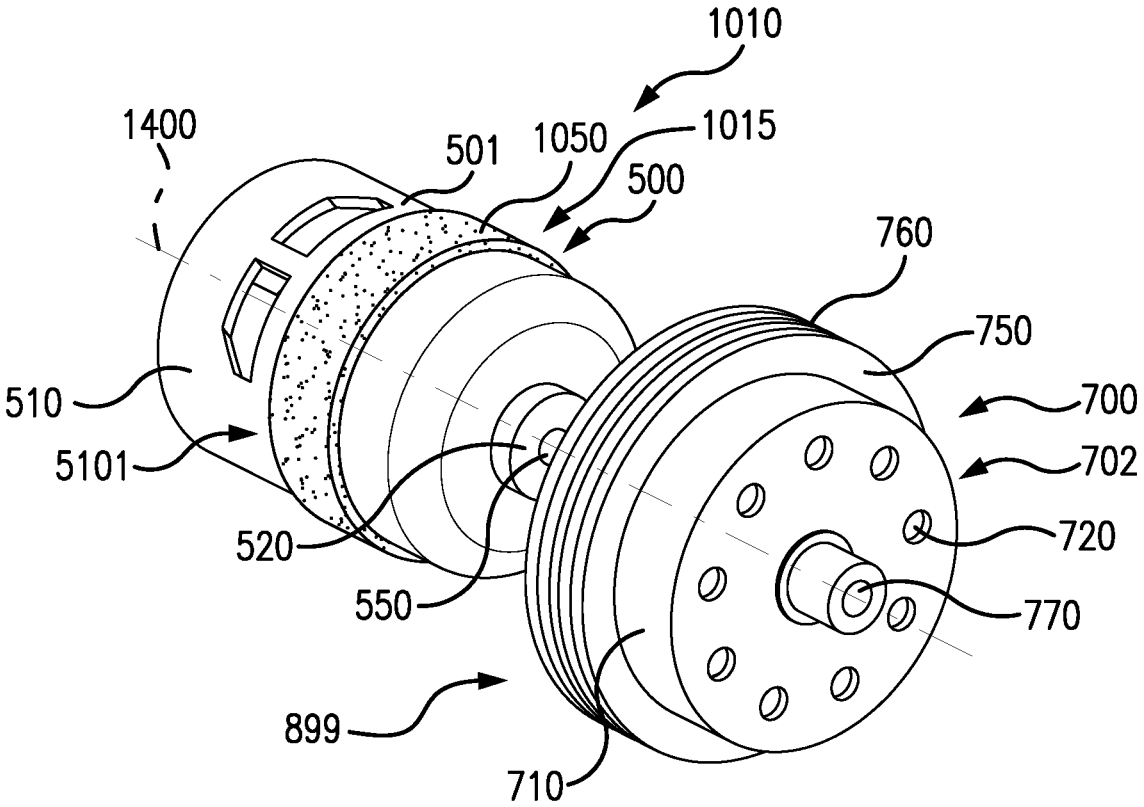
FIG. 7F is a perspective view of an inner rotor motor having a sound damping material.

FIG. 7F is a perspective view of an inner rotor motor 500 bearing a sound damping material 1010. The non-limiting example of FIG. 7F shows the sound damping member 1015 which is a sound damping tape 1050 affixed to the motor housing 510. In an embodiment, the sound damping tape 1050 can be affixed to or be supported by the motor housing 510 around its outside circumference 5101, or other surface of the motor housing 510. The sound damping material 1010 can cover the motor housing 510 in part or in whole.

Figure 7G:
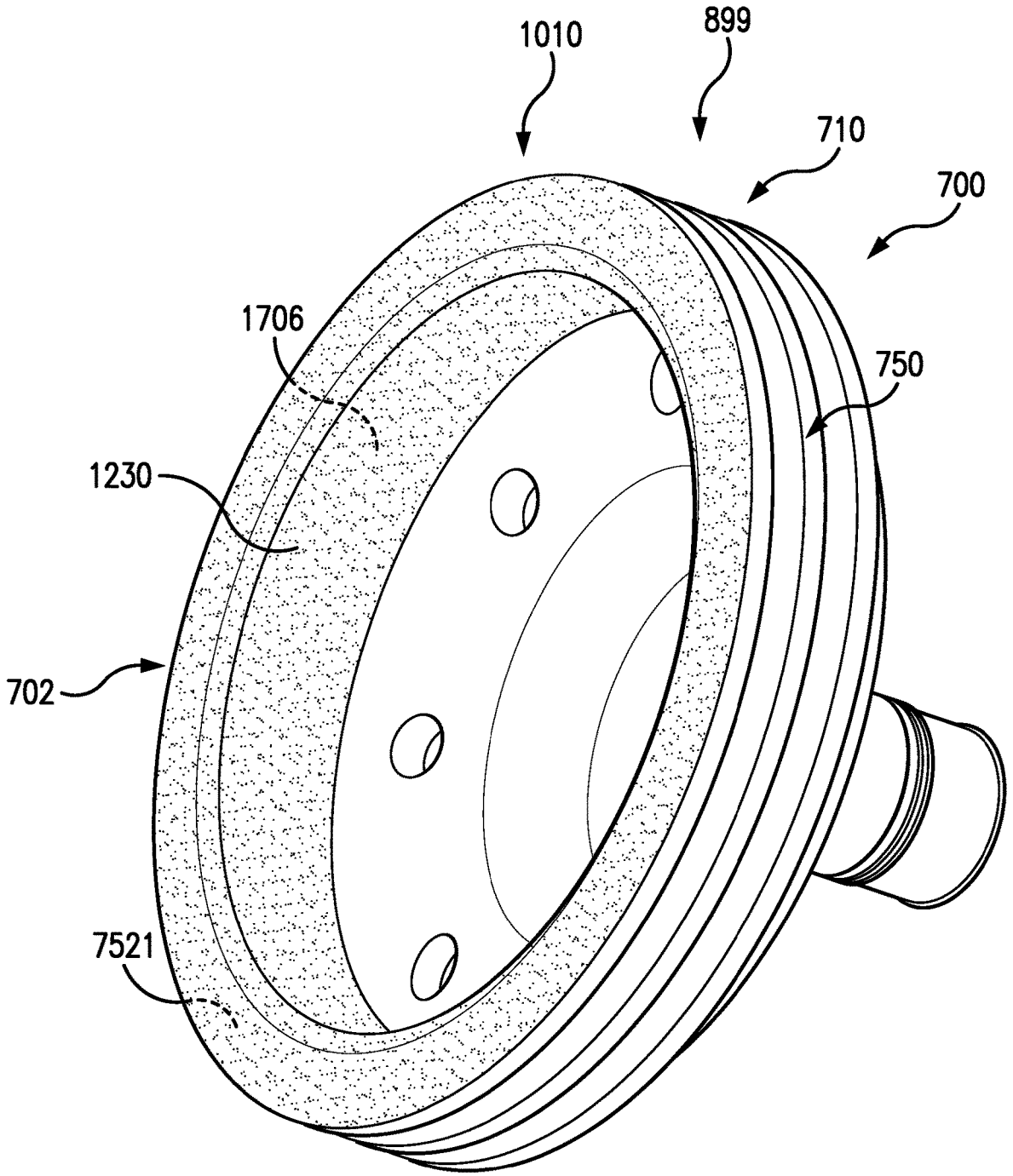
FIG. 7G is a perspective view of the cupped flywheel having a sound damping powder coating.

FIG. 7G is a perspective view of a cupped flywheel having a sound damping powder coating. In an embodiment, the sound damping member 1015 can have a coating which can have one or more of a polymer coating and a powder coating. The non-limiting example of 7G shows the sound damping material 1010, which is a sound damping powder coating 1230 on a flywheel ring inner surface. The sound damping powder coating 1230 can coat in part or in whole the flywheel 700, the cupped flywheel 702 or the cantilevered flywheel 899. FIG. 7G shows the cupped flywheel 702 which has the sound damping powder coating 1230 which coats the flywheel ring inner surface 1706 and the flywheel ring 750 across the flywheel ring width surface 7521.

Figure 8:
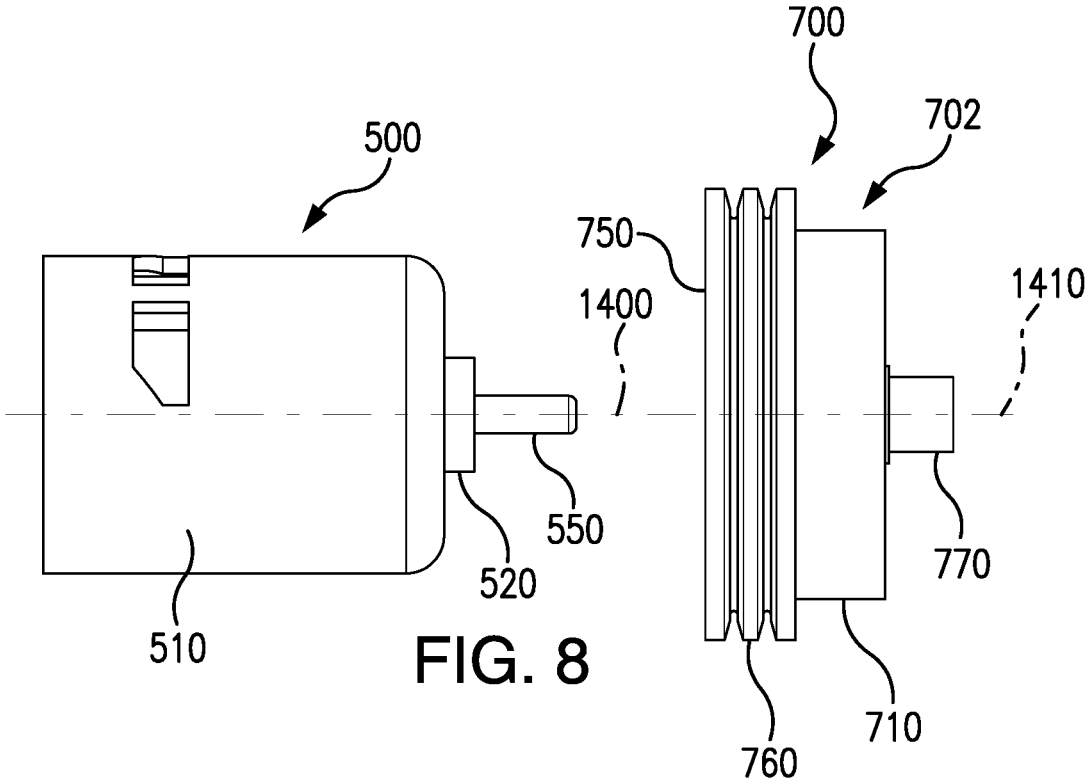
FIG. 8 is a side view of the cupped flywheel positioned for assembly onto the inner rotor motor.

FIG. 8 is a side view of the cupped flywheel positioned for assembly onto the inner rotor motor 500. As illustrated in FIG. 8, the cupped flywheel 702 can be positioned such that a flywheel axial centerline 1410 is collinear with a rotor centerline 1400. In an embodiment, the cupped flywheel 702 can be frictionally attached to the rotor shaft 550 by means of fitting the flywheel bearing 770 onto a portion of the rotor shaft 550. Herein, in embodiments the flywheel bearing 770 is synonymous to a flywheel hub. In other embodiments, the cupped flywheel 702 can be affixed to the rotor shaft 550 by other means, such as using a lock and key configuration, using a "D" shaped shaft portion mated with a "D" shaped portion of the flywheel bearing 770, using fasteners such a screw, a linchpin, a bolt, a wed, or any other means which attached the cupped flywheel 702 to the rotor shaft 550. In an embodiment, the inner rotor 540 and/or the rotor shaft 550 and the cupped flywheel 702 and/or the flywheel bearing 770 can be manufactured as one piece, or multiple pieces.

Figure 9:
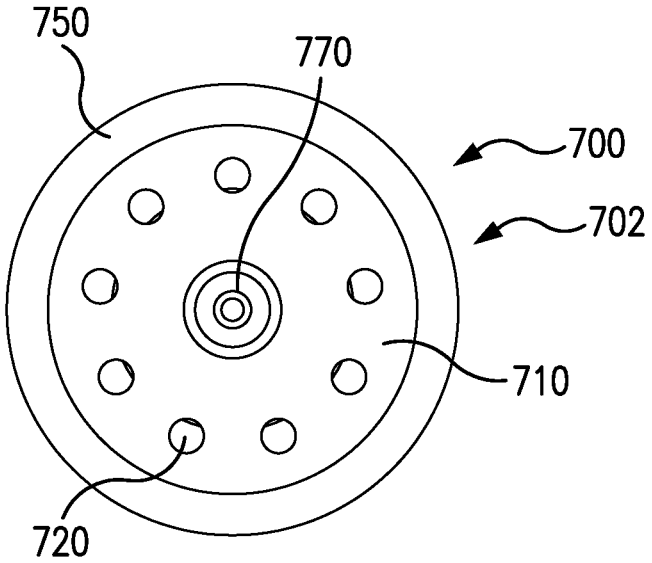
FIG. 9 is a front view of the cupped flywheel.

FIG. 9 is a front view of the cupped flywheel 702 having a number of the flywheel opening 720. The flywheel ring 750 is shown extending radially away from the center of the cupped flywheel 702 and the flywheel bearing 770. There is no limitation to the number of flywheel rings which can be used. Optionally, one or more flywheel rings can be located along the length of the cupped flywheel 702. Each flywheel ring can have a contact surface to impart energy to a moveable member. Multiple flywheel rings can power multiple members, or the same member.

FIG. 10A is a side view of a drive mechanism having the cupped flywheel 702 which is frictionally engaged with a driver profile 610. In FIG. 10A, the mating of the flywheel ring 750 with the driver profile 610 is shown. There is no limitation as to the means by which the flywheel 700 imparts energy to the driver 600, driver profile 610 and/or driver blade 54. In the example of FIG. 10A, the flywheel ring 750 is a geared flywheel ring 760 having a first gear groove 783 and a second gear groove 787 which are shown in frictional contact with driver profile 610 and more specifically a first profile tooth 611 and a second profile tooth 613. By this frictional contact, at least a portion of the rotational energy developed in the cupped flywheel 702 is imparted to the driver profile 610 propelling the driver profile through a driving action to cause the driver blade 54 born by the driver profile 610 to drive a nail 53.

Figure 10B:
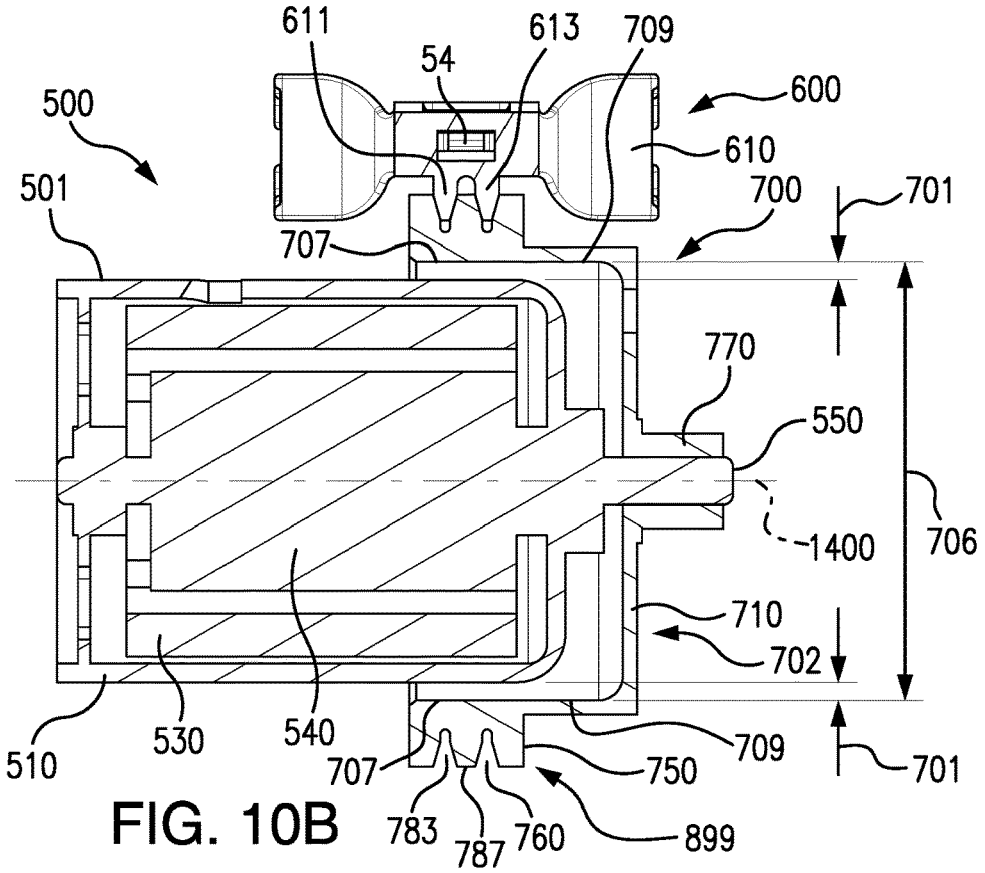
FIG. 10B is a cross-sectional view of the drive mechanism having the cupped flywheel which is frictionally engaged with the driver profile.

FIG. 10B is a cross-sectional view of a drive mechanism having the cupped flywheel 702 which is frictionally engaged with the driver profile 610. In FIG. 10B, the cross-sectional view illustrates the cantilevered nature of the flywheel ring 750 over at least a portion of the inner rotor motor 500. In an embodiment, the flywheel ring 750 can be cantilevered over the entirety of the inner rotor motor 500, or any portion of the inner rotor motor 500. In the embodiment of FIG. 10B, the cup shape of the cupped flywheel 702 when coupled to the rotor shaft 550 as illustrated in FIG. 10B configures the flywheel ring 750 radially and in a cantilevered configuration about at least a portion of inner rotor motor 500 and/or motor housing 510 and/or rotor 540. The flywheel ring 750 can be positioned along the rotor centerline 1400 at a position at which the flywheel ring 750 is positioned such that a portion of each of the motor housing 510, the stator 530, the inner rotor 540 and the rotor shaft 550 is radially within a flywheel ring inner circumference 707. The flywheel ring inner circumference 707 can have a diameter which optionally is the same or different from the flywheel inner diameter 706. The flywheel ring inner circumference 707 can be separated from the motor housing 510 by a flywheel motor clearance 701. There is no limitation as to the dimension of the flywheel motor clearance 701. The clearance 701 can be in a range of from less than a millimeter to one foot or more, such as 0.02 mm, 0.05 mm, 1 mm, 2 mm, 3 mm, 4 mm, 5 mm, 7.5 mm, 10 mm, 15 mm or 25 mm, or greater. For example, in an embodiment of a power tool the clearance can be in a range of from 0.02 mm to 10 mm can be used. In another non-limiting example for larger industrial equipment a clearance of 5 mm to 25 mm or greater, can be used.

In the example embodiment of FIG. 10B, the flywheel ring inner circumference 707 can be the same as a flywheel inner circumference 709. The flywheel inner circumference 709 can be the same or different from the flywheel ring inner circumference 707. The flywheel inner circumference 709 can have any dimension which is separated from the motor housing 510 by a clearance. The flywheel inner circumference 709 can be at least in part over at least a portion of the inner rotor motor 500 and/or the motor housing 510. The flywheel inner circumference 709 can at least in part radially encompass at least a part of inner rotor motor 500 and/or the motor housing 510.

The driving action of the driver profile 610 can be used to drive a fastener, such as a nail 53, into a workpiece. FIGS. 11, 12, 12B and 13 disclose a selection of steps taken during a driving action of the driver profile 610. The driver profile 610 can be driven by a frictional contact with the flywheel 700 which can be the cantilevered flywheel 899. In an embodiment, the driver profile 610 can have a driver blade 54 which can be propelled to physically contact the fastener such that the fastener is driven into a workpiece. In an embodiment, the fastener can be a nail 53. The driving action of the driver profile 610 can begin when the driver profile 610 makes contact with the flywheel 700 which can be a cantilevered flywheel 899, such as the cupped flywheel 702. Upon contact by the driver profile 610 with the flywheel 700, the driver profile 610 can be propelled toward the nosepiece 12 and a fastener such as a nail 53 positioned in the nosepiece 12 for driving into a work piece. The driver profile 610 and/or the driver blade 54 can physically contact the fastener such that the fastener is driven into a workpiece. After the fastener is driven into the workpiece, the driver profile 610 can return to its resting position. In an embodiment, the driver profile 610 can be driven by means of frictional contact by the flywheel 750 of the cupped flywheel 702.

Figure 10C:
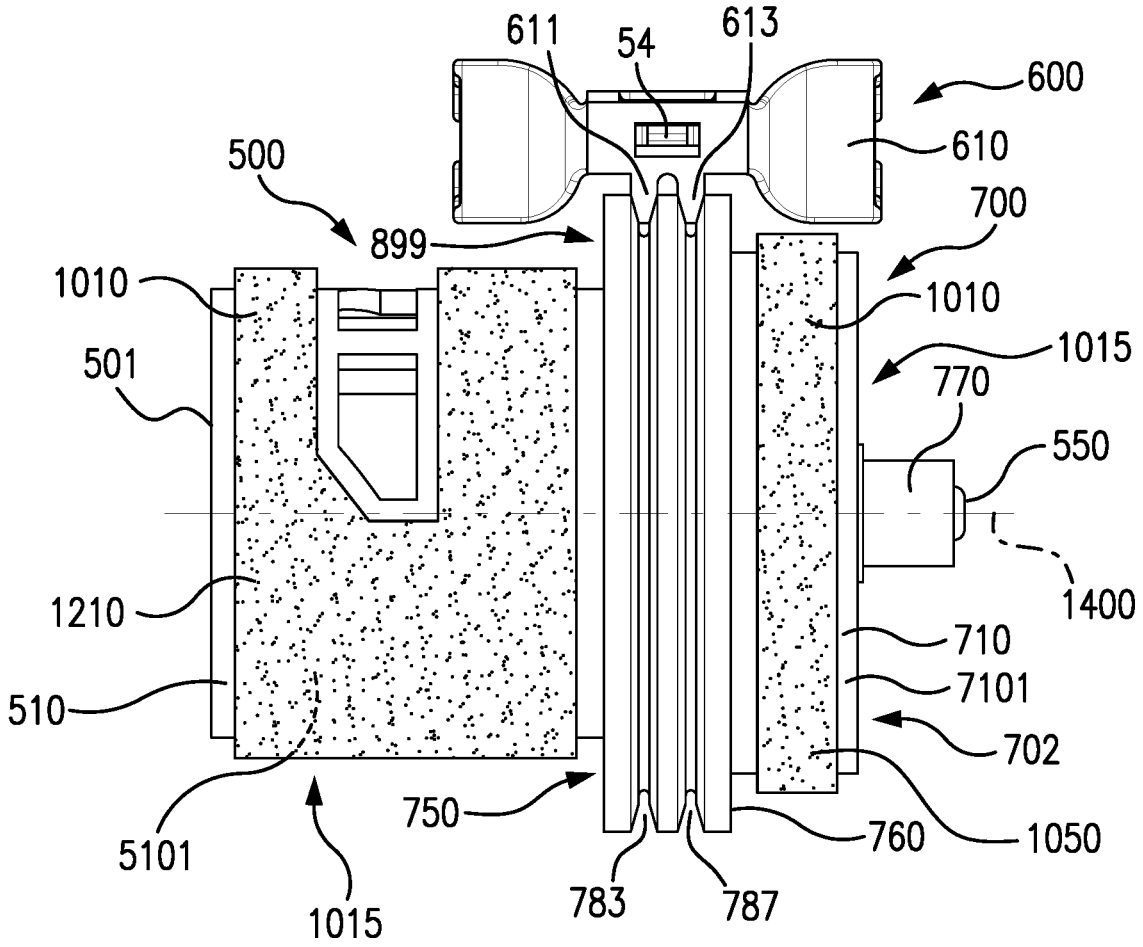
FIG. 10C a side view of a drive mechanism having an inner rotor motor which has a sound damping material and the cupped flywheel which has a sound damping material.

FIG. 10C a side view of a drive mechanism having an inner rotor motor 500 which has the sound damping material 1010 and having the cupped flywheel 702 which has the sound damping material 1010. The sound damping material 1010 can have a broad variety of shapes, forms, configurations and applications. The sound damping material 1010 can be applied directly to a surface, in pre-formed shapes, tapes, laminates, sheets, or other structure and/or configuration. Methods of application can also broadly vary.

FIG. 10C shows the sound damping member 1015 which has the sound damping material 1010 and which is in the form of a sound damping sheet 1210. The sound damping sheet 1210 is shown wrapped around and/or covering in part or wholly a motor housing outside surface 5101 of motor housing 510. The sound damping sheet 1210 can be adhered to and/or cover all or part of the motor housing 510.

FIG. 10C also shows the sound damping member 1015 which has the sound damping material 1010 and which is in the form of the sound damping tape 1050. The sound damping tape 1050 is shown wrapped around and/or covering a flywheel body outside surface 7101. The sound damping sheet 1210 can be adhered to and/or cover all or part of the flywheel body outside surface 7101.

Figure 11:
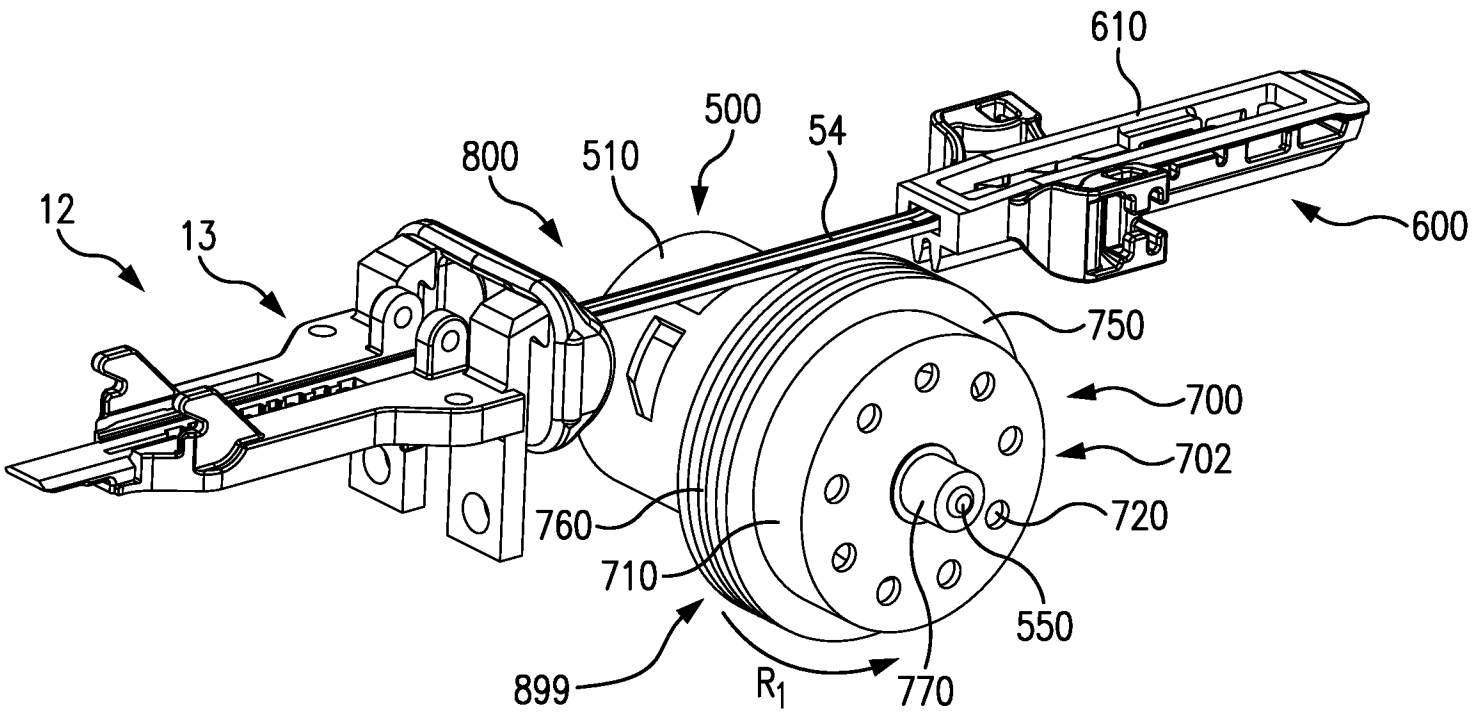
FIG. 11 is a perspective view of the drive mechanism having the cupped flywheel and the driver which is in a resting state.

FIG. 11 is a side view of a drive mechanism having the cupped flywheel 702 and a driver profile 610 which is in a resting state. In FIG. 11, the driver profile 610 has a portion proximate to but not touching the flywheel ring 750 of the cupped flywheel 702. In FIG. 11, the driver blade 54 is shown extending from its seating in the driver profile 610 to the latched nosepiece assembly 13 and its parts, such as the nosepiece 28. The flywheel 700 can rotate at a speed and an angular velocity.

Numeric values and ranges herein, unless otherwise stated, are intended to have associated with them a tolerance and to account for variances of design and manufacturing. Thus, a number is intended to include values "about" that number. For example, a value X is also intended to be understood as "about X". Likewise, a range of Y-Z, is also intended to be understood as within a range of from "about Y-about Z". Unless otherwise stated, significant digits disclosed for a number are not intended to make the number an exact limiting value. Variance and tolerance is inherent in mechanical design and the numbers disclosed herein are intended to be construed to allow for such factors (in non-limiting e.g., ±10 percent of a given value). Example numbers disclosed within ranges are intended also to disclose sub-ranges within a broader range which have an example number as an endpoint. A disclosure of any two example numbers which are within a broader range is also intended herein to disclose a range between such example numbers. Likewise, the claims are to be broadly construed in their recitations of numbers and ranges.

In the embodiment of FIG. 11, the cantilevered flywheel 899 is shown to be the cupped flywheel 702. There is no limitation regarding the diameter or dimensions of any of the various embodiments of the flywheel 700 disclosed herein, such as the cantilevered flywheel 899 which can be the cupped flywheel 702, or other type of cantilevered flywheel having at least a portion projecting over at least a portion of the inner rotor motor 500. In other example embodiments, the flywheel 700 can have a number of flywheel struts 713 (FIG. 18G), or flywheel 700 can have a flywheel mesh structure 740 (FIG. 18F), or other structure. Any of the flywheels disclosed herein can have a diameter from small to quite large, such as in a range of from less than 0.5 inches to greater than 24 inches. For example cupped flywheel 702 can have a portion, such as a flywheel body portion 710 and/or a flywheel outer diameter 704 (FIG. 19A) having a diameter which can be 0.05 in, 1.0 in, 1.5 in, 2.0 in, 3.0 in, 4.0 in, 5.0 in, 6.0 in, 7.0 in, 8.0 in, 9.0 in, 10.0 in, 11.0 in, 12.0 in, 12.6 in, 15 in, 18 in, 24 in. The flywheel ring 750 can also have an outer diameter 751 which can be 0.05 in, 1.0 in, 1.5 in, 2.0 in, 3.0 in, 4.0 in, 5.0 in, 6.0 in, 7.0 in, 8.0 in, 9.0 in, 10.0 in, 11.0 in, 12.0 in, 12.6 in, 15 in, 18 in, 24 in. Additionally, there is no limitation to the structural supports for the flywheel ring 750.

There is no limitation to the speed at which any of the many types and variations of flywheels operate. For example, any of the flywheels disclosed herein can be operated at any rotational speed in the range of from 2500 rpm to 20000 rpm, or greater. In an embodiment, cupped flywheel 702 can be operated at a rotational speed of from less than 2500 rpm to 20000 rpm, or greater. For example, cupped flywheel 702 can be operated at a rotational speed of 1000 rpm, 2500 rpm, 5000 rpm, 5600 rpm, 7500 rpm, 8000 rpm, 9000 rpm, 10000 rpm, 12000 rpm, 12500 rpm, 13000 rpm, 14000 rpm, 15000 rpm, 17500 rpm, 18000 rpm, 20000 rpm, 25000 rpm, 30000 rpm, 32000 rpm, or greater.

There is also no limitation to the angular velocity at which any of the many types and variations of flywheels operate. For example, any of the flywheels disclosed herein can be operated at any rotational speed in the range of from 250 rads/s to 3000 rads/s, or greater. In an embodiment, the cupped flywheel 702 can be operated at a rotational speed of from less than 250 rads/s to 3000 rads/s, or greater. For example, the cupped flywheel 702 can be operated at a rotational speed of 200 rads/s, 300 rads/s, 400 rads/s, 500 rads/s, 600 rads/s, 700 rads/s, 800 rads/s, 900 rads/s, 1000 rads/s, 1200 rads/s, 13000 rads/s, 1400 rads/s, 1500 rads/s, 1600 rads/s, 1750 rads/s, 2000 rads/s, 2200 rads/s, 2500 rads/s, 3000 rads/s, or greater.

There is also no limitation to the velocity of a flywheel portion and/or a portion of the contact surface 715 at which any of the many types and variations of flywheels operate. For example, any of the flywheels disclosed herein can be operated such that the velocity of a flywheel portion and/or a portion of contact surface 715 is in a range of from less than 5 ft/s to 400 ft/s, or greater. For example cupped flywheel 702 can be operated such that velocity of a flywheel portion and/or a portion of contact surface 715 is 2.5 ft/s, 5 ft/s, 7.5 ft/s, 9 ft/s, 10 ft/s, 15 ft/s, 20 ft/s, 25 ft/s, 30 ft/s, 50 ft/s, 75 ft/s, 90 ft/s, 100 ft/s, 125 ft/s, 150 ft/s, 175 ft/s, 190 ft/s, 200 ft/s, 250 ft/s, 300 ft/s, 350 ft/s, 400 ft/s, or greater.

There is no limitation to the mass which any of the many types and variations of flywheels disclosed herein can have. For example, any of the flywheels disclosed herein can have a mass in a range of from less than 1 oz to greater than 50 oz. For example the cupped flywheel 702 can have a mass of less than 0.5 oz, 1.0 oz, 0.75 oz, 1 oz, 2 oz, 3 oz, 4 oz, 5 oz, 7.5 oz, 9 oz, 10 oz, 12 oz, 14 16 oz, 18 oz, 20 oz, 25 oz, 30 oz, 40 oz, 50 oz, or greater. In another example, the cupped flywheel 702 can have a mass of less than 10 g, 25 g, 28 g, 50 g, 75 g, 100 g, 150 g, 200 g, 250 g, 300 g, 500 g, 750 g, 900 g, 1000 g, 1250 g, 1500 g, 2000 g, or greater.

There is no limitation to the inertia of any of the many types and variations of flywheels. For example, any of the flywheels disclosed herein can be operated to have any inertia in the range of from less than 10 J(kg*m^2) to 500 J(kg*m^2), or greater. For example cupped flywheel 702 can have an inertia of less than 5 J(kg*m^2), 7.5 J(kg*m^2), 10 J(kg*m^2), 25 J(kg*m^2), 50 J(kg*m^2), 75 J(kg*m^2), 90 J(kg*m^2), 100 J(kg*m^2), 150 J(kg*m^2), J(kg*m^2), 200 J(kg*m^2), 250 J(kg*m^2), 300 J(kg*m^2), 350 J(kg*m^2), 400 J(kg*m^2), 450 J(kg*m^2), 500 J(kg*m^2), 600 J(kg*m^2), or greater.

There is also no limitation regarding the flywheel energy which any of the many types and variations of flywheels can possess. For example, any of the flywheels disclosed herein can have a flywheel energy of any value in the range of from less than 10 j to 1500 j, or greater. For example cupped flywheel 702 can have a flywheel energy of less than 5 j, 10 j, 20 j, 50 j, 100 j, 150 j, 200 j, 250 j, 300 j, 350 j, 400 j, 450 j, 500 j, 550 j, 600 j, 650 j, 700 j, 750 j, 800 j, 900 j, 1000 j, 1100 j, 1250 j, 1500 j, 2000 j, or greater.

Figure 12A:
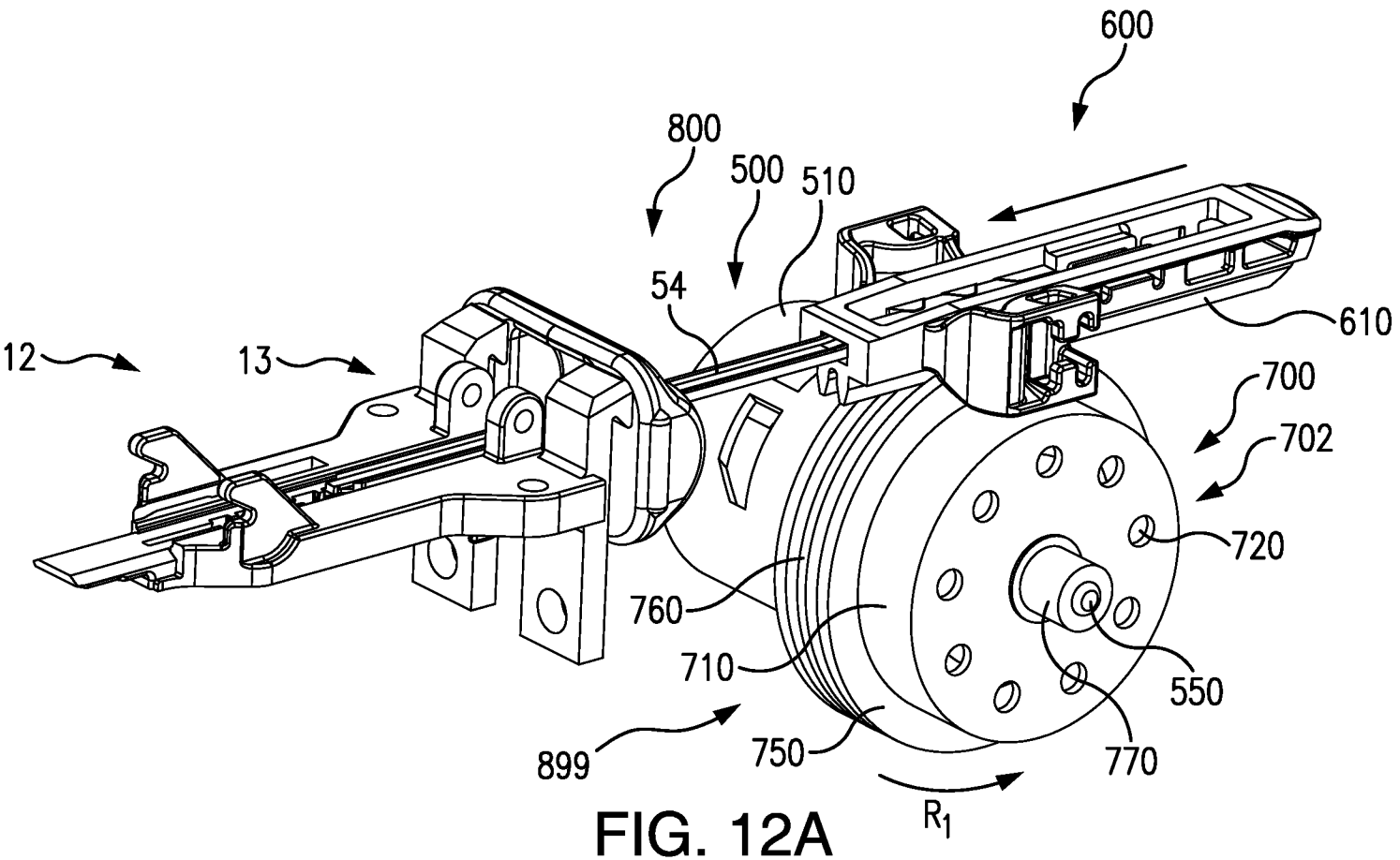
FIG. 12A is a perspective view of the drive mechanism having the cupped flywheel and the driver which is in an engaged state.

FIG. 12A is a side view of a drive mechanism having the cupped flywheel 702 and a driver profile 610 which is in an engaged state. In FIG. 12A, the driving process is shown at a point of the sequence in which the driver profile 610 is frictionally engaged with the cupped flywheel 702. At this stage the cupped flywheel 702 will impart energy to the driver profile 610 which bears the driver blade 54. This energy will propel the driver profile toward the nosepiece 12, which in the example of FIG. 12A is the latched nosepiece 13.

There is no limitation to the driving force which can be imparted to the driver profile 610 and/or the driver blade 54. For example, any of the flywheels disclosed herein can impart a driving force in a range of from less than 2 j to 1000 j, or greater. For example cupped flywheel 702 can impart a driving force to the driver profile 610 and/or the driver blade 54 of less than 1 j, 2 j, 4 j, 8 j, 10 j, 15 j, 20 j, 25 j, 50 j, 75 j, 90 j, 100 j, 125 j, 150 j, 175 j, 200 j, 250 j, 300 j, 350 j, 400 j, 500 j, 1000 j, 15000 j, or greater.

There is no limitation to the torque generated by the inner rotor motor 500. For example, any of the flywheels disclosed herein can be driven by the inner rotor motor 500 which can generate a torque in the range of from less than 0.005 Nm to 10 Nm, or greater. For example, the inner rotor motor 500 can generate any torque in the range of from less than 0.005 Nm, 0.01 Nm, 0.05 Nm, 0.075 Nm, 0.09 Nm, 0.1 Nm, 1.5 Nm, 2 Nm, 2.5 Nm, 3 Nm, 3.5 Nm, 4 Nm, 4.5 Nm, 5 Nm, 6 Nm, 7 Nm, 10 Nm, or greater.

There is no limitation to the velocity of the driver profile 610 at which any of the many types and variations of flywheels operate. For example, any of the driver profile 610 disclosed herein can be operated at any velocity in the range of from less than 10 ft/s to 400 ft/s, or greater. For a power tool and/or fastening device having the cupped flywheel 702 can have the driver profile 610 which can have a velocity of for example, 2.5 ft/s, 5 ft/s, 7.5 ft/s, 9 ft/s, 15 ft/s, 20 ft/s, 25 ft/s, 30 ft/s, 50 ft/s, 75 ft/s, 90 ft/s, 100 ft/s, 125 ft/s, 150 ft/s, 175 ft/s, 190 ft/s, 200 ft/s, 250 ft/s, 300 ft/s, 350 ft/s, 400 ft/s, or greater.

Figure 12B:
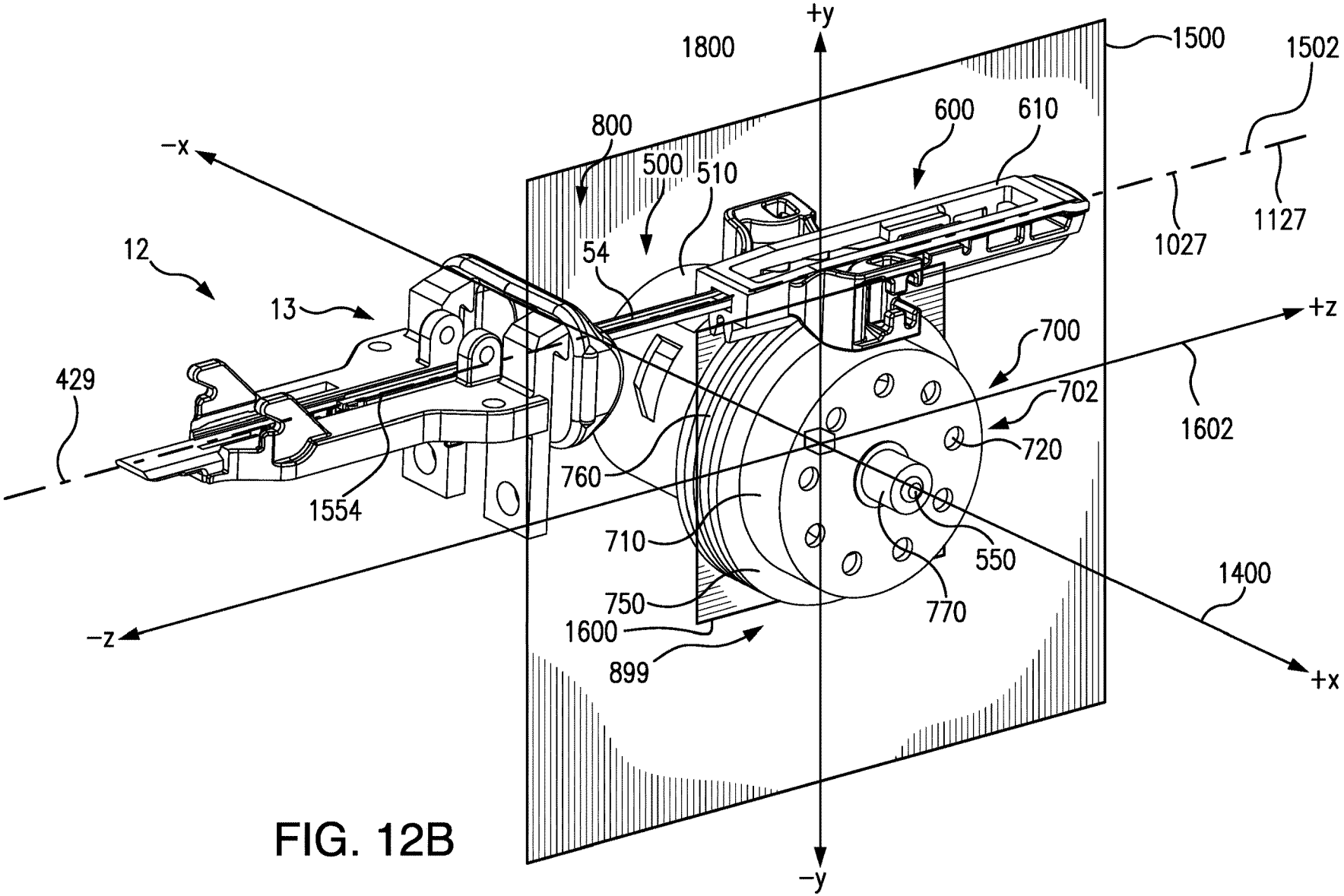
FIG. 12B is a perspective view of the drive mechanism having the cupped flywheel and the driver which is in an engaged state showing an embodiment in which a flywheel ring centerline plane is coplanar with a driver centerline plane.

FIG. 12B is a side view of a drive mechanism having the cupped flywheel and a driver which are in an engaged state and shows an embodiment in which the flywheel ring centerline plane 1600 is coplanar with the driver centerline plane 1500. FIG. 12B provides a detailed illustration of the geometry of the example embodiment disclosed in FIG. 12A. In an embodiment, a cantilevered flywheel member such as the flywheel ring 750 can be positioned along its rotational plane to have a flywheel ring center line plane 1600 coplanar to a driver centerline plane 1500. There is no limitation to the geometries and configurations which can be used to coordinate a portion of the flywheel 700 to contact the driver profile 610. In the embodiment shown in FIG. 12A, the cupped flywheel 702 has a cantilevered position of a portion of cupped flywheel body 710 and flywheel ring 750 such that they are projected over at least a portion of the inner rotor motor 500.

In the example of FIG. 12B, the alignment of the flywheel ring center line plane 1600 coplanar to the driver centerline plane 1500 can further be positioned coplanar to a plane extending from the channel centerline 429 shown in FIG. 6. In the embodiment of FIG. 12B, the radial centerline 1602 of the flywheel ring 750, the driver profile centerline 1502, driver blade centerline 1554 and the channel centerline 429 can be coplanar.

In an embodiment, the radial centerline 1602 of the flywheel ring 750 and the centerline of the driver profile centerline 1502 can be parallel. In an embodiment, the radial centerline 1602 of the flywheel ring 750 and the centerline of the channel centerline 429 can be parallel. In an embodiment, the driver profile centerline 1502 and the channel centerline 429 can be parallel. In an embodiment, the driver profile centerline 1502 and the driver blade centerline 1554 can be parallel. In an embodiment, the driver profile centerline 1502 and driver blade centerline 1554 can be collinear. In an embodiment, the driver profile centerline 1502, the driver blade centerline 1554 and the channel centerline 429 can be collinear.

There is no limitation to the geometries that can be used regarding the coordination of the components of the drive mechanism disclosed herein. In another embodiment, the driver blade centerline 1554 can be coplanar with the flywheel ring centerline plane 1600. This allows for many configurations of the driver blade 54 and flywheel 700 to achieve a successful driving of the driver blade 54. In another embodiment, the driver profile centerline 1502 can be coplanar with the flywheel ring center line plane 1600. Many configurations of the driver profile 610 and flywheel 700 can achieve a successful driving of the driver profile 610. In another embodiment, the channel centerline 429 can be coplanar with the flywheel ring center line plane 1600. Many configurations of the channel 52 and flywheel 700 can achieve a successful driving of a nail 53.

While the embodiment of FIG. 12B shows the radial centerline 1602 of the flywheel ring 750 and the driver profile centerline 1502 in a coplanar arrangement, arrangements which are not coplanar can also be used. For example, configurations can be used in which the driver blade centerline 1554 is not coplanar with the radial centerline 1602 of the flywheel ring 750. In other examples, configurations can be used in which the radial centerline 1602 of the flywheel ring 750 and the channel centerline 429 are not coplanar. In another embodiment, the driver blade centerline 1554 is not collinear with the driver profile centerline 1502.

There is also no limitation to an angle of contact which generates friction and/or otherwise transfers energy between the flywheel 700 and the driver profile 610 and/or driver blade 54. FIG. 12B illustrates a tangential contact between a portion of the driver profile 610 and the flywheel ring 750. Any angle sufficient to allow a transfer of energy from the flywheel 700 to the driver profile 610 and/or directly to the driver blade 54 can be used. For example, a contact between the flywheel 700 can be configured such that the flywheel ring centerline plane 1600 intersects the driver centerline plane 1500 at an angle, such as at an angle less than 90°, or less than 67°, or less than 45°, or less than 34°, or less than 25°, or less than 18°, or less than 15°, or less than 10°, or less than 5°, or less than 3°.

Figure 13:
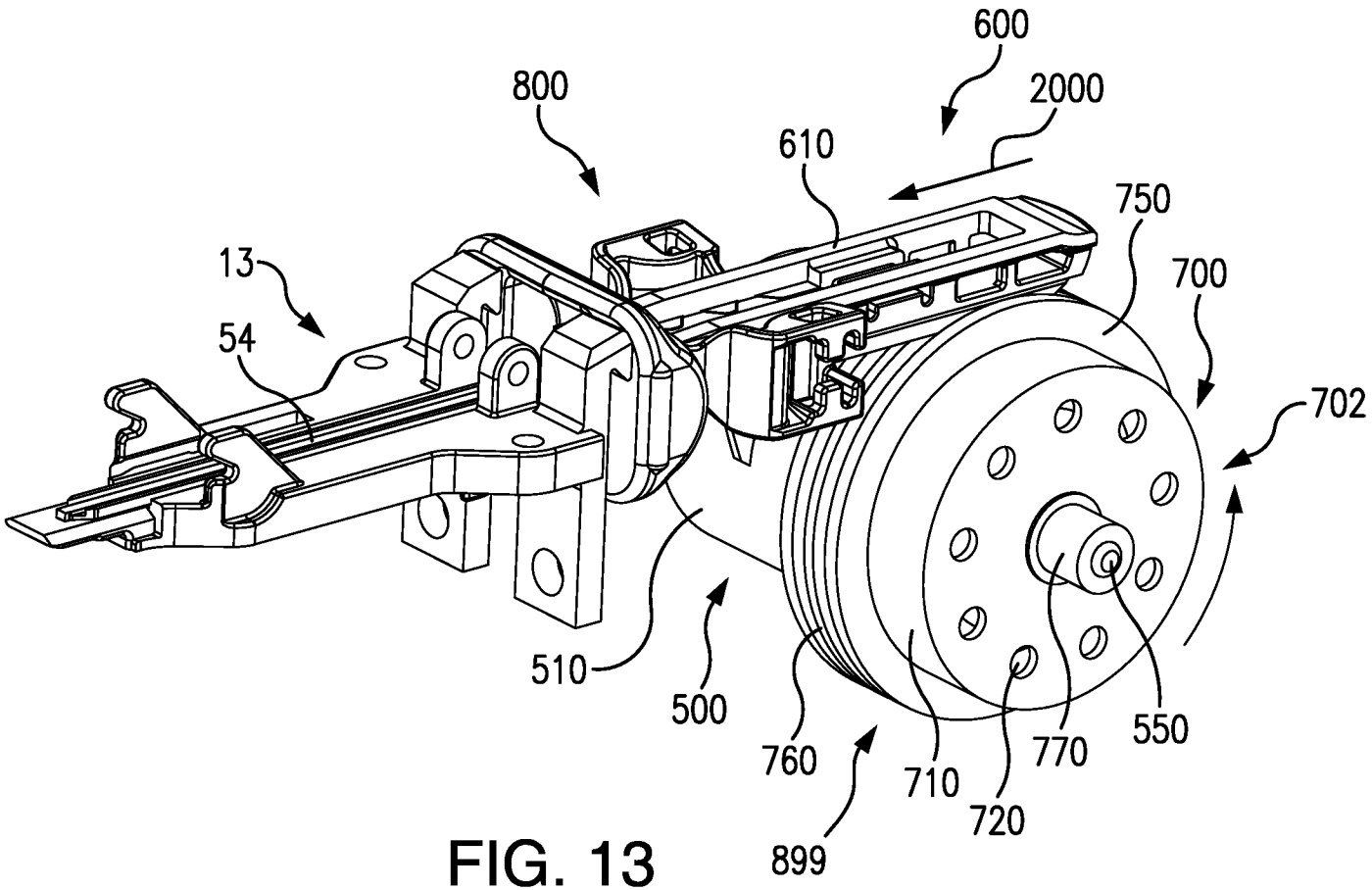
FIG. 13 is a perspective view of a drive mechanism having the cupped flywheel and the driver which is in a driven state.

FIG. 13 is a side view of a drive mechanism having the cupped flywheel and a driver profile 610 which has progressed in its driving action to a position striking a fastener. FIG. 13 illustrates the driver profile 610 at a position in which is still engaged with the flywheel ring 750, yet is near the end of its driving motion which terminates when the driver profiles motion toward the nosepiece assembly 12 ceases and the motion of profile 610 toward the nosepiece 12 stops and/or when recoil begins of the driver profile 610 back toward its original configuration as show in FIG. 11.

Arrow 2000 indicates the direction of motion of the driver profile 610 during a driving action.

Figure 13A:
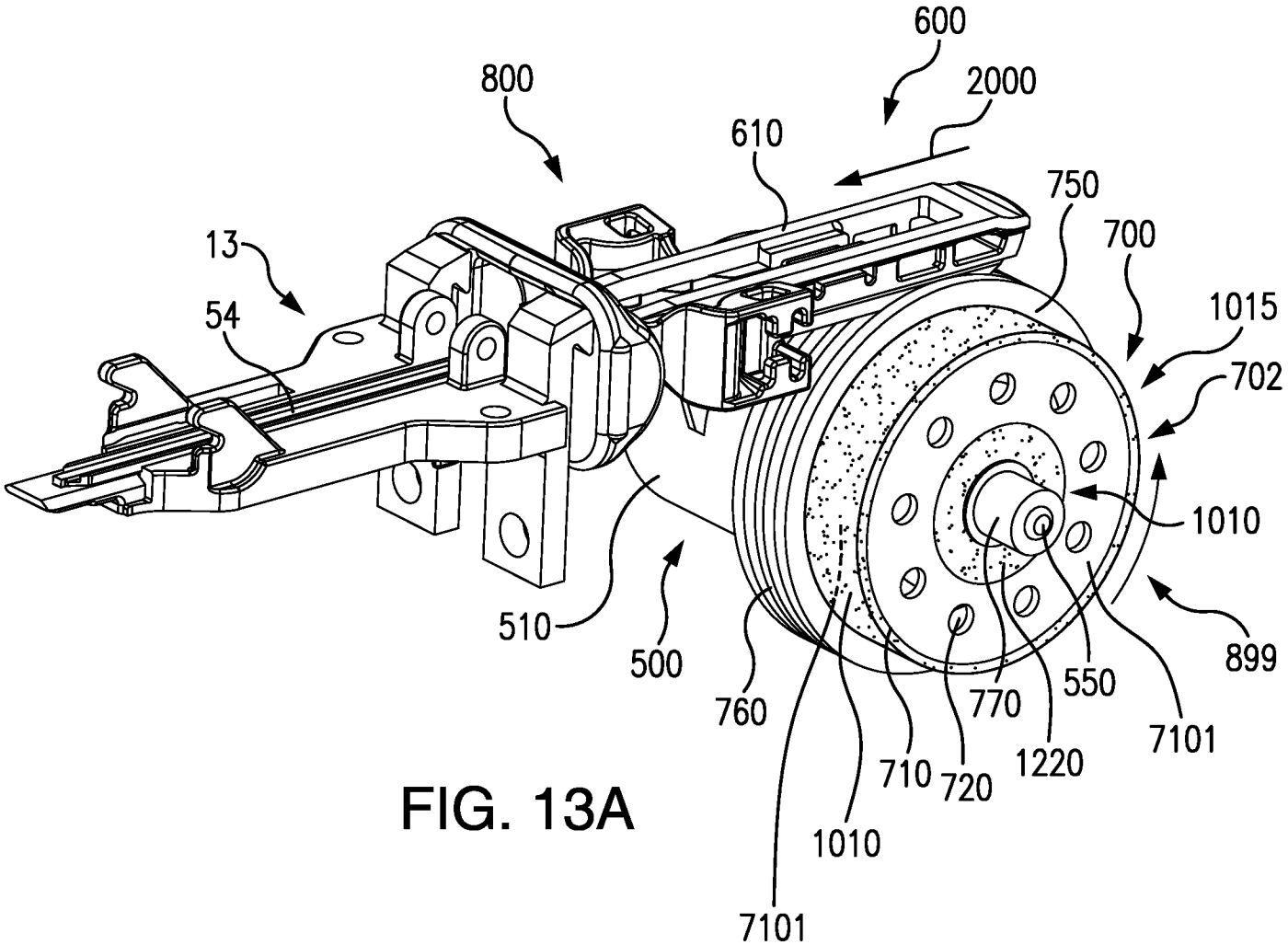
FIG. 13A is a perspective view of a drive mechanism having the cupped flywheel which has the sound damping material and the driver which is in a driven state.

FIG. 13A is a perspective view of a drive mechanism which is in a driven state and which has the cupped flywheel 702. The cupped flywheel 702 of FIG. 13A has a sound damping member 1015 having the sound damping material 1010. The sound damping member 1015 is in the form of a sound damping tape 1050 and can be wrapped around and/or covering a flywheel body outside surface 7101 in part or wholly. FIG. 13A also shows a sound damping cover 1220 which covers and/or is affixed to at least a portion of the flywheel face 703. The sound damping cover 1220 can be adhered to and/or cover all or part of the flywheel face 703.

Figure 14:
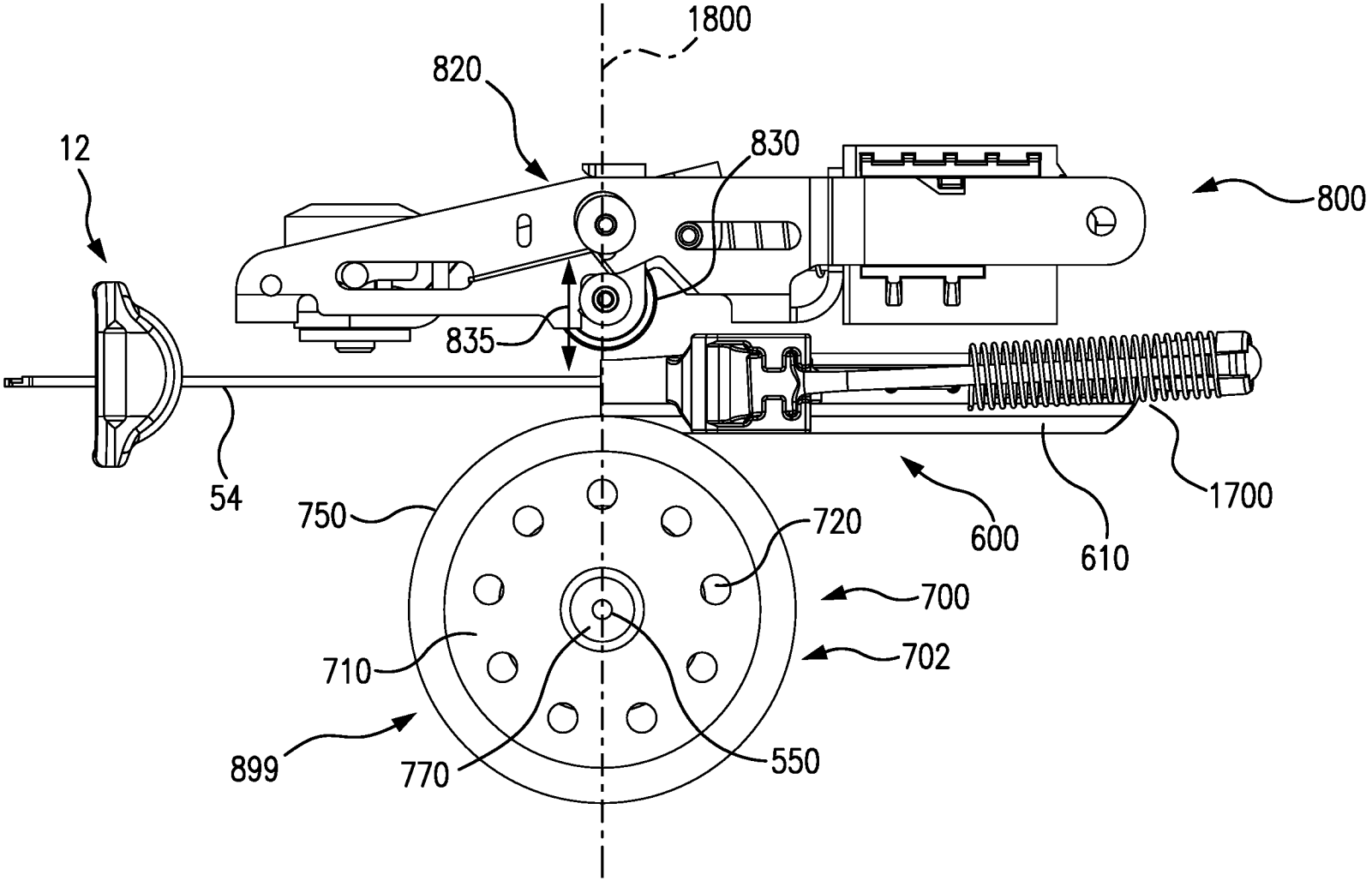
FIG. 14 is a side view of a partial drive assembly having the cupped flywheel.

FIG. 14 is a side view of a drive assembly having the cupped flywheel 702. FIG. 14 shows an example embodiment of a nailer drive mechanism at the state in which the driver profile 610 has initially and tangentially made frictional contact with the flywheel ring 750. This is a position analogous to that depicted in FIG. 12. FIG. 14 illustrates an embodiment of the driver assembly 800 including an activation mechanism 820 which has an activation member 830 which by its movement can impart a force along the engagement axis 1800 (also illustrated in FIG. 12B as a +y and −y axis) which causes the driver profile 610 to come into frictional contact with flywheel 700 to effect a driving motion of driver profile 610. The engagement movement of activation member 830 is reversible and illustrated by a double pointed engagement movement arrow 835. FIG. 14 also illustrates an embodiment of a driver profile return mechanism 1700 which absorbs recoil energy and guides the driver profile 610 back to its resting state, prior to another driving action.

Figure 15:
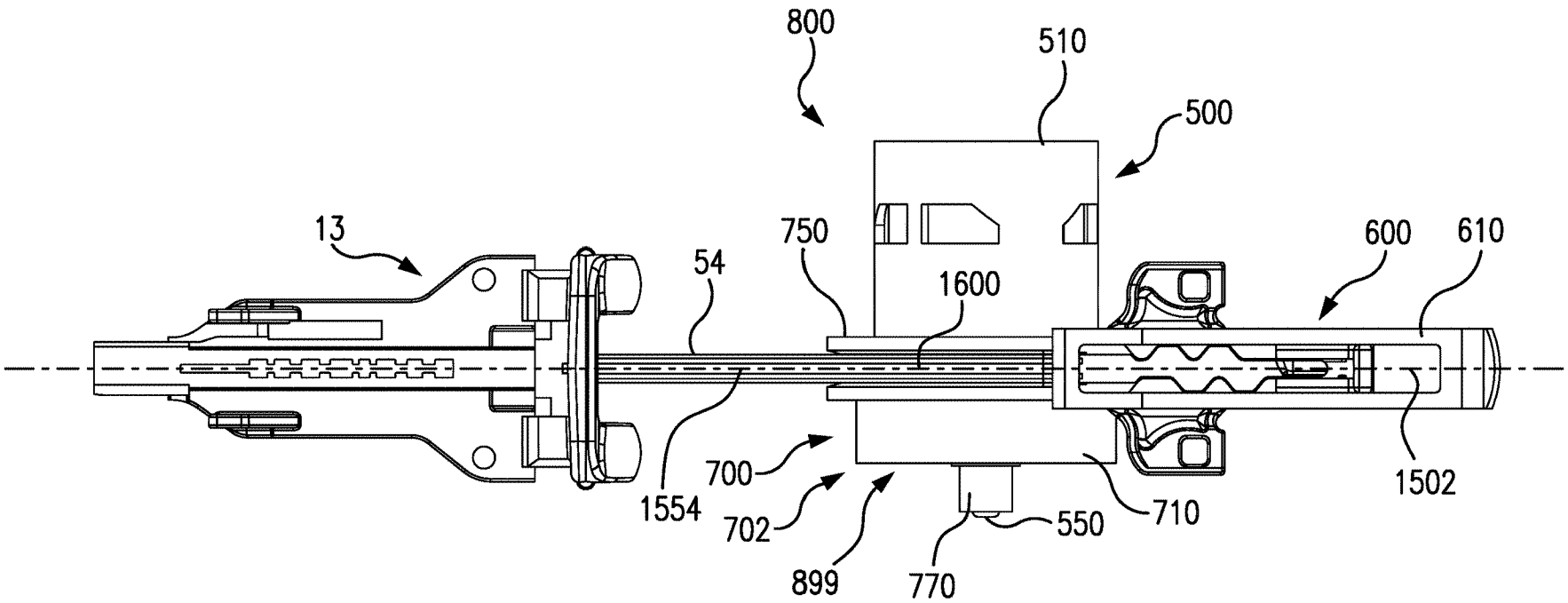
FIG. 15 is a top view of the partial drive assembly having the cupped flywheel.

FIG. 15 is a top view of a partial drive assembly having the cupped flywheel. FIG. 15 shows the driver profile 610 at a resting state. FIG. 15 also illustrates the parallel and/or coplanar configuration of the driver profile centerline 1502, the flywheel ring centerline plane 1600 and the driver blade centerline 1554.

Figure 16A:
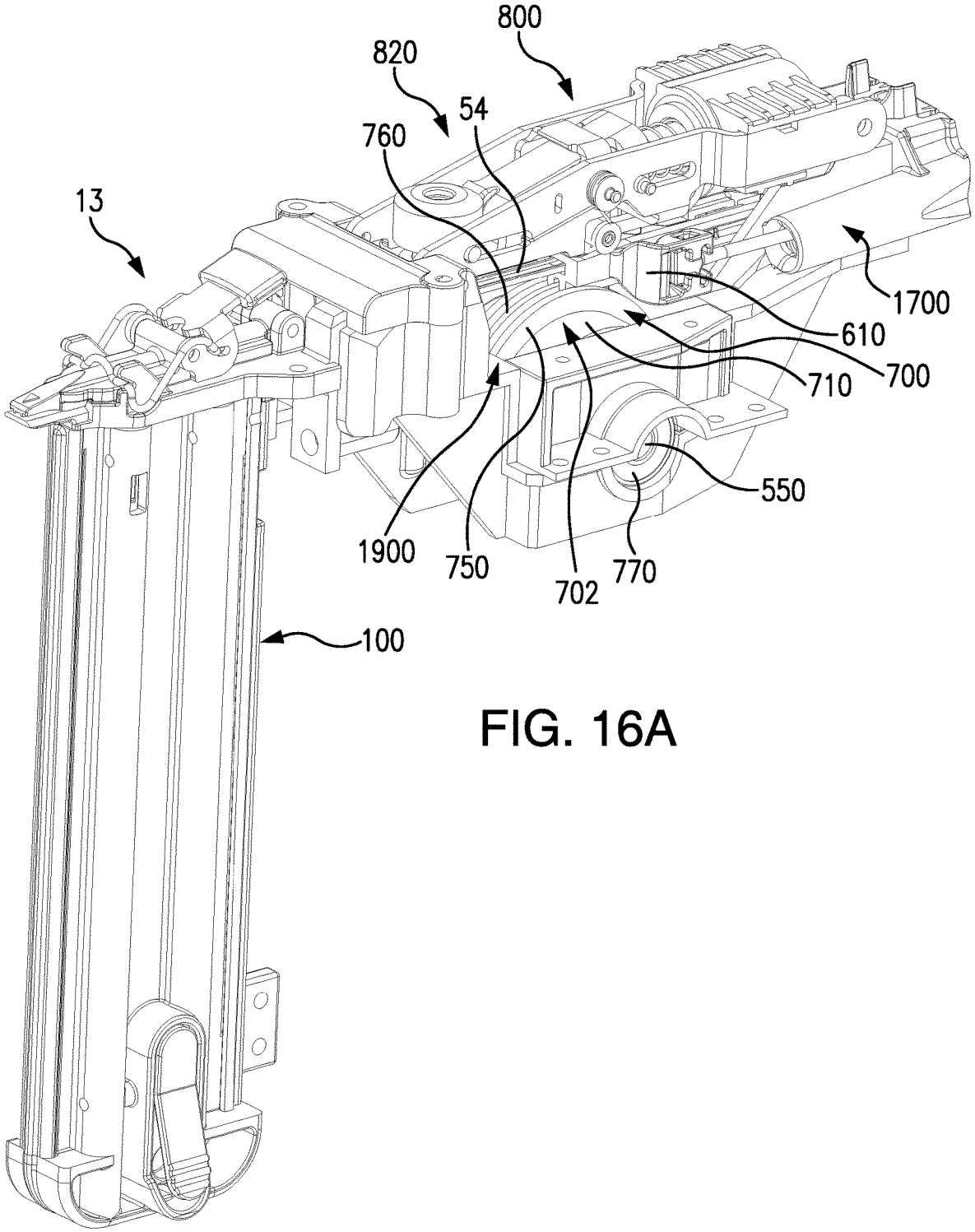
FIG. 16A is a perspective view of the drive assembly having the cupped flywheel shown in conjunction with a magazine for nails.

FIG. 16A is a perspective view of a drive assembly having the cupped flywheel 702 shown in conjunction with the magazine 100 feeding the plurality of nails 55. FIG. 16A illustrates a driver assembly 800 in conjunction with the driver profile 610 and cantilevered drive 1900. The cantilevered drive can have an inner rotor motor 500 and the cupped flywheel 702, as well as a geared flywheel ring 760 which can frictionally engage the driver profile 610 when activated by the activation mechanism 820. In this example embodiment, the power tool is the nailer 1 having the latched nosepiece assembly 13 and the magazine 100 feeding a plurality of nails 55.

FIG. 16A1 is a exploded view of the drive assembly having the cupped flywheel 702, which is also configured as the cantilevered flywheel 899 and the sound damping member 1015 which is optionally the sound damping tape 1050. FIG. 16A1 shows a cantilevered flywheel assembly 1899 having a frame 1260 with a frame cover 1275 which supports a flywheel assembly 705 and a motor assembly 508. The cantilevered flywheel assembly 1899 can also have an end cap 1295.

The non-limiting example of FIG. 16A1 shows a flywheel assembly 705 which has a flywheel 700 and which is the cantilevered flywheel assembly 1899 having the cantilevered flywheel 899. In the embodiment of FIG. 16A1, the cantilevered flywheel 899 is shown as the cupped flywheel 702. The flywheel assembly 705 can be at least in part supported by a retaining ring 1265 and a bearing ball 521. The sound damping member 1015, which can be the sound damping tape 1050, is shown configured and adhered to the flywheel ring inner surface 1706 of the cupped flywheel 702.

The motor assembly 508 can have the inner rotor motor 500 which has a magnet ring 531, which can at least in part surround an armature 535, as well as having an upper brush box 532, a lower brush box 533 and an end bridge 537 configured with a bearing plug 523 and an end bridge screw 538. Motor control elements and systems can broadly vary. The example of FIG. 16A1 shows motor control components which include a thermistor 539, a hall sensor 1285 which can be mounted on a pc board 1290 and which can be engaged with a hall sensor board mount 1280. The end bridge 537 can optionally be secured by one or more of an end bridge screw 538 and can be covered at least in part by the end cap end cap 1295.

FIG. 16A2 is a side view of the exploded view of the drive assembly of FIG. 16A1 having the cupped flywheel 702 and the sound damping tape 1050.

FIG. 16A3 is a side view of the drive assembly of FIG. 16A1 when assembled and having the cupped flywheel 702 and the sound damping tape 1050. The drive assembly can have a flywheel assembly 705 and a motor assembly 508 supported by a frame 1260 having a frame cover 1275. The drive assembly can be covered at least in part by the end cap 1295.

FIG. 16A4 is a sectional view of the assembled drive assembly of FIG. 16A1 having the cupped flywheel 702 and the sound damping tape 1050. FIG. 16A4 shows a flywheel assembly 705 which is the cantilevered flywheel assembly 1899 and which has a cupped flywheel 702 which is the cantilevered flywheel 899 which can have the flywheel ring 750. The cantilevered flywheel 899 has the sound damping member 1015 having the sound damping material 1010. The sound damping member 1015 is shown as the sound damping tape 1050.

The sound damping tape 1050 is shown to have an adhesive surface 1051 adhered and/or affixed to the flywheel ring inner surface 1706. The sound damping tape 1050 is show to extend along at least a portion of, or all of, the flywheel ring inner circumference 707. The cantilevered flywheel 899 to which the sound damping tape 1050 is affixed cantilevers over at least a portion of the magnet ring 531 (e.g. FIG. 16A4) and/or the motor housing 510 (e.g. FIG. 10C, 13A). The sound damping tape 1050 affixed to the cantilevered portion of the cantilevered flywheel 899 can be in part or wholly cantilevered over at least a portion of the magnet ring 531 and/or the motor housing.

In an embodiment, the sound damping member and/or material can have an adhesion to steel in a range of from 25 N/100 mm to 100 N/100 mm or greater; such as 25 N/100 mm to 50 N/100 mm, 30 N/100 mm to 70 N/100 mm, 50 N/100 mm to 100 N/100 mm, or 75 mm to 100 N/125 mm or greater. In an embodiment the adhesion to steel at a temperature in a range of from −32° C. (negative 32° C.) to 80° C. can be from 25 N/100 mm to 100 N/100 mm or greater; such as 25 N/100 mm to 50 N/100 mm, 30 N/100 mm to 70 N/100 mm, 50 N/100 mm to 100 N/100 mm, or 75 mm to 100 N/125 mm or greater. In an embodiment the adhesion to steel at a temperature in a range of from −25° C. (negative 25° C.) to 50° C. can be from 25 N/100 mm to 100 N/100 mm or greater; such as 25 N/100 mm to 50 N/100 mm, 30 N/100 mm to 70 N/100 mm, 50 N/100 mm to 100 N/100 mm, or 75 mm to 100 N/125 mm or greater. In an embodiment, the adhesion to steel at a temperature in a range of from 0° C. to 40° C. can be from 25 N/100 mm to 100 N/100 mm or greater, such as 25 N/100 mm to 50 N/100 mm, 30 N/100 mm to 70 N/100 mm, 50 N/100 mm to 100 N/100 mm, or 75 mm to 100 N/125 mm or greater.

Figure 16B:
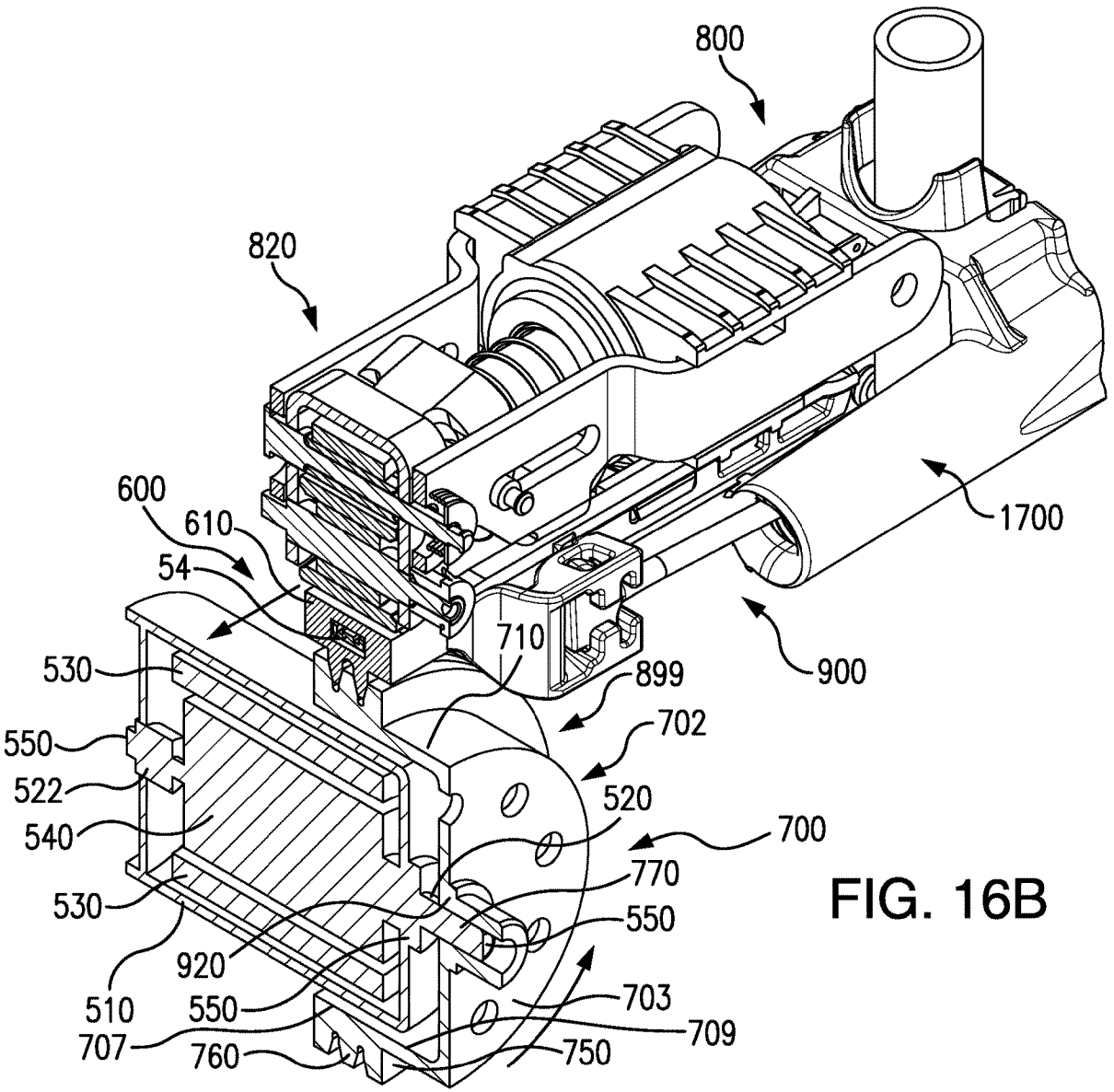
FIG. 16B is a sectional view of the drive assembly having the cupped flywheel taken along the longitudinal centerline plane of the rotor shaft.

FIG. 16B is a sectional view of the drive assembly shown in FIG. 16 having the cupped flywheel sectioned along the longitudinal centerline plane of the rotor shaft. FIG. 16 illustrates a cross-section of the activation mechanism 820 and driver profile 610 bearing driver blade 54. In this embodiment, the driver profile 610 is engaged by the flywheel ring 750. The cupped flywheel 702, the flywheel ring 750, the inner rotor motor 500, the rotor shaft 550 and flywheel bearing 770 are shown in cross-section. FIG. 16B also illustrates a bearing support ring 920 which in the cross-section is shown as a ring of extra material having a thickness provided to strengthen the transition of shape (the approximate 90 degree angle) between the flywheel bearing 770 longitudinal axis and the plane of the flywheel face 703. The bearing support ring 920 can be of a single body construction strengthening the transition of material between the bearing 770 and flywheel face 703.

Figure 17:
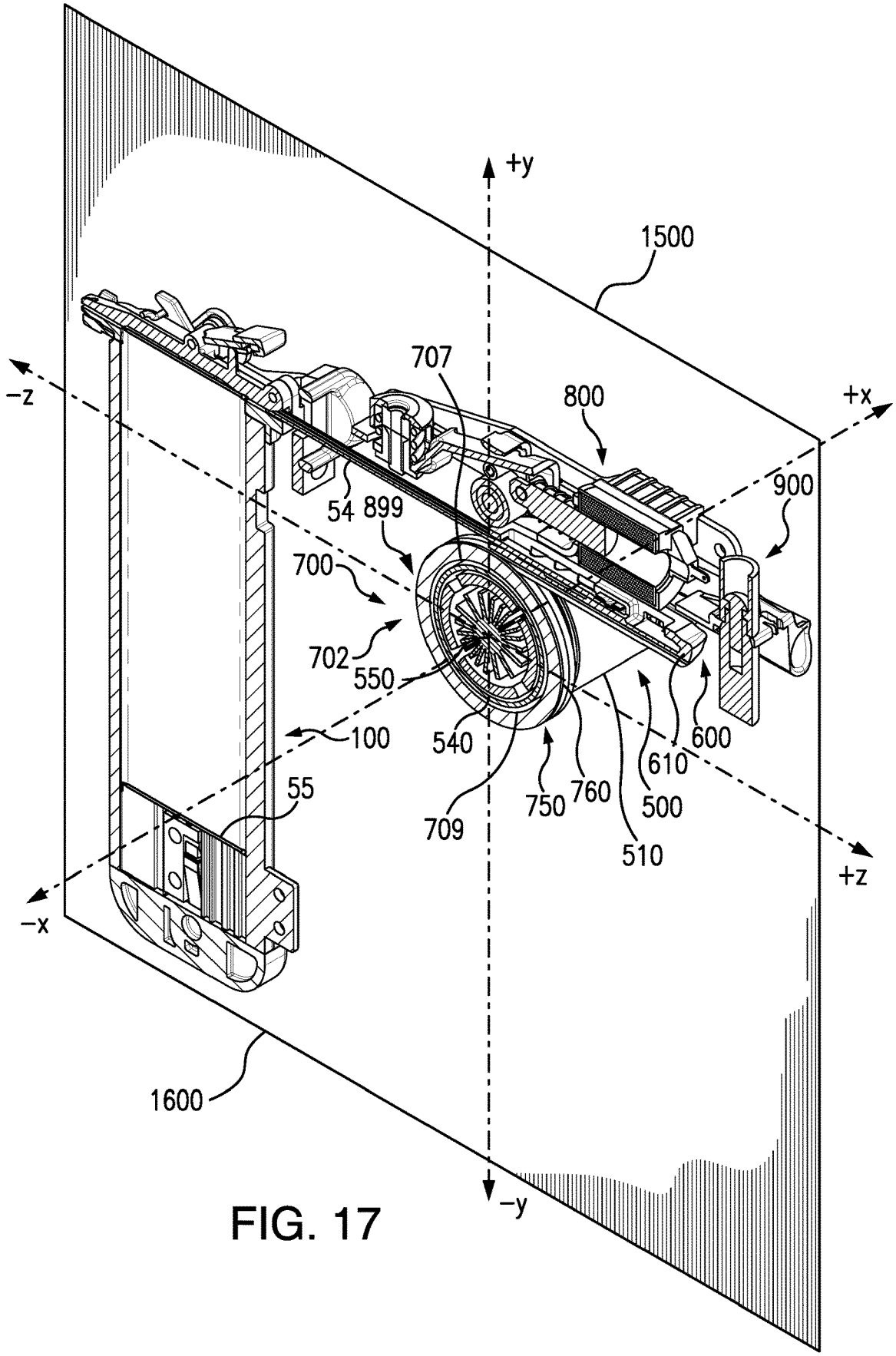
FIG. 17 is a sectional view of the drive assembly having the cupped flywheel taken along the longitudinal centerline plan of the driver profile.

FIG. 17 is a sectional view of a drive assembly having the cupped flywheel 702 taken along the driver centerline plane 1500 of the driver profile. FIG. 17 is a sectional view of the driver assembly 800 example of FIG. 16A, which in FIG. 17 is shown in a cross-sectional view taken along the flywheel ring centerline plane 1600. In the example of FIG. 17, the driver centerline plane 1500 and the flywheel ring centerline plane 1600 are shown in a coplanar configuration. FIG. 17 illustrates an example of the alignment of the flywheel ring 750, the driver profile 610 and the driver blade 54 in conjunction with the activation mechanism 820. The stator 530 and inner rotor 540 of inner rotor motor 500 are shown in cross-section.

FIGS. 18A-G show a variety of embodiments of cantilevered flywheel designs. There is no limitation to the design of the cantilevered flywheels or regarding the means of supporting such flywheels or transferring their energy to a moveable member, such as the driver profile 610. The various cantilevered flywheel designs can have a contact surface 715, as shown in non-limiting example in FIGS. 18A, 20, 21, 22 and 23. The contact surface 715 can be any portion of the flywheel which contacts another member and which imparts energy to another member.

The contact surface 715 in its many types and variations can impart energy to the driver profile 610 and/or driver blade 54. The interface between the contact surface 715 and the driver profile 610 and/or driver blade 54 can have a breadth of variety. For example, the interface can produce a frictional contact (e.g. FIG. 20) or a geared contact (e.g. FIGS. 10A, 10B and 21). The shape of the contact surface 715 can range from flat or flattened, to rough or patterned, to having large gearing. The shape of the contact surface in an axial direction along the −x to +x axis (FIG. 12B) can be any shape in the range of concave to convex. Additionally, the contact surface 715 can have a surface which is sinusoidal, grooved, adapted for a lock and key interface, pitted, nubbed, having depressions, having projections, or any of a variety of topography which can adapt the contact surface 715 to impart energy to another object and/or item, such as the driver profile 610 and/or driver blade 54, or moveable member, gear or other member.

Figure 18A:
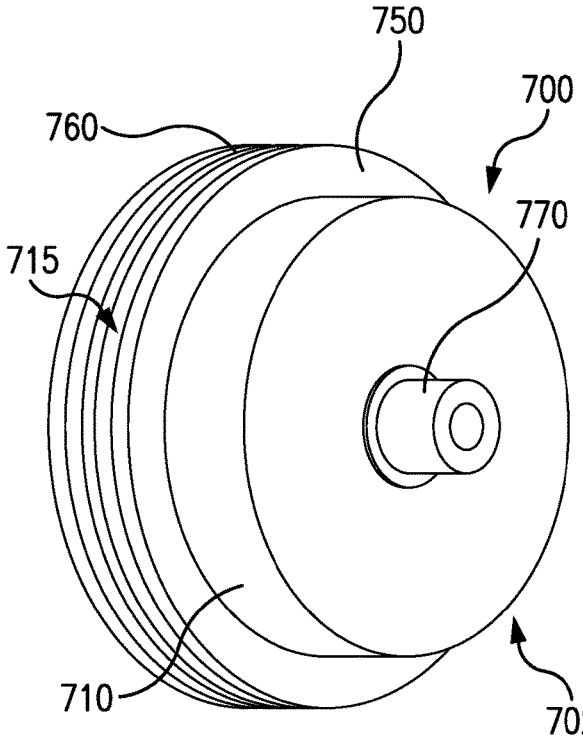
FIG. 18A is a perspective view of the cupped flywheel.
Figure 20:
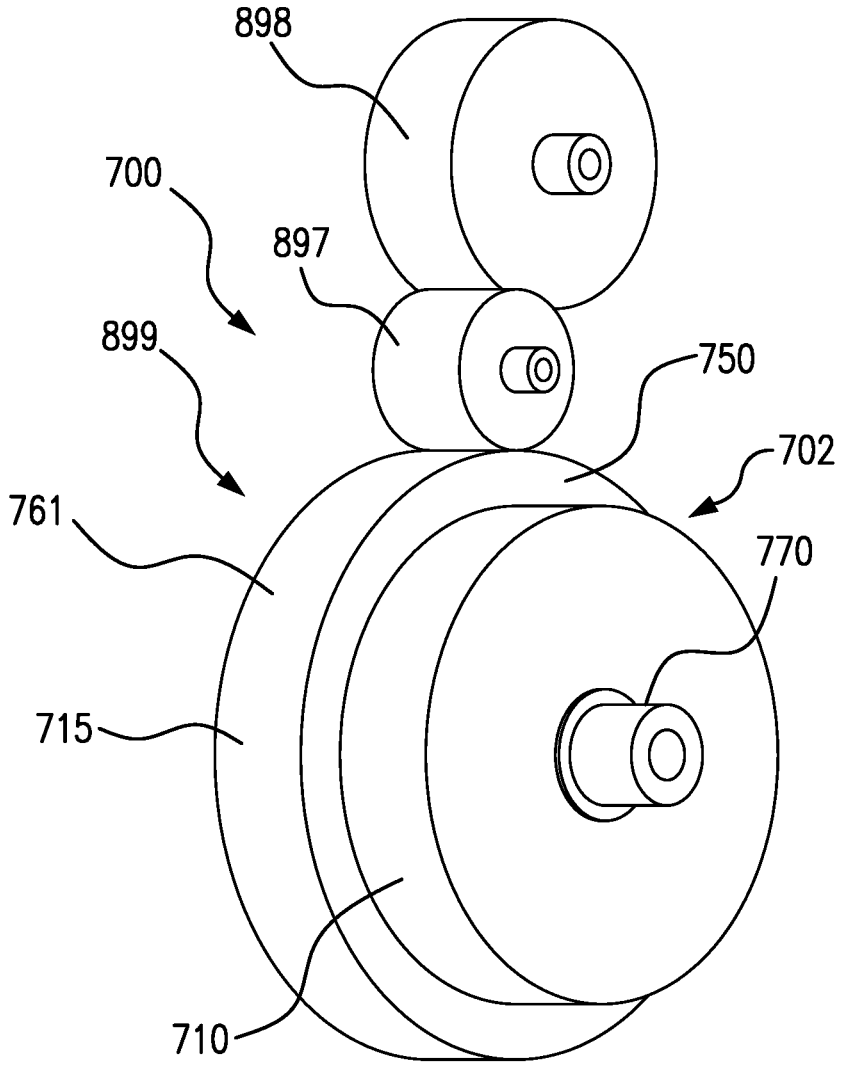
FIG. 20 is an embodiment of a cupped flywheel roller drive mechanism.
Figure 22:
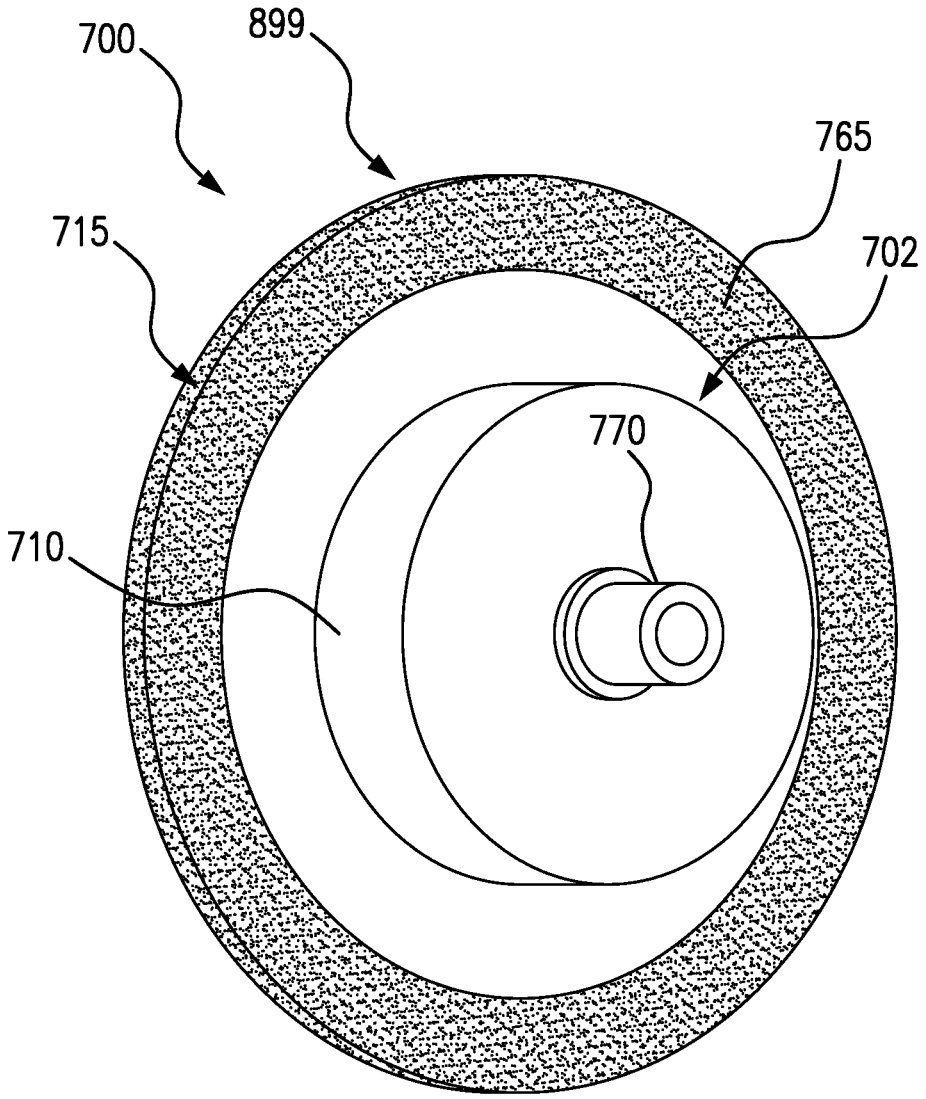
FIG. 22 is an embodiment of the cupped flywheel having a flywheel ring grinder portion.
Figure 23:
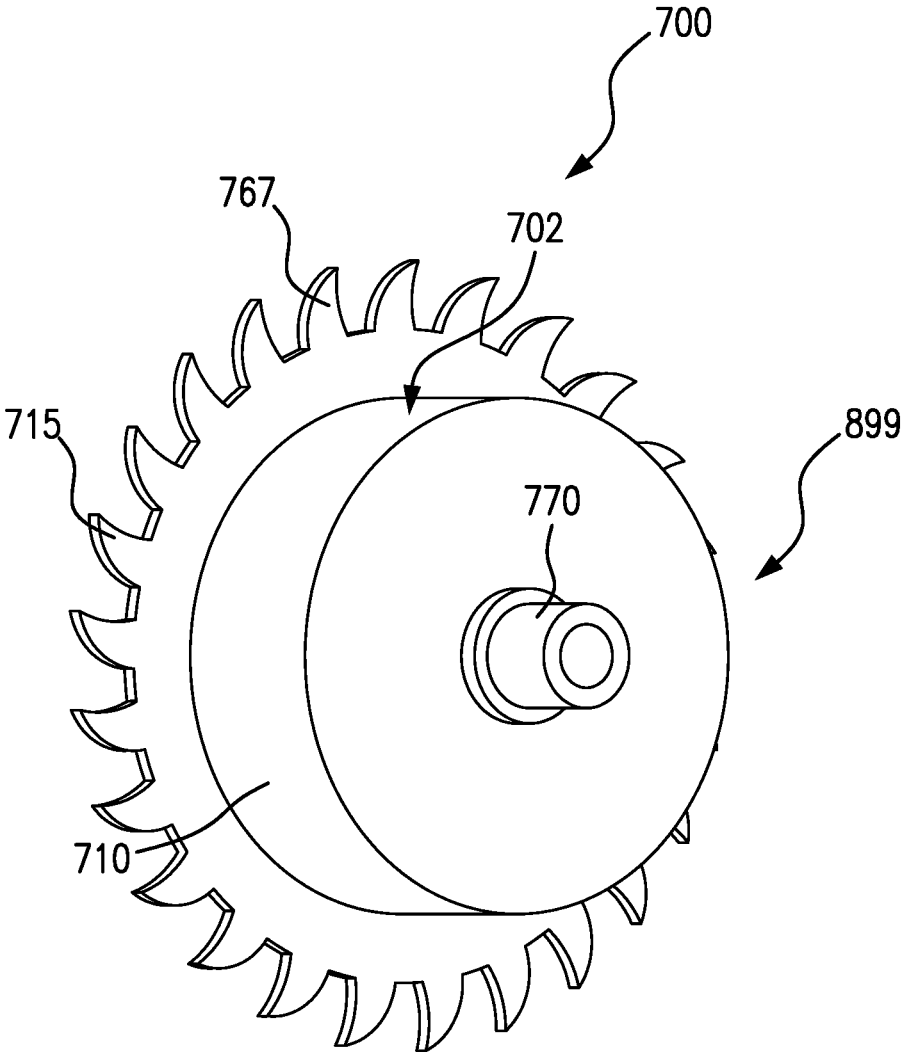
FIG. 23 is an embodiment of the cupped flywheel having a flywheel ring saw portion.

FIG. 18A is a perspective view of the cupped flywheel 702 having the geared flywheel ring 760. In the example of FIG. 18A, the contact surface 715 is shown as a geared surface of the geared flywheel ring 760. In the example of FIG. 20, the contact surface 715 is a flattened surface which can cause another member to rotate or otherwise move. In the example of FIG. 22, the contact surface 715 is a grinding surface of a flywheel ring grinder portion which can remove material from another article. In the example of FIG. 23, the contact surface 715 is a saw tooth portion of flywheel ring saw portion 767. In the many and varied embodiments, the contact surface 715 can be in a position cantilevered to rotate radially about at least a portion of the motor housing 510 and inner rotor motor 500.

Figure 18B:
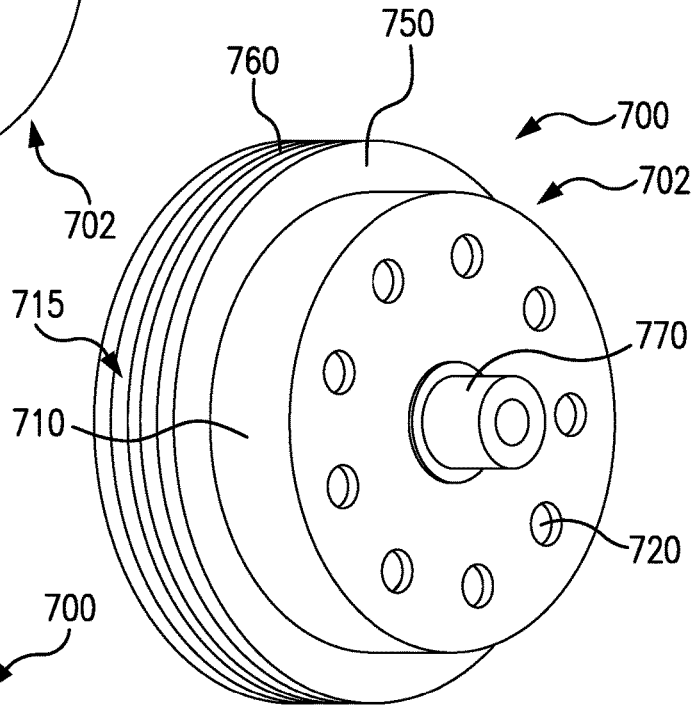
FIG. 18B is a view of the cupped flywheel having a number of flywheel openings in a flywheel face.

FIG. 18B is a view of the cupped flywheel having a number of flywheel openings in the flywheel face. In the example of FIG. 18B, a number of a flywheel openings 720 are present and pass through the flywheel face 703. There is no limitation regarding the shape of the openings which are used with the cupped flywheel 702. If the flywheel cup material is sufficiently thick, grooves or other features which can reduce the weight of the cupped flywheel 702 can be used whether or not an opening is created in any portion of the cupped flywheel 702.

Figure 18C:
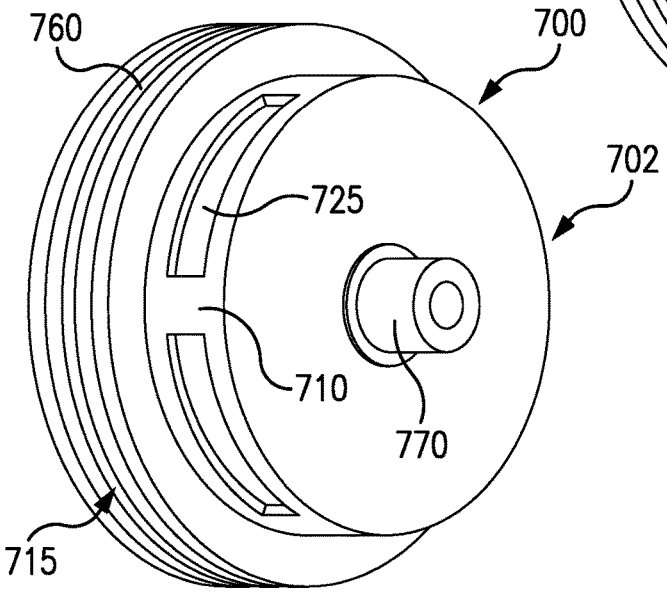
FIG. 18C is a view of the cupped flywheel having a number of flywheel slots in a flywheel body.

FIG. 18C is a view of the cupped flywheel 702 having a number of flywheel slots in a flywheel body 710. The cupped flywheel can have a flywheel slot 725 or a number of flywheel slots. Herein, a number of flywheel slots are also collectively referenced by the numeral 725. FIG. 18C shows the cupped flywheel 702 which has the number of flywheel slots 725 present in the flywheel body 710. The number of the flywheel slots 725 can reduce the weight of the flywheel 700, achieve a desired rotation balance of the flywheel, achieve inertial specifications of the flywheel 700 and meet performance specifications for the flywheel 700. The number of flywheel slots 725 in the cupped flywheel 702 can be used to achieve design benefits, such as weight control and improved performance, analogous to those achieved by using a number of the flywheel openings 720, or openings of other shapes.

Figure 18D:
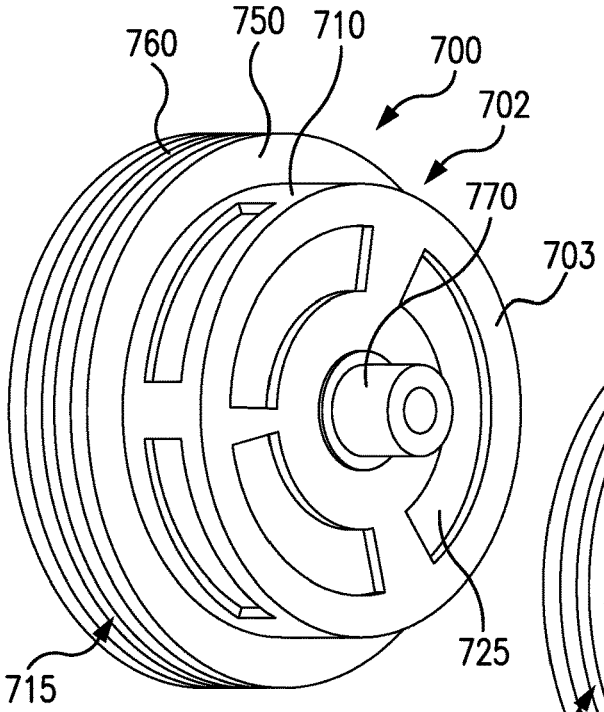
FIG. 18D is a view of the cupped flywheel having a number of flywheel slots in the flywheel body and the flywheel face.

FIG. 18D is a view of the cupped flywheel 702 having the number of slots 725 present in the flywheel body 710 as well as present in the flywheel face 703.

Figure 18E:
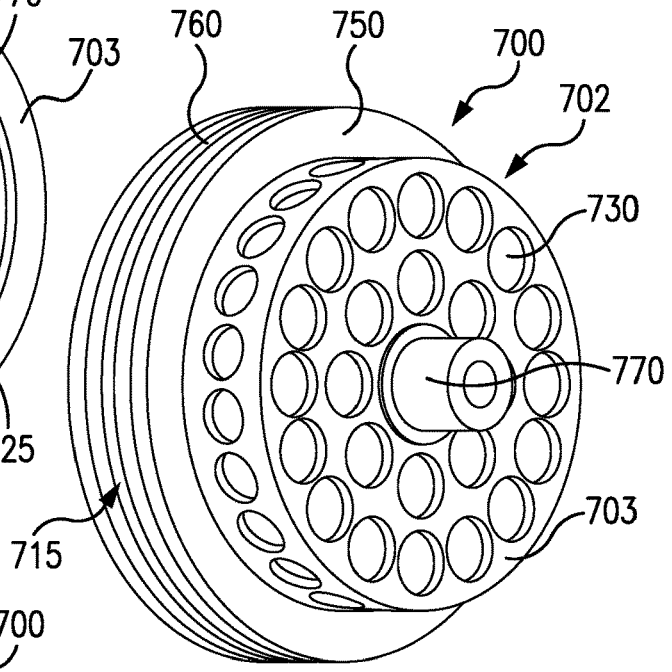
FIG. 18E is a view of the cupped flywheel having a number of flywheel round openings in the flywheel body and the flywheel face.

FIG. 18E is a view of the cupped flywheel having a number of flywheel round openings 703 in a flywheel body 710 and flywheel face 703. In the example of FIG. 18E, the cupped flywheel 702 has a number of a flywheel round openings 730 present in the flywheel body 710, as well as present in the flywheel face 703. While FIG. 18E illustrates an example having a round opening, there is no limitation regarding the shape of the openings that can be used with any variety of the flywheel 700 disclosed herein. For example, openings can be round, oval, oblong, irregular, slots, decoratively shaped, patterned, triangular, square, polygonal, rectangular, or any desired shape and/or pattern.

Figure 18F:
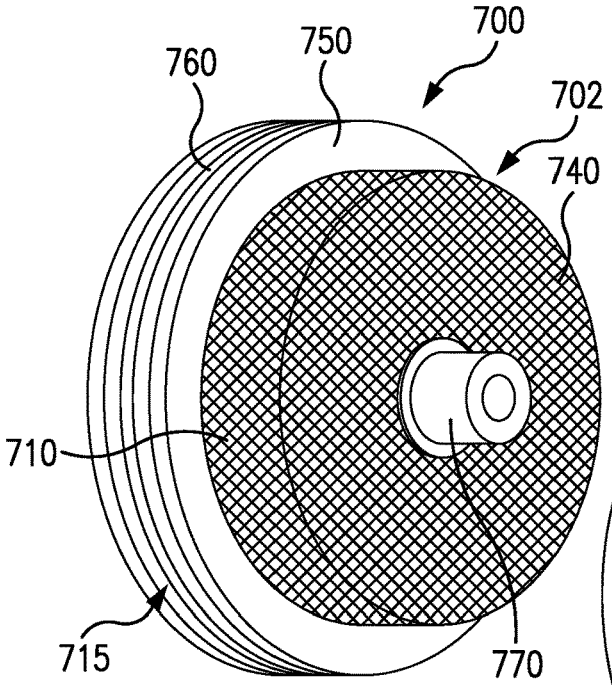
FIG. 18F is a view of the cupped flywheel having a mesh flywheel body and a mesh flywheel face.

FIG. 18F is a view of the cupped flywheel having a mesh flywheel body and mesh flywheel face. There is no limitation as to the nature of the material which supports the contact surface 715 and imparts energy and/or rotational motion from the inner rotor motor 500. Any material which supports the contact surface in a cantilevered position about at least a portion of the inner rotor motor 500 and/or the motor housing 510 can be used. FIG. 18F illustrates an example embodiment in which a flywheel mesh structure 740 is used to support the flywheel ring 750 having a contact surface 715 which is a geared surface.

This disclosure is not limited to a cup-shaped flywheel. The flywheel 700 can be any type of flywheel which supports the contact surface 715 in a cantilevered position about at least a portion of the inner rotor motor 500 and/or the motor housing 510.

Figure 18G:
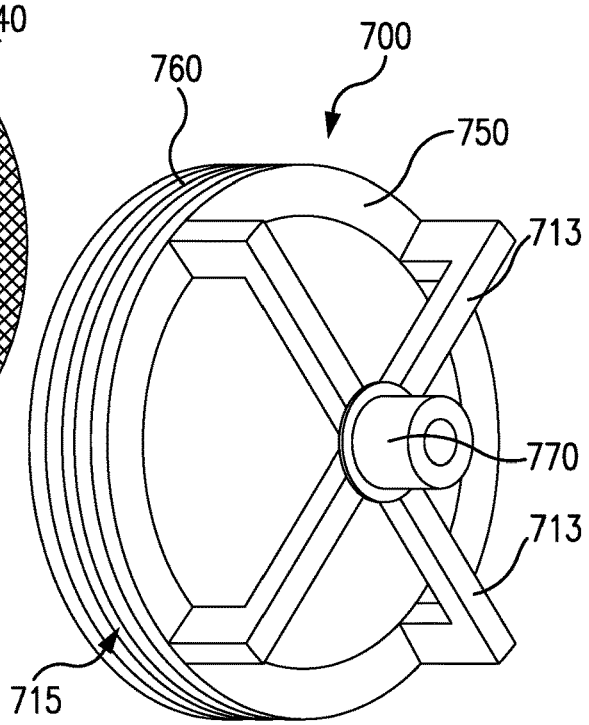
FIG. 18G is a view of a cantilevered flywheel ring supported by a number of flywheel struts.

FIG. 18G is a view of a cantilevered flywheel ring supported by a number of flywheel struts 713. In the example shown in FIG. 18G, the contact surface 715 is the surface of the geared flywheel ring 760. In this embodiment, the geared flywheel ring 760 is supported by a number of flywheel struts 713. In this example, the number of flywheel struts 713 can be coupled to flywheel bearing 770 which can be driven by the rotor shaft 550.

Figure 19A:
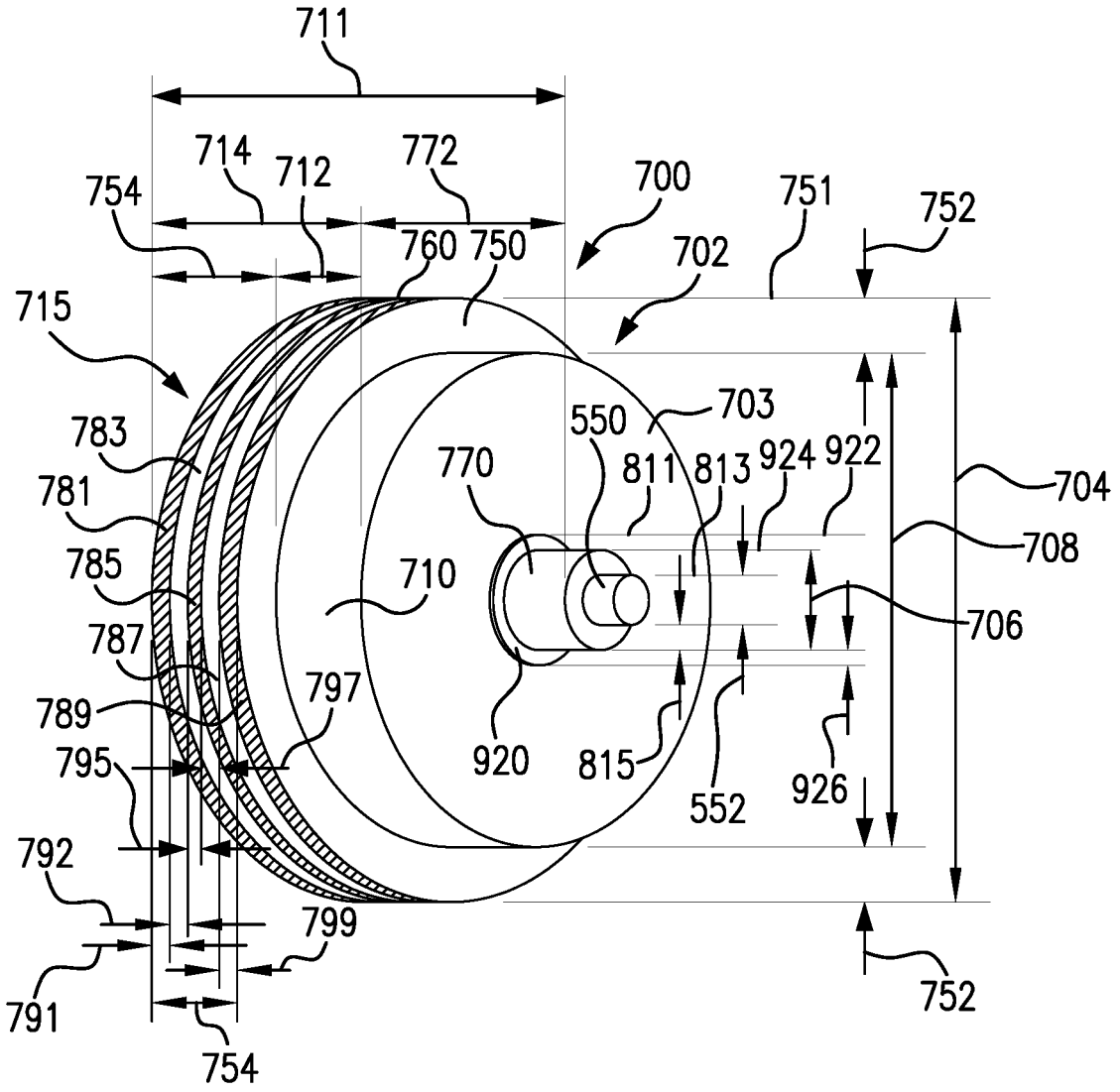
FIG. 19A is a perspective view of the cupped flywheel having dimensioning.

There is no limitation regarding the relative geometries of the features of the cupped flywheel 702. FIG. 19A is a perspective view of the cupped flywheel having dimensions. The example embodiment of FIG. 19 illustrates the flywheel 700 which is the cupped flywheel 702 having a flywheel outer diameter 704 and a flywheel inner diameter 706. The cupped flywheel 702 is born by the flywheel bearing 770 having a flywheel bearing length 772 and a flywheel bearing thickness 815. In an embodiment, a bearing support ring 920 having a bearing support ring width 926 of material can be used to transition the flywheel face 703 material and the flywheel bearing 770 between a bearing support ring outer diameter 811 (also shown as support outer diameter 922) and the flywheel inner diameter 706. As shown in FIG. 19A, the bearing support ring 920 and the flywheel bearing 770 can be supported by material at an interfacing portion which can be of one body in construction and which can extend between the bearing support ring inner diameter 924 and bearing support ring outer diameter 811. The flywheel bearing 770 can be coupled to rotor shaft 550 at an interface between flywheel bearing inner diameter 813 and rotor shaft 550 having a rotor outer diameter 552. The cupped flywheel 702 can have a flywheel body outside diameter 708 from which a flywheel ring can extend radially in a direction away from the rotor shaft 550 and have a flywheel ring height 752 as measured in FIG. 19A between the flywheel outer diameter 704 and the flywheel body outside diameter 708. The flywheel ring 750 can also have an outer diameter 751.

The cupped flywheel 702 can have a flywheel length 711 which in projection can be composed of a flywheel ring length 754, a flywheel body length 712 of flywheel body 710 and a flywheel bearing length 772. A flywheel cup length 714 can have a length which in its projection can be composed of the flywheel ring length 754 and the flywheel body length 712. Optionally, the flywheel bearing can be flat with the flywheel face 703, not have a projection and not contribute to the flywheel length 711. In other embodiments, the flywheel bearing is not used and has no contribution to the flywheel length 711.

FIG. 19A illustrates the cupped flywheel 702 having the flywheel ring 750 which has the contact surface 715 which is grooved and/or geared forming the geared flywheel ring 760. There is no limitation to the type of gearing, grooving or surface characteristics of the contact surface 715. In the embodiment of FIG. 19A, the geared flywheel ring 760 has flywheel ring length 754 and a number of gear teeth. As shown in FIG. 19A, the geared flywheel ring 760 has a first gear tooth 781 having first gear tooth width 791, a second gear tooth 785 having second gear tooth width 795, and a third gear tooth 789 having third gear tooth width 799. The first gear tooth 781 can be separated from the second gear tooth 785 by a first gear groove 783 having first gear groove width 792. The second gear tooth 785 can be separated from the third gear tooth 789 by a second gear groove 787 having second gear groove width 797.

Figure 19B:
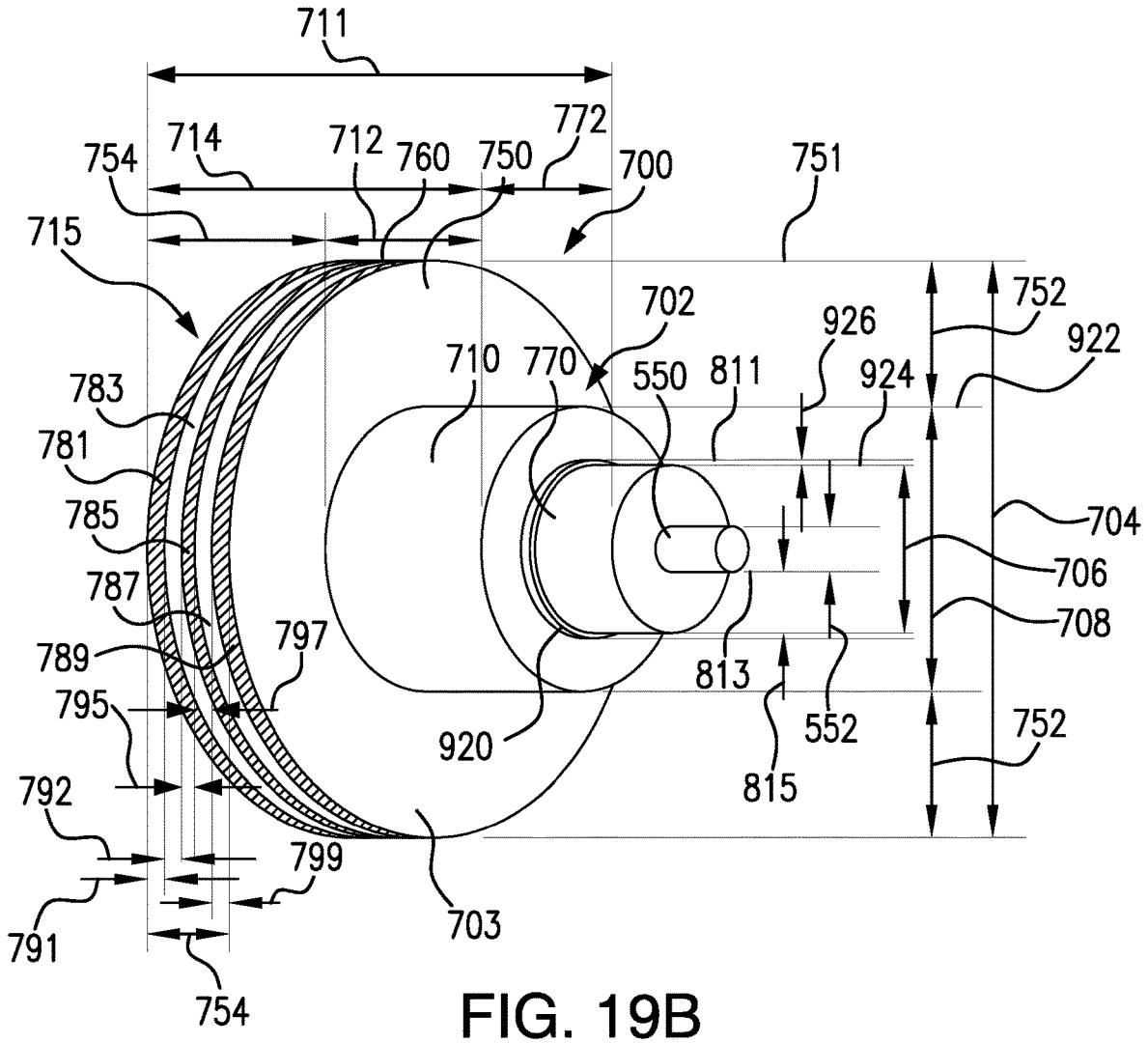
FIG. 19B is an example of the cupped flywheel having a narrow cup and wide flywheel ring.

FIG. 19B is an example of cupped flywheel having a narrow cup and wide flywheel ring. FIG. 19B is an example of another dimensional configuration of the cupped flywheel 702 having the flywheel ring 750. In the embodiment of 19B the flywheel body outside diameter 708 is less than that of the embodiment illustrated in FIG. 19A and the flywheel ring height 752 is greater than that of the embodiment illustrated in FIG. 19A. Any dimension of the flywheel 700 and the cupped flywheel 702 can be set to meet any design specifications.

Figure 21:
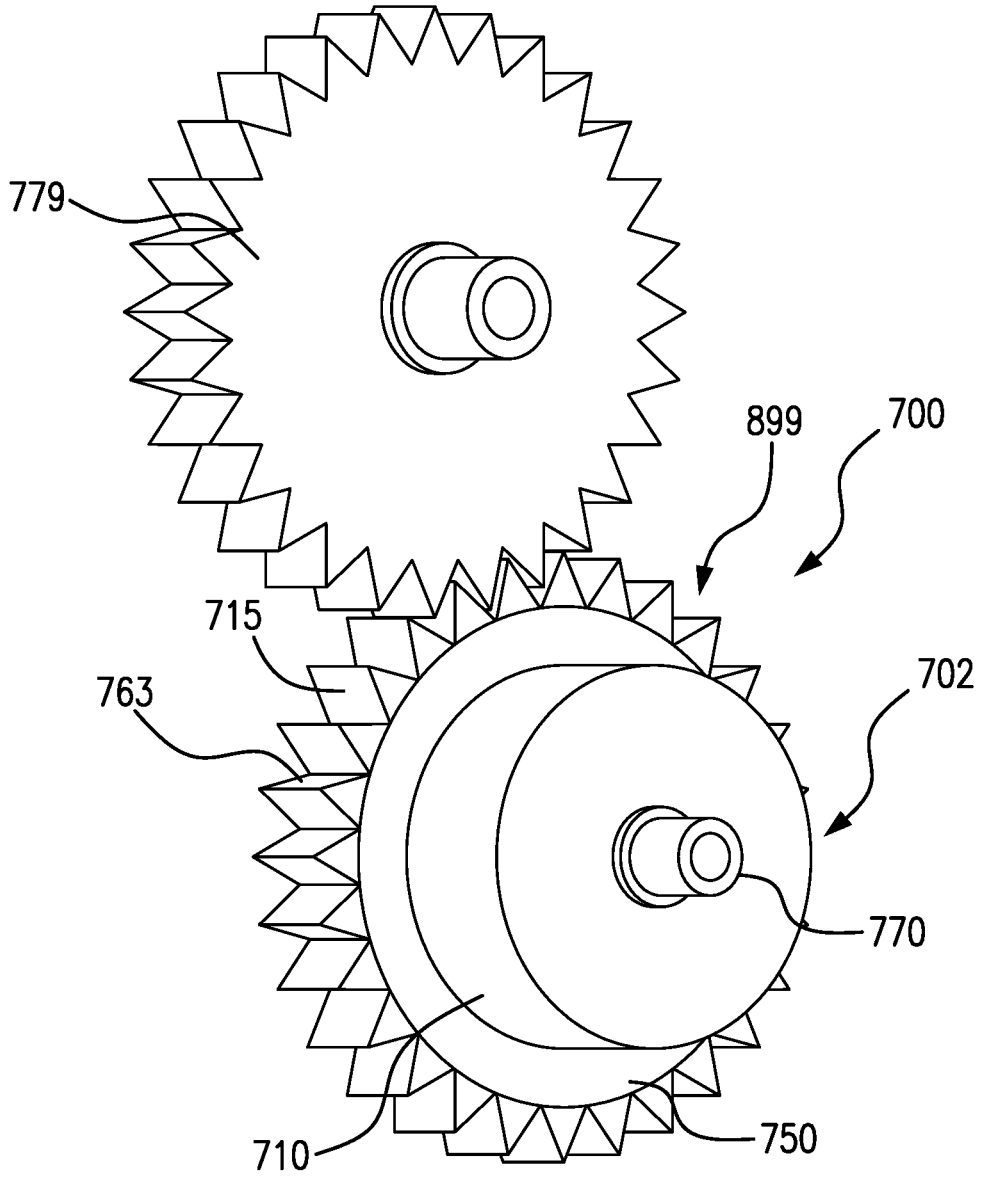
FIG. 21 is an embodiment of the cupped flywheel having a flywheel ring having axial gears.
Figure 24:
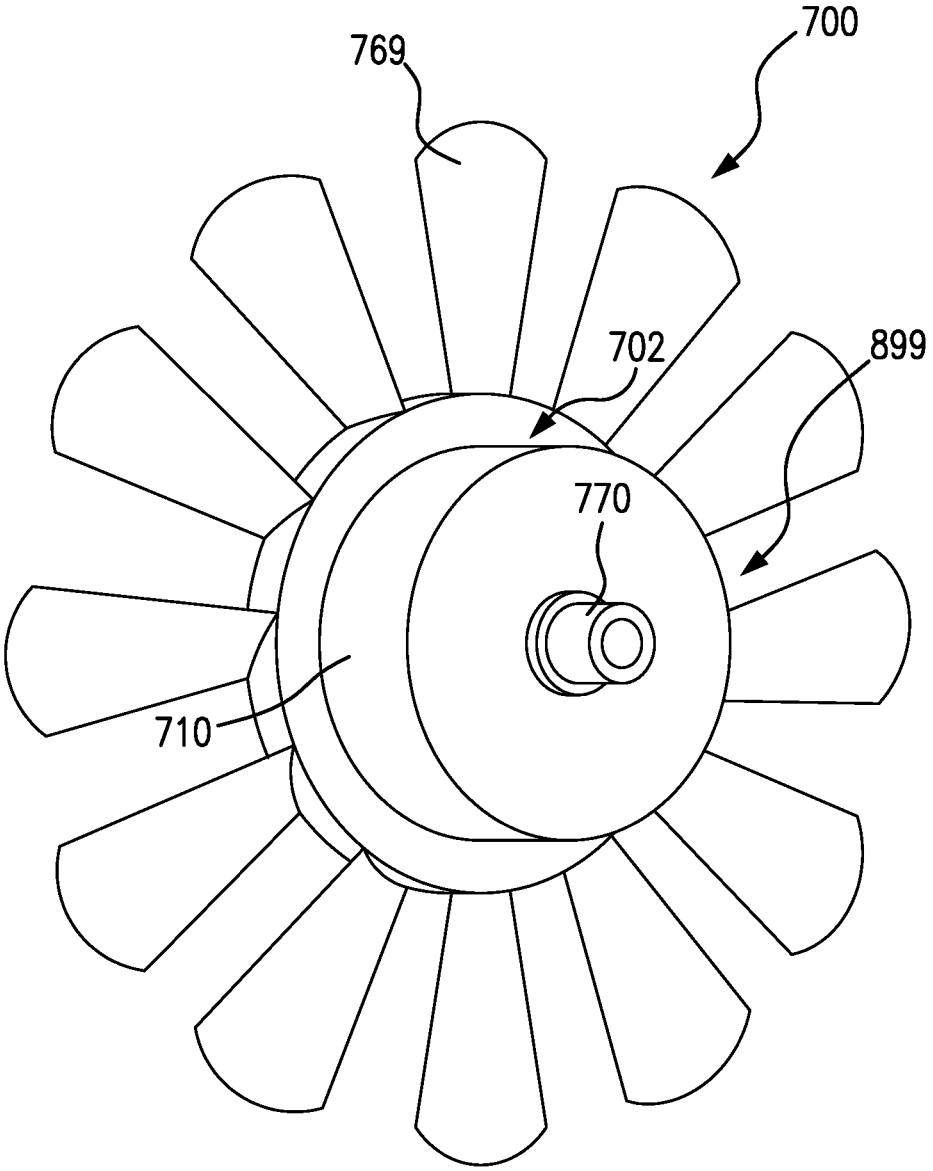
FIG. 24 is an embodiment of the cupped flywheel having a flywheel ring fan portion.

The application and use of a flywheel 700 which is a cantilevered flywheel 899, such as cupped flywheel 702 is not limited by this disclosure. In addition to a nailer 1, the cantilevered flywheel 899 which can be driven by an inner rotor motor 500 can be used with any power tool which can receive power from a flywheel directly or by means of a mechanism receiving power from the cantilevered flywheel 899. FIGS. 20 and 21 show examples to drive mechanisms which can use the cantilevered flywheel 899. FIGS. 22, 23 and 24 show examples types of power tool applications which can use the cantilevered flywheel 899. Power tools which can use the technology of this disclosure include but are not limited to fastening tools, material removal tools, grinders, sanders, polishers, cutting tools, saws, weed cutters, blowers and any power tool having a motor, such as in non-limiting example an inner rotor motor, whether brushed or brushless.

FIG. 20 is an embodiment of the cupped flywheel roller drive mechanism. In the example of FIG. 20, the flywheel ring 750 is a flywheel ring having flattened contact surface 761 having the contact surface 715 which is flattened in shape and which drives a first drive wheel 897 which drives a second drive wheel 898.

FIG. 21 is an embodiment of the cupped flywheel 702 having a flywheel ring 750 having axial gears. In the example of FIG. 21, the flywheel ring 750 is a flywheel ring having axial gears 763 which drives a gear 779.

FIG. 22 is an embodiment of the cupped flywheel 702 having the flywheel ring 750 which has a flywheel ring grinder portion 765.

FIG. 23 is an embodiment of the cupped flywheel 702 having the flywheel ring 750 which has a flywheel ring saw portion 767.

The cantilevered flywheel 899 can be used in any appliance which can receive power from a flywheel. FIG. 24 is an embodiment of the cupped flywheel 702 having the flywheel ring 750 which has a flywheel ring fan portion 769. The cantilever flywheel 899 can also be used in appliances such as fans, humidifiers, computers, printers, devices with brushed inner rotor motors, devices with brushless inner rotor motors and devices with motors having outer rotors. The cantilever flywheel 899 can also be used in automobiles, trains, planes and other vehicles. The cantilever flywheel 899 can be used in any device having an inner rotor motor.

Figure 25:
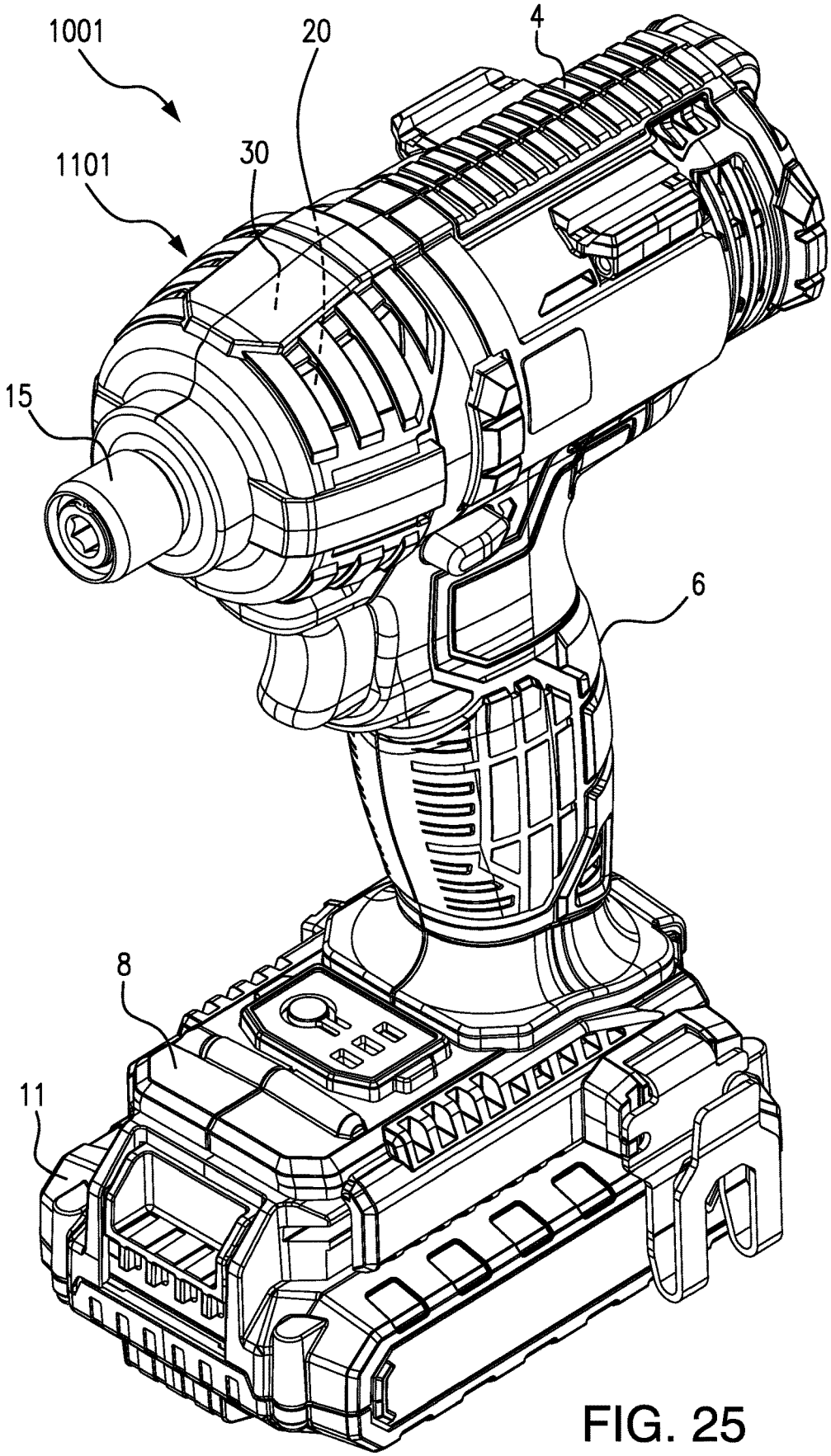
FIG. 25 is a perspective view of an impact driver.

FIG. 25 is a perspective view of an impact driver 1101. FIG. 1 shows an example of a fastening tool 1001 which is an impact driver 1101 having a housing 4 which houses an impact driver motor 20 (FIG. 26), drive mechanism 25 (FIG. 26), a handle 6 and base portion 8 with battery pack 11. The impact driver also has a driver control system which can control the impact driver motor 20 and a drive mechanism 25 which can have a gearbox 30 and bit holder assembly 15 which can be driven by the drive mechanism 25. In non-limiting example, the tool can be a screwdriver bit, a drill bit, or other bit which is compatible with driving a given fastener.

Figure 27:
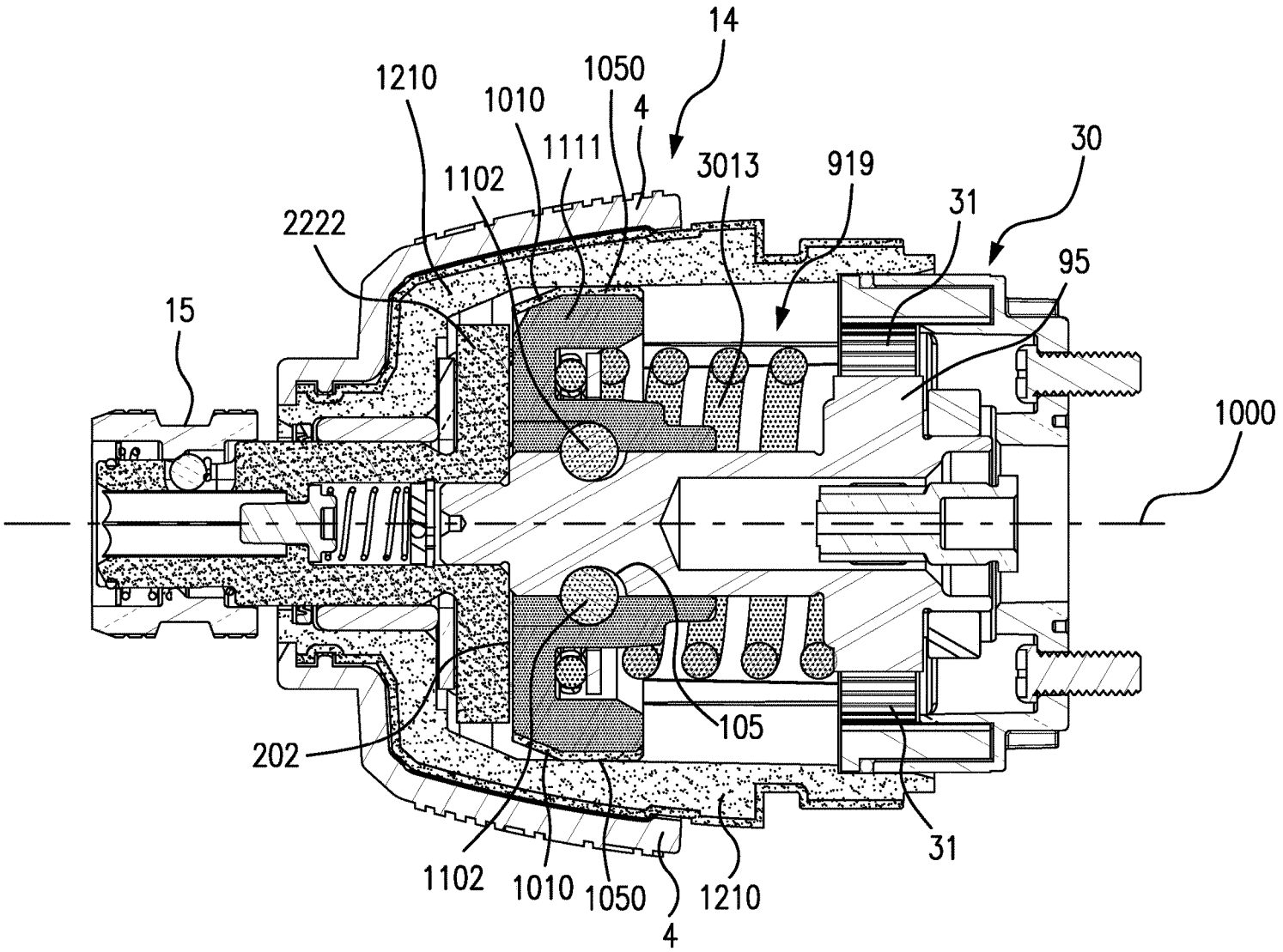
FIG. 27 is a sectional view of an impact mechanism having the sound damping material.

FIG. 26 is an exploded view of an impact driver 1101 having sound damping material 1010. FIG. 3 shows the impact driver 1101 in an exploded state. FIG. 3 shows the housing 4 having a left housing 4L and a right housing 4R configured to house a drive mechanism 29 having an impact driver motor 20, a gearbox 30 and a bit holder assembly 15. The gearbox can have a hammer 1111 (FIG. 27) and an anvil 2222 (FIG. 27). FIG. 3 also shows a driver control system 40 which can have a switch assembly 5015 and a pc board 555.

Figure 28:
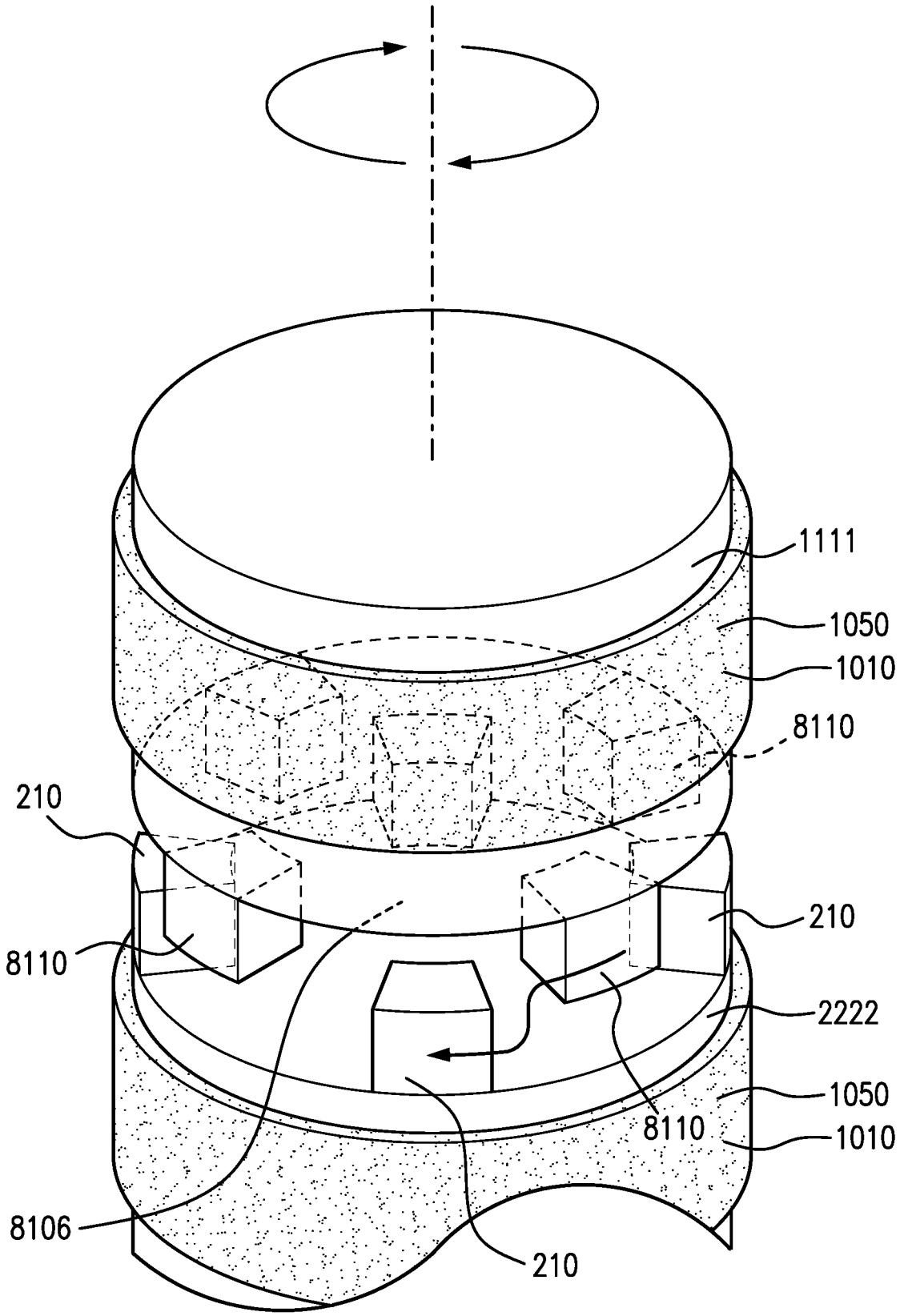
FIG. 28 shows a hammer having the sound damping material and an anvil having the sound damping material.

FIG. 27 is a sectional view of an impact mechanism 919 having the sound damping material 1010 applied to the housing 4 and also applied to the hammer 1111. FIG. 4 shows a nose housing 14 covering at least in part the impact mechanism 919 which has a gearbox 30, the hammer 1111, an anvil 2222 and a hammer spring 3013. In the embodiment of FIG. 4, the impact driver motor 20 provides energy to rotate an output spindle 95 in conjunction with gears 31 of the gearbox 30. In the embodiment of FIG. 27, the rotation of the output spindle 95 imparts energy to the hammer 1111 which energizes the hammer 1111 to rotate. Optionally, one or more of a hammer bearing 1102 can be used to guide the motion of the hammer 1111 and can facilitate the axial motion of the hammer 1111 along a length of an output spindle centerline and, optionally, a hammer guide groove. The hammer 1111 has a number of the hammer lug 8110 and which are positioned to respectively contact a corresponding number of an anvil lug 210 of the anvil 2222 (FIG. 28). The rotating hammer 1111 can impart energy to the anvil 2222 to achieve a rotational motion of the anvil 2222. The rotational motion of the anvil 2222 can cause a tool, such as a bit which can be held in the bit holder assembly 15, to turn. The turning of the tool, such as a bit, when applied to a fastener can drive the fastener into a work piece. An impact driver can have a portion of a driving sequence for a fastener which is an impacting phase.

When a resistance to turning of a fastener reaches an hammer retraction resistance, the hammer 1111 will move axially away from a portion of the anvil base 202 along output spindle axis 1000 with the guidance of one or more hammer bearings 1102 and the guide groove and be allowed to clear the anvil in a manner in which the hammer 1111 can rotate faster than the anvil 2222 for at least a part of a revolution of the hammer 1111. Then, the hammer 1111 can move axially along output spindle axis to return to a position to impact against and impart rotational energy to anvil 2222. This impacting sequence can be repeated until a driver release condition exists, or the trigger is released.

Undesired sound and/or noise can be emitted from the impact driver and/or impact mechanism during operation. The application of one or more sound damping members and/or vibration absorption members significantly reduces and/or eliminates such undesired sound. FIG. 27 illustrates a number of the sound damping member 1015 which has the sound damping material 1010. A shown in FIG. 27, a first of the sound damping member 1015 is the sound damping sheet 1210 which has been applied at least a portion of the inner surface of housing 4. A second of the sound damping member 1015 is the sound damping tape 1050 which is applied to at least a portion of the hammer 1111. FIG. 28 shows a hammer 1111 having the sound damping material 1010, which is the sound damping tape 1050. The sound damping tape 1050 of the hammer 1111 is applied to at least a portion of the hammer 1111.

The anvil 2222 of FIG. 28 has the sound damping material 1010, which is the sound damping tape 1050. The sound damping tape 1050 of the hammer 2222 is applied to at least a portion of the hammer 2222.

Example 1 and Example 2

Figure 29:
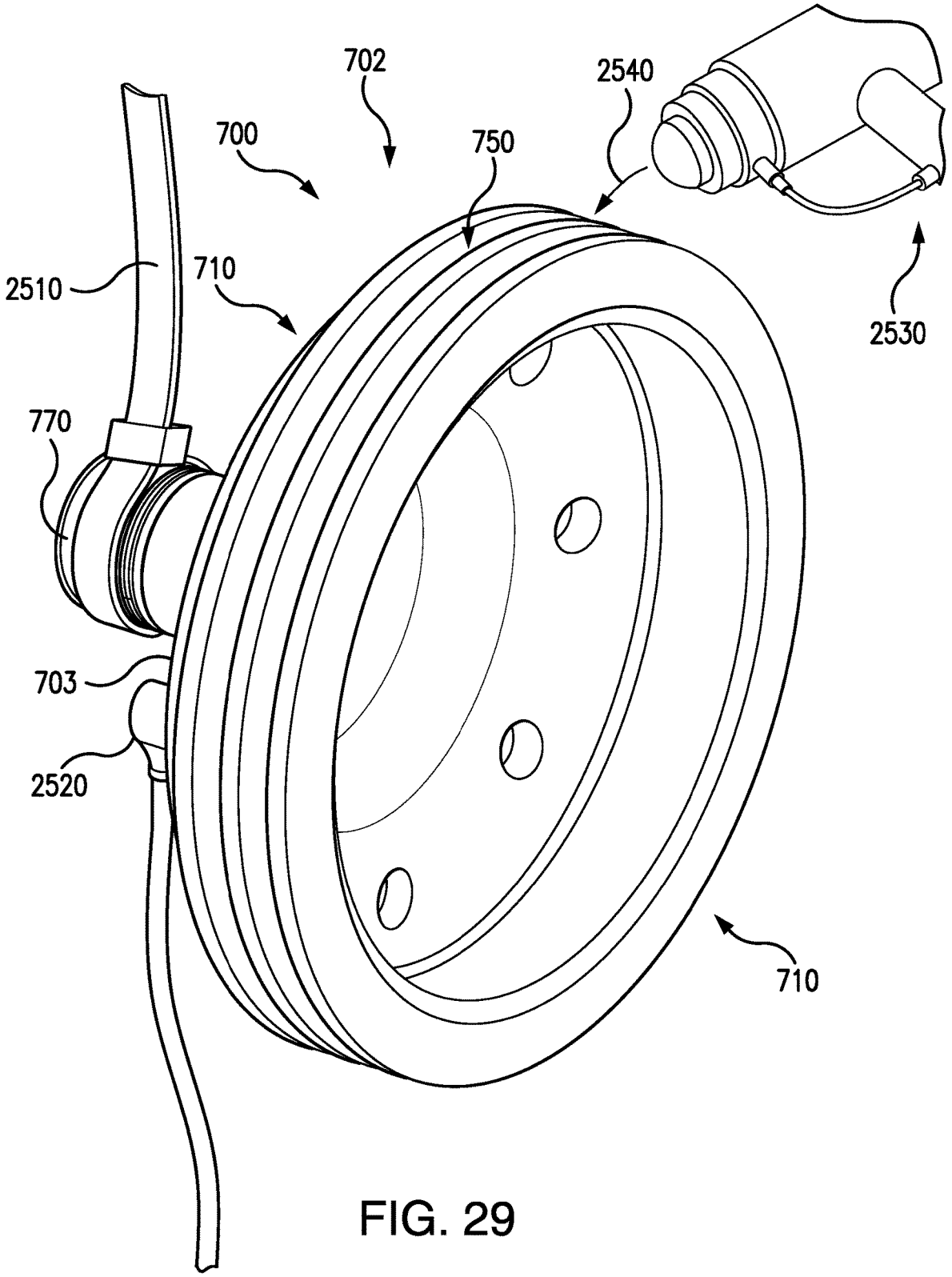
FIG. 29 shows the cupped flywheel without a sound damping member tested in Example 1.
Figure 30:
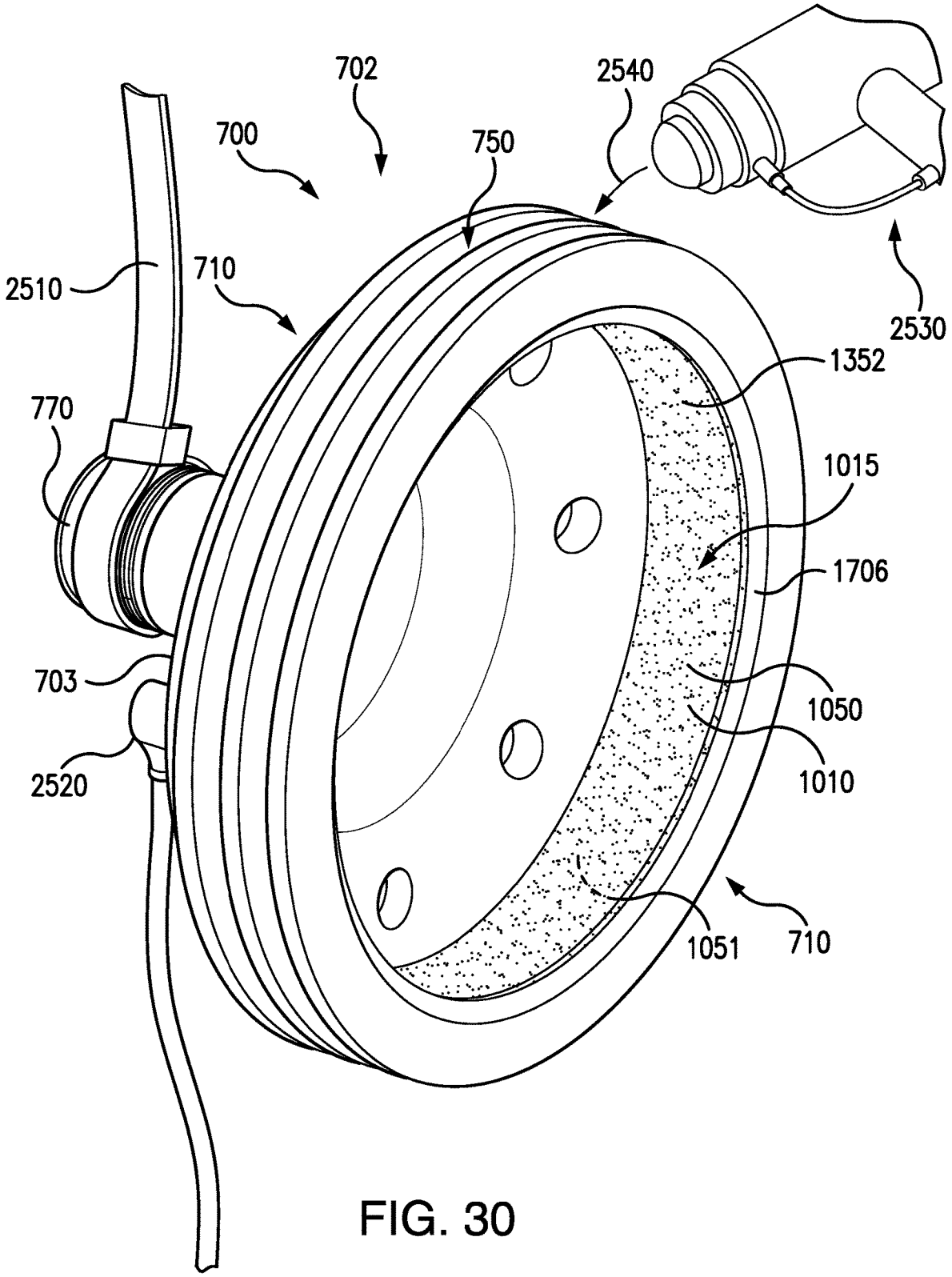
FIG. 30 shows the cupped flywheel having a sound damping member tested in Example 2.

FIGS. 29 through 36 collectively relate to Example 1 and Example 2. FIG. 29 shows the cupped flywheel without a sound damping member tested in Example 1. FIG. 30 shows of the cupped flywheel having a sound damping member tested in Example 2. FIGS. 31 through 36 collectively regard data and results from Example 1 and Example 2.

Example 1 and Example 2 regard comparative testing between a cupped flywheel 702 without a sound damping member 1015 and a cupped flywheel with a sound damping member 1015. The embodiment of the sound damping member 1015 tested in Example 1 and Example 2 is a vibration absorption member 1020.

Example 1 and Example 2 followed a Vibration And Sound Evaluation Procedure ("VASE Procedure") which has the following steps:

Step 1. Suspend a part by a means that does not influence the vibration and sound reaction and/or response (string, small wire, etc.) when the part, such as the cupped flywheel 702, is struck by a modal hammer 2530. As shown in FIG. 29, the parts of Example 1 and Example 2 were suspended by a zip tie 2510 which is thin and which is attached to the outside surface of the flywheel bearing 770.

Step 2. Attach the accelerometer 2520 to the part, such as the cupped flywheel 702, in a position that does not influence the vibration and sound reaction and/or response when the part is struck by the modal hammer 2530. In Example 1 and Example 2 the accelerometer 2520 was reversibly attached to the flywheel face 703 at a point proximate to the flywheel bearing 770 and not on the resonating region of the flywheel body 710, as shown in FIG. 30.

Step 3. Impact the part on the outer surface of the flywheel ring 750 with a modal hammer 2530 having a output to a spectrum analyzer. The striking force is normalized by dividing the acceleration (response) by the force (input) of the modal hammer 2530 strike. This data analysis and normalization is achieved by:

Sub-step 3.1. Acquire a signal from the accelerometer and hammer;

Sub-step 3.2. Apply a transfer function or frequency response used to normalize the results, to acceleration/force;

Step 4. Average the results of the data output from Step 3 for a number of trials 1 . . . n, e.g. n=5 trials, were n can be from 2 to a large number, such as 50 trials.

The results for Example 1 and Example 2 from the VASE Procedure identify resonances and damping. The respective data results disclosed herein of Example 1 and Example 2 are the averaged results respectively of the output data from 5 trials for each of Example 1 and Example 2.

The data results for Example 1 are the averaged results of the output data from 5 strikes (also herein as, 5 trials) of the cupped flywheel 702 without a sound damping member 1015 by the modal hammer, i.e. n=5. In Example 1, each strike of the modal hammer and the results produced from that 1 strike are 1 trial.

The data results for Example 2 are the averaged results of the output data from 5 strikes (5 trials) of the cupped flywheel 702 with the sound damping member 1015 by the modal hammer, i.e. n=5. In Example 2, each strike of the modal hammer and the results produced from that 1 strike are 1 trial.

FIG. 29 shows the cupped flywheel without a sound damping member tested in Example 1. FIG. 29 shows a cupped flywheel 702 suspended by a zip tie 2510 in accordance with the VASE Procedure and having an accelerometer 2520 attached. The cupped flywheel 702 used in Example 1 does not have a sound damping member 1015. Modal hammer 2530 is also shown which is used to strike the cupped flywheel 702 along striking arc 2540 for each trial.

FIG. 30 shows the cupped flywheel having a sound damping member 1015 tested in Example 2. FIG. 30 shows the cupped flywheel 702 suspended by a zip tie 2510 in accordance with the VASE Procedure and having an accelerometer 2520 attached. The cupped flywheel 702 used in Example 2 has a sound damping member 1015 which is a sound damping tape 1050. The sound damping tape 1050 has the sound damping material 1010. Modal hammer 2530 is also shown which is used to strike the cupped flywheel 702 along striking arc 2540 for each trial.

Figure 31:
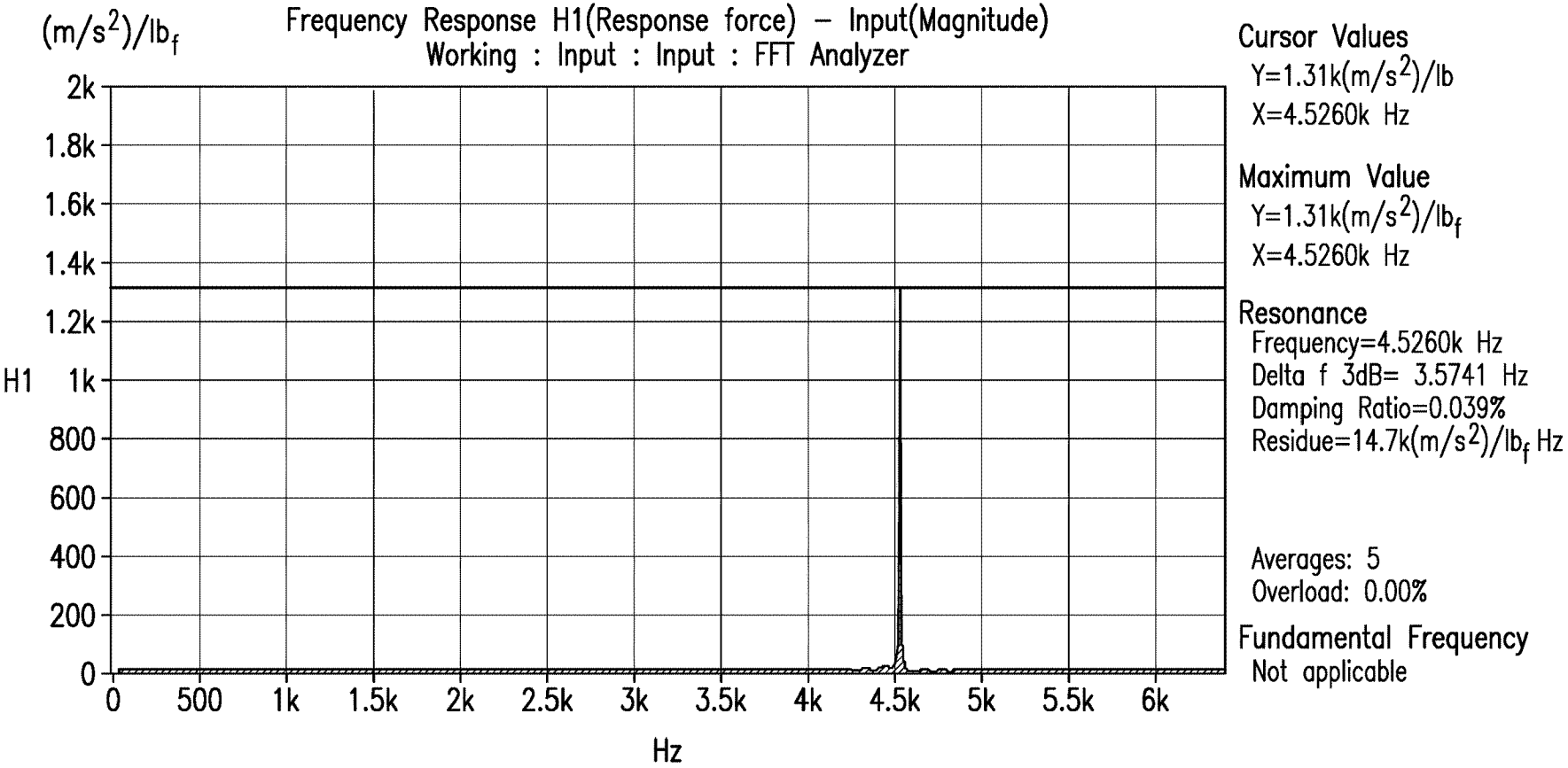
FIG. 31 shows a graph of frequency response data for the cupped flywheel without a sound damping member tested in Example 1.

For Example 1, FIG. 31 shows a graph of vibration response H1 data for the test of the cupped flywheel 702 without a sound damping member 1015. The frequency response for the cupped flywheel 702 without a sound damping member 1015 of Example 1 was 1,310 (m/s^2)/lb at 4,526 Hz.

In an embodiment, the sound damping member, which can be a vibration absorption member, provides vibration damping in a frequency range of at least 80 Hz to 50,000 Hz, such as 1000 Hz to 20,000 Hz, or 500 Hz to 15,000 HZ, or 500 Hz to 15,000 Hz, or 1000 Hz to 10,000 Hz, or 1000 Hz to 8,000 Hz, or 1000 Hz to 5,000 Hz, or 500 Hz to 30,000 Hz, or 500 Hz to 20,000 Hz.

In an embodiment, the sound damping member provides sound damping of noise from a part which is damped in a frequency range of at least 80 Hz to 50,000 Hz, such as 1000 Hz to 20,000 Hz, or 500 Hz to 15,000 HZ, or 500 Hz to 15,000 Hz, or 1000 Hz to 10,000 Hz, or 1000 Hz to 8,000 Hz, or 1000 Hz to 5,000 Hz, or 500 Hz to 30,000 Hz, or 500 Hz to 20,000 Hz.

In an embodiment a decrease in emitted noise from the part and/or vibration of the part can be reflected in a vibration damping ratio. The vibration damping ratio is a measure of the decrease in signal amplitude as a function of time. The vibration damping ratio herein is calculated as follows: Vibration damping ratio=actual damping/critical damping, taken at the resonant frequency.

In example 1 and example 2, the frequency response and vibration damping ratio were tested using a Bruel & Kjaer Noise and Vibration Measurement System (BK NVMS) (433 Vincent Street West, West Leederville, Wash. 6007) which receives input from a modal hammer. Further, in Example 1 and Example 2, a BK NVMS acquisition system was employed in conducting the data analysis and vibration damping ratio calculations.

A vibration damping ratio 0.039% was found for the cupped flywheel 702 without a sound damping member 1015 tested in Example 1.

In Example 1 and Example 2 the frequency response H1 is normalized as acceleration/pounds force, i.e. (m/s^2)/lbf (also "$(m/s^2)/lb_f$").

As shown in FIGS. 31 through 36, damping is shown to create the difference in vibration which produces differences and/or reductions in noise and/or sound.

Figure 32:
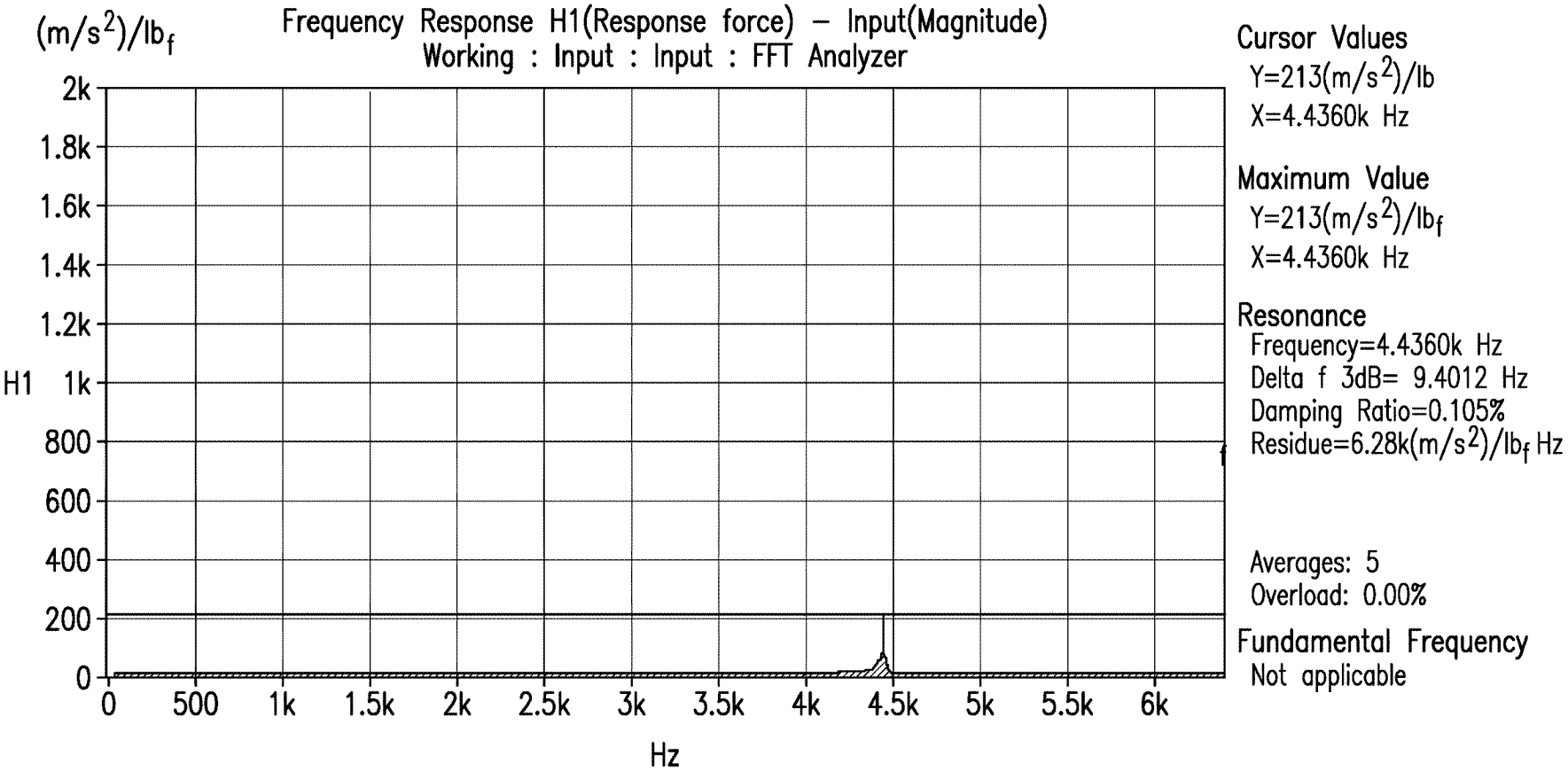
FIG. 32 shows a graph of frequency response data for the cupped flywheel having a sound damping member tested in Example 2.

FIGS. 31 and 32 each provide a value of Delta f. Delta F is the half power bandwidth. Delta f 3 dB correlates to two points on either side of the peak at this 3 dB reduction on the FFT (fast Fourier transform output). The larger the Delta f 3 dB or range between the points, the greater damping.

FIG. 32 shows a graph of vibration response dated for the cupped flywheel having a sound damping member 1015 tested in Example 2. The frequency response for the cupped flywheel 702 with a sound damping member 1015, which for Example to is the sound damping tape 1050, was 213 (m/s^2)/$lb_f$ at 4,436 Hz. In example 2, a vibration damping ratio is 0.105% was found for the cupped flywheel 702 with the sound damping tape 1050 having sound damping material 1010.

The Delta f 3 dB values found in Example 1 and Example 2 were compared. FIG. 31 shows that that the testing of Example 1, which does not use the sound damping member 1015, yields a Delta f 3 dB of 3.5741 Hz. FIG. 32, shows that that the testing of Example 2, which uses the sound damping member 1015 applied to the cupped flywheel 702 and which is damped, has a Delta f 3 dB of 9.4012 Hz. Comparing the results of Example 2 which is damped by the use of the sound damping member 1015 to Example 1 which is not damped evidences the significant damping achieved. A ratio of the Delta f 3 dB for Example 2 to the Delta f 3 dB for Example 1 can be determined by 9.4012 Hz (Example 2)/3.5741 Hz (Example 1) to be equal to 2.63. It is shown by the ratio of Example 2 Delta f 3 dB to the Example 1 Delta f 3 dB that the half power bandwidth evidences significant damping by the use of a sound damping member 1015 (e.g. Example 2) as compared to an undamped test (e.g. Example 1).

FIGS. 33-36 are time plots which by comparison of results from Example 1 and Example 2 evidence the cupped flywheel 702 with the sound damping tape 1050 has much less energy and decays at a faster rate due to the higher vibration damping ratio.

Figure 33:
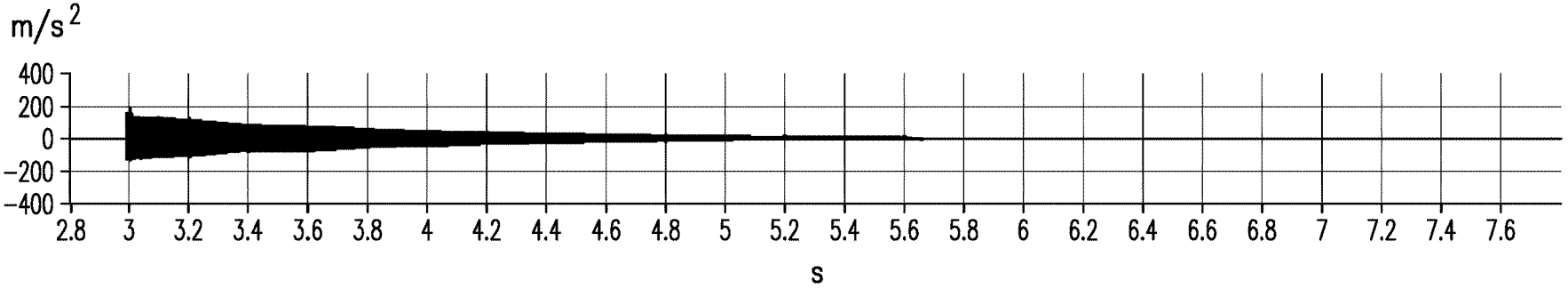
FIG. 33 shows an excerpted graph of vibration response dated for the cupped flywheel without a sound damping member tested in Example 1.

FIG. 33 shows an excerpted graph of vibration response data displayed as Acceleration (m/s^2) against Time (seconds(s)) for the cupped flywheel tested in Example 1 without a sound damping member.

Figure 34:
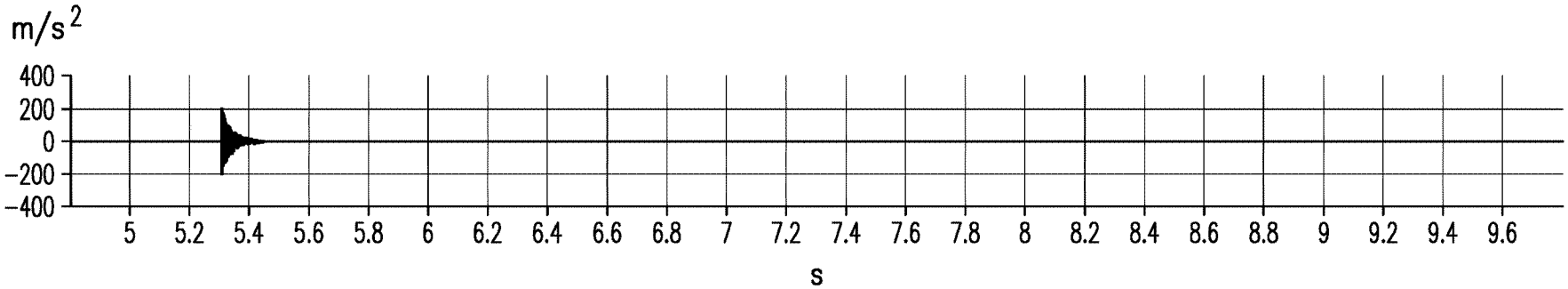
FIG. 34 shows an excerpted graph of vibration response dated for the cupped flywheel having a sound damping member tested in Example 2.

FIG. 34 shows an excerpted graph of vibration response data displayed as Acceleration (m/s^2) against Time (seconds(s)) for the cupped flywheel in Example 1 having a sound damping member.

Figure 35:
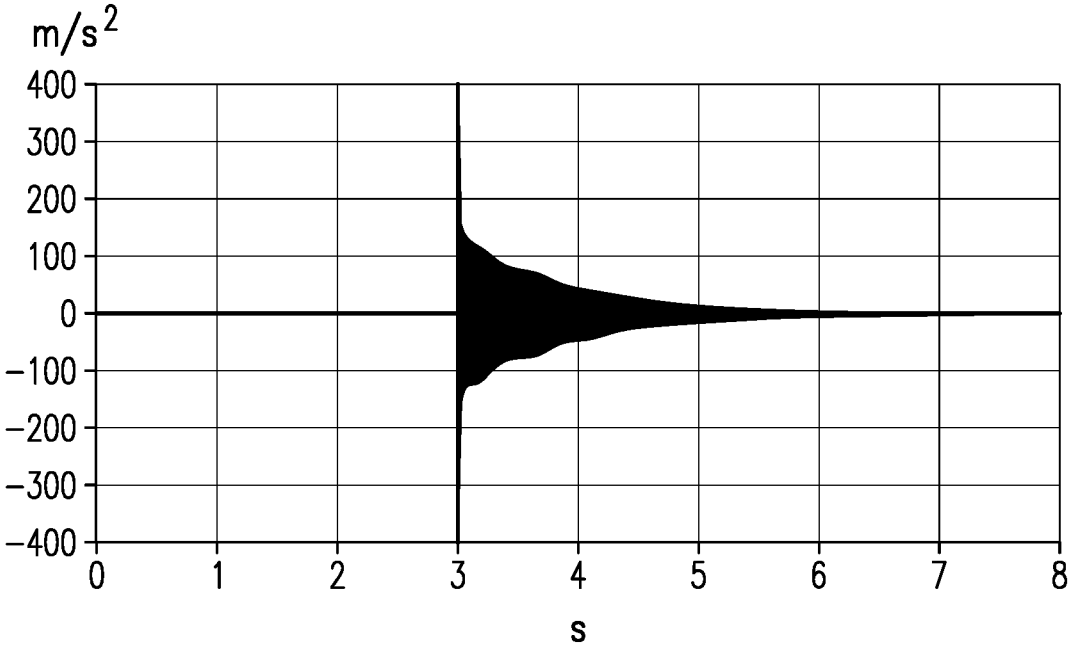
FIG. 35 shows Response versus Time data for testing of the cupped flywheel without a sound damping member tested in Example 1.

FIG. 35 shows time versus response data for the Example 1 test of the cupped flywheel 702 without a sound damping member.

Figure 36:
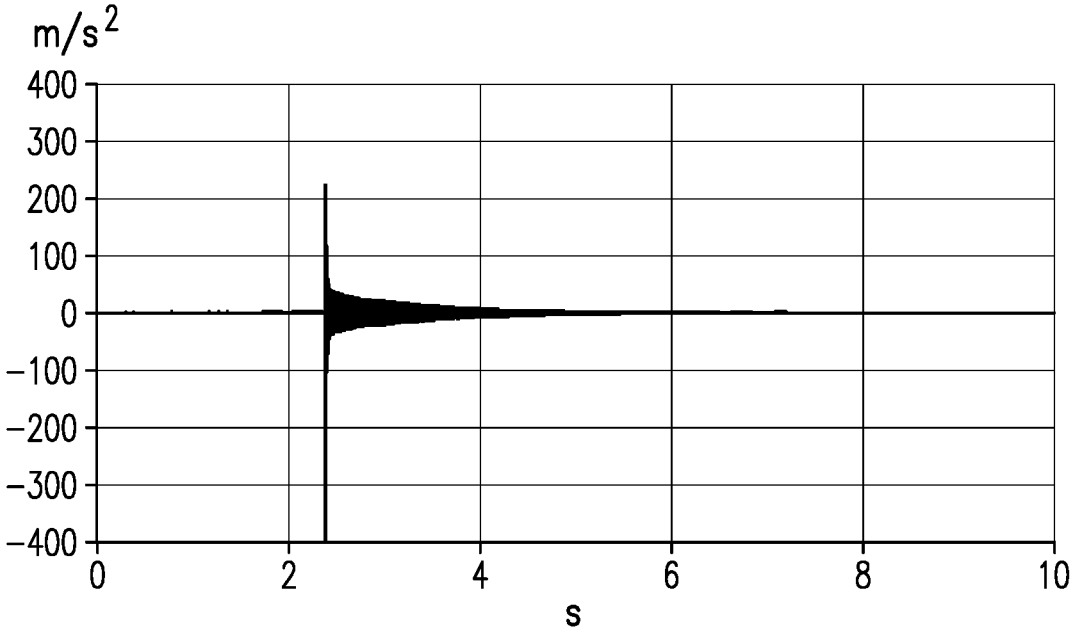
FIG. 36 shows Response versus Time data for testing of the cupped flywheel having a sound damping member tested in Example 2.

FIG. 36 shows time versus response data for the Example 2 test of the cupped flywheel 702 having a sound damping member.

The results of Example 1 and Example 2 evidence that the application of a sound damping member 1015 significantly reduces the magnitude of the vibration produced by a power tool and the amplitude of the sound produced by the vibration, as described in the present application. It has also been found that the magnitude of the vibration of a sound producing part, such as the cupped flywheel 702, can be reduced to a large degree, such as up to 80% reduction. For example, the maximum magnitude of a vibration produced by a power tool component or power tool may be reduced by 30% or more; 40% or more; 50% or more; 60% or more; 70% or more; or 80% or more, as compared to a power tool or component without a sound damping member. A sound produced can therefore be reduced. For example, a maximum amplitude of the sound can be reduced by 30% or more; 40% or more; 50% or more; 60% or more; 70% or more; or 80% or more, as compared to a power tool or component without a sound damping member.

The results of Example 1 and Example 2 evidence that the application of a sound damping member 1015 which is a vibration absorption member 1020 can significantly reduce the magnitude of the vibrations produced by a power tool and the noise and/or sound generated by such vibrations.

In non-limiting example, a hearing range for humans can be 20 Hz to 20,000 Hz and can be more sensitive in a narrower range, such as 100 Hz to 15,000 Hz or 1,000 Hz to 4,000 Hz. By reducing the magnitude of sound produced by the power tool, the maximum value of the sound expressed as acceleration per pound-force $(m/s^2)/lb_f$ over these frequency ranges can be kept at or below 1,000 $(m/s^2)/lb_f$; at or below 800 $(m/s^2)/lb_f$ at or below 600 $(m/s^2)/lb_f$ at or below 500 $(m/s^2)/lb_f$. As shown in FIG. 32, the maximum magnitude can be kept to 213 $(m/s^2)/lb_f$, which occurs at a frequency of 4,436 Hz.

Further, vibrations of the cupped flywheel 702 over the frequency ranges of 20 Hz to 20,000 Hz, or 100 Hz to 15,000 Hz or 1,000 Hz to 4,000 Hz can be kept at or below 1,000 $(m/s^2)/lb_f$, such as at or below 800 $(m/s^2)/lb_f$, at or below 600 $(m/s^2)/lb_f$, at or below 500 $(m/s^2)/lb_f$, or at or below 500 $(m/s^2)/lb_f$. As shown in FIG. 32, the maximum magnitude can be kept to 213 $(m/s^2)/lb_f$, which occurs at a frequency of 4,436 Hz.

Decreasing the maximum magnitude of a sound and/or vibration produced by the power tool over the frequency ranges disclosed herein above can provide a more pleasant user experience by achieving a quieter operation of the power tool.

It has been found that the vibration damping ratio can be greatly improved by use of a sound damping member 1015, which can be a vibration damping member 1020. In non-limiting example, the vibration damping ratio can be increased by 50% or more, or 100% or more, by using a sound damping member 1015 as compared to not using a sound damping member 1015. When the vibration damping ratio is so increased, it can be greater than 0.05%; greater than 0.07%, or greater than 0.09%. As is evidenced by Example 2, the a vibration damping ratio of 0.105% was achieved by using a sound damping member 1015, which was a vibration absorption member 1020. Increasing the vibration damping ratio by the use of a sound damping member 1015, which can be a vibration absorption member 1020, greatly reduces the time during which a noise and/or vibration causing noise can have a significant resonance, as evidenced in the results disclosed in FIGS. 33 and 34. A vibration damping ratio in a range of 0.05% to 20% can be achieved by the use of the sound damping member 1015, which can be a vibration absorption member 1020.

The scope of this disclosure is to be broadly construed. It is intended that this disclosure disclose equivalents, means, systems and methods to achieve the devices, activities and mechanical actions disclosed herein. For each mechanical element or mechanism disclosed, it is intended that this disclosure also encompass and teach equivalents, means, systems and methods for practicing the many aspects, mechanisms and devices disclosed herein. Additionally, this disclosure regards a sound damping member, a vibration absorption member and a motor having a cantilevered flywheel and their many aspects, features, elements uses and applications. Such devices can be dynamic in their use and operation, this disclosure is intended to encompass the equivalents, means, systems and methods of the use of the power tool and its many aspects consistent with the description and spirit of the technologies, devices, operations and functions disclosed herein. The claims of this application are to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

We claim:

1. An impact driver, comprising:
a housing;
a motor housed in the housing;
a drive system including a hammer and an anvil;
a bit holder assembly; and
a sound damping material which reduces sound produced by the impact driver, wherein the sound damping material is disposed between an innermost wall of the housing and the drive system.

2. The impact driver of claim 1, wherein the sound damping material is on the anvil.

3. The impact driver of claim 1, wherein the sound damping material is on the hammer.

4. The impact driver of claim 1, wherein the sound damping material is adjacent to the anvil.

5. The impact driver of claim 1, wherein the sound damping material is adjacent to the hammer.

6. The impact driver of claim 1, wherein the sound damping material is on the innermost wall of the housing.

7. The impact driver of claim 1, wherein the sound damping material is a sound damping tape.

8. The impact driver of claim 1, wherein the sound damping material is configured to absorb vibration from one or more parts of the impact driver.

9. An impact driver, comprising:
a housing;
a motor housed in the housing;
a drive system including a hammer and an anvil;
a bit holder assembly; and
a sound damping material that is configured to absorb vibration from one or more parts of the impact driver, wherein the sound damping material is disposed between an innermost wall of the housing and the drive system.

10. The impact driver of claim 9, wherein the sound damping material is on the anvil.

11. The impact driver of claim 10, wherein the sound damping material is on the hammer.

12. The impact driver of claim 9, wherein the sound damping material is on the hammer.

13. The impact driver of claim 9, wherein the sound damping material is adjacent to the anvil.

14. The impact driver of claim 13, wherein the sound damping material is adjacent to the hammer.

15. The impact driver of claim 9, wherein the sound damping material is adjacent to the hammer.

16. The impact driver of claim 9, wherein the sound damping material is on the innermost wall of the housing.

17. The impact driver of claim 9, wherein the sound damping material is a sound damping tape.

18. An impact driver comprising:
a housing;
a motor housed in the housing;
a drive system including a hammer and an anvil;
a bit holder assembly; and
a sound damping material which reduces sound produced by the impact driver, the sound damping material disposed on at least one of the hammer and the anvil.

19. The impact driver of claim 18, further comprising sound damping material disposed on an inside of the housing.

20. The impact driver of claim 18, wherein the sound damping material is configured to absorb vibration from one or more parts of the impact driver.

* * * * *